United States Patent [19]

Abe et al.

[11] Patent Number: 4,840,877

[45] Date of Patent: Jun. 20, 1989

[54] SILVER HALIDE COLOR PHOTOGRAPHIC MATERIAL AND METHOD FOR PROCESSING THE SAME

[75] Inventors: Akira Abe; Keiji Mihayashi; Hidetoshi Kobayashi; Hirohiko Kato, all of Kanagawa, Japan

[73] Assignee: Fuji Photo Film Co., Ltd., Kanagawa, Japan

[21] Appl. No.: 94,638

[22] Filed: Sep. 9, 1987

[30] Foreign Application Priority Data

| | | | |
|---|---|---|---|
| Sep. 9, 1986 | [JP] | Japan | 61-212394 |
| Sep. 30, 1986 | [JP] | Japan | 61-231496 |
| Sep. 30, 1986 | [JP] | Japan | 61-231497 |

[51] Int. Cl.[4] ..... G03C 7/30; G03C 7/38

[52] U.S. Cl. ..... 430/350; 430/372; 430/387; 430/551; 430/555

[58] Field of Search ..... 430/555, 551, 550, 372, 430/377, 350, 387

[56] References Cited

U.S. PATENT DOCUMENTS

| | | | |
|---|---|---|---|
| 4,076,533 | 2/1978 | Otas et al. | 430/555 |
| 4,241,168 | 12/1980 | Arai et al. | 430/555 |
| 4,301,235 | 11/1981 | Ichijima et al. | 430/555 |
| 4,310,619 | 1/1982 | Ichijima et al. | 430/555 |
| 4,366,237 | 12/1982 | Ichijima et al. | 430/555 |
| 4,367,282 | 1/1983 | Yagihara et al. | 430/555 |

OTHER PUBLICATIONS

Carroll et al, *Introduction to Photographic Theory,* c. 1980, John Wiley & Sons, New York, pp. 96+97.

*Primary Examiner*—Richard L. Schilling

*Attorney, Agent, or Firm*—Sughrue, Mion, Zinn, Macpeak & Seas

[57] ABSTRACT

A silver halide color photographic material comprising a support having thereon at least one silver halide emulsion layer, wherein the silver halide color photographic material contains a magenta dye forming coupler represented by the general formula (I) and a compound represented by the general formula (II) in the same layer (I)

wherein $R_1$ is represents an aromatic group, an aliphatic group or a heterocyclic group; $R_2$ represents a substituent; Za, Zb, Zc and Zd, which may be the same or different, each represents an unsubstituted methine group, a substituted methine group or —N=, $$(R'—COO^-)_nM^{n+} \quad (II)$$

wherein R′ represents a substituent which imparts a diffusion-resistant property to the compound represented by the general formula (II); $M^{n+}$ represents a hydrogen ion, a metal ion or an ammonium ion; and n represents an integer from 1 to 4.

29 Claims, 1 Drawing Sheet

SILVER HALIDE COLOR PHOTOGRAPHIC MATERIAL AND METHOD FOR PROCESSING THE SAME

FIELD OF THE INVENTION

The present invention relates to a silver halide color photographic material containing a two-equivalent magenta coupler, which contains a small amount of silver, has good stability during perservation before exposure to light and is excellent in color image stability after processing. Also it relates to a method for processing the silver halide color photographic material, which method does not impair preservability of images in the color photographic material after processing, even when it is subjected to shortened time of processing or shortend time of drying or the amount of water for washing is significantly reduced.

BACKGROUND OF THE INVENTION

It has been well known that after a silver halide photographic light-sensitive material is exposed to light, an oxidized aromatic primary amine developing agent reacts with a dye forming coupler to form color images. In this process, color reproduction by a conventional substractive process is used to from color images composed of cyan, magenta, and yellow dyes, which are the complementary colors of red, green, and blue, respectively. The reaction of the coupler with the oxidation product of the color developing agent is carried out at an active site. The coupler having a hydrogen atom as a substituent at the active site is a 4-equivalent coupler, i.e., a coupler which stoichiometrically requires 4 mols of silver halide having a development nucleus as an oxidizing agent for forming 1 mol of dye.

On the other hand, a coupler having a group releasable in the state of an anion as substituent at the active site is a 2-equivalent coupler, i.e., a coupler which requires only 2 mols of silver halide having a development nucleus for forming 1 mol of dye. Accordingly, the processing time for the photographic light-sensitive materials can be shortened, and the sharpness of the color images formed is improved when the 2-equivalent coupler is used, as compared with using the 4-equivalent coupler, because it is generally possible to reduce the amount of silver halide in the light-sensitive layer and to reduce the thickness of the layer. Further, in 2-equivalent couplers, it is possible to change the coupling activity with respect to the color developing agent by changing the properties of releasing group.

Several attempts have been made to prepare 2-equivalent couplers from 5-pyrazoline type couplers which have been dominantly employed. For instance, the 4-position of the pyrazolone ring can be substituted with a thiocyano group as described in U.S. Pat. Nos. 3,214,437 and 3,253,924, an aryloxy group as described in U.S. Pat. No. 3,419,391, a 2-triazolyl group as described in U.S. Pat. No. 3,617,291, a halogen atom as described in U.S. Pat. No. 3,522,052, or an alkylthio group, an arylthio group or a heterocyclic thio group as described in U.S. Pat. No. 3,227,554, etc.

However, these 4-position substituted pyrazolone couplers have several diadvantages. They cause the formation of severe color fog; they have only a low coupling activity; they are chemically unstable per se and change into compounds which are unable to form color with the lapse of time; and they have many difficulties in their synthesis, etc.

Further, several 5-pyrazolone type two-equivalent magenta couplers having a heterocyclic substituent at the 4-position thereof are also known. More specifically, 5-pyrazolone couplers having at the 4-position thereof an imidazolyl group or a derivative thereof, a 1,2,4-triazolyl group or a derivative thereof or a 1,2,3-triazolyl group or a derivative thereof as described in West German Pat. (OLS) Nos. 2,536,191 and 2,651,353, or a pyrazolyl group or a derivative thereof as described in U.S. Pat. Nos. 4,310,619, 4,301,235 and 4,367,282, etc. are known.

Certainly, these couplers have good stability and color forming properties. However, they are still insufficient since increase in color image density may occur upon a lapse of time after processing of the photographic material containing them or they interact with a silver halide emulsion (for example, they adsorb to silver halide grains) whereby sensitivity is decreased.

Other compounds have been proposed as color formation improving agents or solubility improving agents, etc. More specifically, improvements in color formation and graininess provided by a carboxylic acid type compound having an ester group are described in European Pat. (OPI) No. 71, 122 (the term "OPI" as used herein means an "unexamined published application"). Further, in U.S. Pat. No. 3,700,454, it is described that an alkyl-substituted phenoxyalkyl carboxylic acid is employed as a solvent component for a coupler having an alkyl-substituted phenoxyalkanamido group to improve color forming property and solubility.

Silver halide color photographic materials (hereinafter simply referred to as color light-sensitive materials) are generally processed after color development by steps such as bleaching and fixing or bleaching, fixing and, further, washing with water, stabilizing, drying, etc. It has been strongly desired in recent years to conduct such processing in a shorter period of time. Such a requirement has been increased, particularly, for the processing of color light-sensitive materials for photographing, which usually require a processing time of 20 min. or longer.

In films such as color negative films or color reversal films which are printed or in which dye images formed are viewed using transmitted light, it is required that the dye images be formed in sufficient density and thus it is necessary to coat a great amount of silver halide in order to obtain high sensitivity. Further, it is also necessary to form a great amount of developed silver in a color developing step.

Coating of silver halide in such a great amount and formation of the developed silver in a great amount results in requiring a long period of time not only in the color developing step but also in a silver removing step including bleaching and fixing.

To reduce such a drawback, it has been known to use a two-equivalent coupler, requiring only two moles of silver halide having a development center instead of four-equivalent coupler, requiring four moles of silver halide having a development center stoichiometrically required for forming one mol of dye.

By the use of two-equivalent couplers, since the amount of silver halide in a light-sensitive layer can be reduced and the thickness of the layer can be reduced, significant benefits of rapid processing and improvement in the sharpness of the dye imagem can be obtained.

For this purpose, various two-equivalent cyan and yellow couplers have been practically used since they have high color forming properties and are stable themselves. However, magenta couplers have scarcely been put to practical use since their stability is inferior or their color forming performance is poor. For instance, 5-pyrazolone type couplers mainly used as magenta coupler with two-equivalent function, include pyrazolone ring substituted at the 4-position with thiocyano group described in U.S. Pat. Nos. 3,214,437 and 3,253,924, with aryloxy group described in U.S. Pat. No. 3,419,391, with 2-triazolyl group described in U.S. Pat. No. 3,617,291, with a halogen atom described in U.S. Pat. No. 3,522,052, with an alkylthio group, an arylthio group or a heterocyclic thio group described in U.S. Pat. No. 3,227,554, respectively.

However, when using the 4-position substituted pyrazolone couplers, there are several drawbacks: severe color fog is caused; coupling activity is much too low; the coupler is chemically unstable and turns into a compound incapable of color formation with the lapse of time; and there are many difficulties in view of their syntheses.

Further, 5-pyrazolone two-equivalent magenta couplers having a heterocyclic subtituent at the 4-position have been described in many patents. There have been proposed those couplers in which a 5-pyrazolone is substituted at the 4-position thereof with an imidazolyl group or its derivative, 1,2,4-triazolyl group or its derivative or 1,2,3-triazolyl group or its derivative as described in West German Pat. (OLS) Nos. 2,536,191 and 2,651,363; or with a pyrazole group or its derivative as described in U.S. Pat. Nos. 4,310,619, 4,301,235 and 4,367,282, etc.

Certainly, these couplers are stable themselves and have high coupling activity.

However, as described in Japanese Patent Application (OPI) No. 956/87, many of the above-described two-equivalent magenta couplers have various drawbacks in that they cause severe color fog; they have low coupling activity and cause insufficient color formation and the density of the dye image formed increases during preservation after processing, although the color forming properties thereof are good, etc.

Since such drawbacks of two-equivalent magenta couplers appear more remarkably in time-shortened processing, they can not actually attain the foregoing requirements, although they have a potential capability of reducing processing time.

Moreover, the reduction of processing time described above also permits miniaturization of a developing machine, and thus a large benefit is generally provided to color laboratories having a small working space. Therefore, in addition to the reduction of time for the color development step and the silver removing step including bleaching and fixing, it is desireble to shorten drying time, which requires the longest period in a conventional large size developing machine. For this purpose, various means have been investigated including, for example, increasing the amount of air for drying.

However, it has been found that when the color light-sensitive materials containing the above-describd azole releasing two-equivalent magenta couplers are processed using a drying step for 8 minutes or less, the density of the magenta color image gradually increases after processing. Due to this problem, it is not possible to reduce the drying step time when using the above-described two-equivalent magenta couplers, although color images having excellent sharpness are obtained. Consequently, it is difficult to sufficiently achieve the reduction in processing time which has been highly in the art.

In recent years, several approaches have been suggested for the purpose of reducing the amount of water used such as an amount of washing water, etc. in processing steps in view of environmental conservation, water resources or cost. For example, in S. R. Goldwasser "Water Flow Rates in Immersion-Washing of Motion Picture Film", *Journal of the Society of Motion Picture and Television Engineers,* No. 64, pages 248 to 253 (May, 1955), a method for reducing the amount of washing water by utilizing multi-stage water washing tanks and countercurrent water is proposed. Further, a system for saving water wherein color photographic materials are subjected to a stabilizing step substantially without a water washing step after a bleach-fixing step is disclosed in U.S. Pat. No. 4,336,324. These methods are effective for saving water, and have been applied to various types of automatic processing machines.

However, reduction of the amount of washing water leads to an increase in the amount of various kinds of processing solution components remaining in color light-sensitive materials after processing. The increase in the amount remaining causes fading of dye images or increases color stain after processing. These problems are particulrly notable when the processing time for a water washing step is reduced.

In order to solve these problems, the application of a multi-stage countercurrent process using a large number of tanks is disclosed in the article by S. R. Goldwasser mentioned above. However, the number of tanks for water washing is actually limited to 2 to 6 from the standpoint of the area required and cost. Therefore, this method is in sufficient. Another method is described in Japense Patent Application No. 233997/85 wherein fading is prevented by adding a sodium salt or potassium salt of a chelating agent to water for a washing step. However, this method has almost no effect on the fading of magenta dyes, although it is very effective in the prevention of fading of cyan dyes and yellow dyes. Further, it is described in Japanese Patent Application (OPI) No. 43741/86 that fading of magenta dyes is prevented by using a stabilizing solution with a controlled surface tension. However, it is difficult to obtain the desired effect.

Accordingly, in order to conduct development processing using a further reduced amount of water, development of a novel method which can prevent from degradation of image preservability, such as fading of magenta dyes and increase in color stain, has been strongly desired. In particular, it is important to solve the above-described problems in development processing of color photographic light-sensitive materials using two-equivalent magenta couplers, since two-equivalent magenta couplers have been mainly employed as magenta dye forming couplers in view of improvement in sharpness of images.

SUMMARY OF THE INVENTION

Therefore, an object of the present invention is to provide a silver halide color photographic material containing a two-equivalent 5-pyrazolone magenta coupler which forms a color image having good preservability.

Another object of the present invention is to provide a silver halide color photographic material containing a two-equivalent coupler which does not cause a reduction in sensitivity.

A still another object of the present invention is to provide a method processing a color photographic light-sensitive material by which color images of excellent photographic performance free from color fog and inferior color formation are obtained in a short period of processing time.

A still another object of the present invention is to provide a method for processing a color photographic light-sensitive material by which color images having good preservability are obtained in a short period of processing time.

A further object of the present invention is to provide a method for processing a color photographic light-sensitive material containing a two-equivalent magenta coupler in a short period of processing time to form color images having excellent stability.

A further object of the present invention is to provide a method for processing a color photographic light-sensitive material containing a two-equivalent magenta coupler, in which the drying step is shortened and miniaturization of a developing machine is realized, and excellent color images are obtained.

A further object of the present invention is to provide a method for processing a color photographic light-sensitive material by which color images free from color fog and inferior color formation and good sharpness are ontained.

A still further object of the present invention is to provide a method for processing a color photographic light-sensitive material, which prevents the degradation of image perservability in color photographic materials processed, even when the amount of washing water is significantly reduced.

A still further object of the present invention is to provide a method for processing a color photographic light-sensitive material, which not only enables the amount of washing water to be significantly reduced, but also provides images excellent in sharpness and preservability.

A still further object of the present invention is to provide a method for rapid processing a color light-sensitive material, which not only enables the amount of washing water to be significantly reduced, but also provides images excellent in sharpness and preservability.

Other objects of the present invention will become apparent from the following detailed description and examples.

These object of the present invention can be attained by a silver halide color photographic material comprising a support having thereon at least one silver halide emulsion layer, at least one layer of the silver halide color photographic material containing the combination of a magenta dye forming coupler represented by general formula (I) shown below and a compound represented by general formula (II)

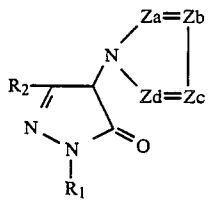

(I)

wherein $R_1$ represents an aromatic group, an aliphatic group or a heterocyclic group; $R_2$ represents a substituent; and Za, Zb, Zc and Zd, which may be the same or different, each represents an unsubstituted methine group, a substituted methine group or —N=, $$(R'—COO^-)_nM^{n+} \quad (II)$$

wherein R′ represents a substituent which imparts a diffusion-resistant property to the compound represented by the general formula (II); $M^{n+}$ represents a hydrogen ion, a metal ion or an ammonium ion; and n represents an integer from 1 to 4.

BRIEF DESCRIPTION OF THE ACCOMPANYING DRAWING

FIG. 1 is a graph showing magenta densities of Samples 403 and 404 at each processing step in Example 7.

DETAILED DESCRIPTION OF THE INVENTION

Figure 1:
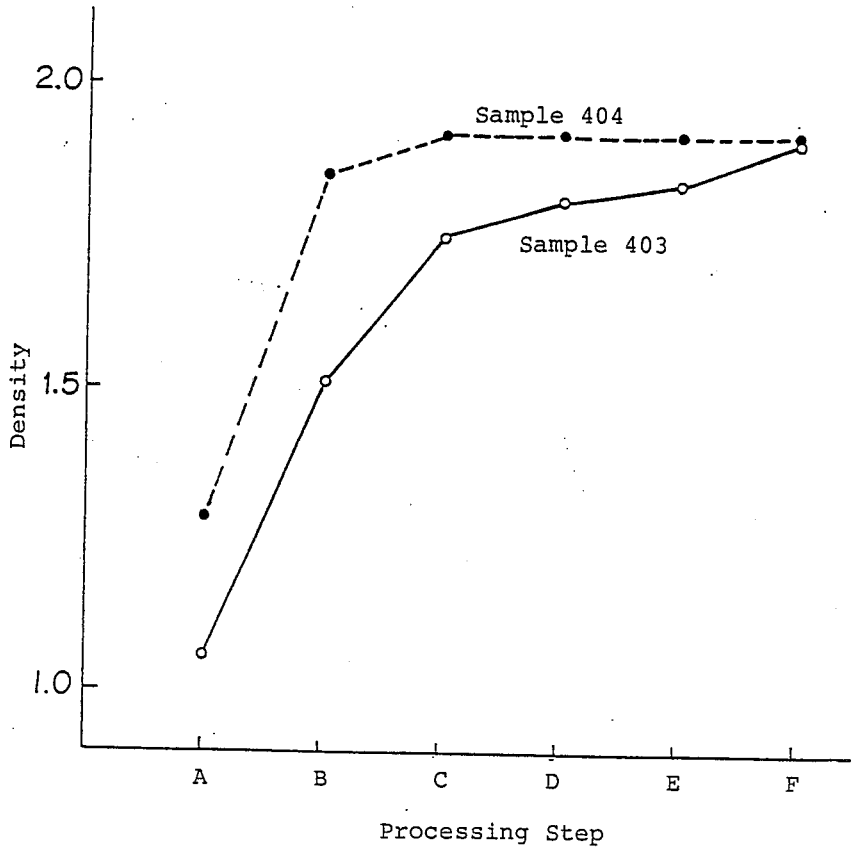

The magenta dye forming coupler represented by the general formula (1) which can be used in the present invention will be described in more detail below.

In the above described general formula (I) $R_1$ represents a straight chain or branched chain alkyl group having from 1 to 32 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an arylalkyl group (e.g., a benzyl group, a β-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_1$ may further represent an aryl group (e.g., a phenyl group an α- or β-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. More preferably $R_1$ is a phenyl group which is substituted with an alkyl group, an alkoxy group, a halogen atom, etc. at least one of the o-positions thereof, because it is effective to restrain coloration of couplers remaining in film layers due to light or heat.

Furthermore, $R_1$ may represent a heterocyclic group (e.g., a 5-membered or 6-membered heterocyclic ring containing as a hetero atom at least one of a nitrogen atom, an oxygen atom and a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the abovedescribed aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above described general formula (I), $R_2$ represents a hydrogen atom, a straight chain or branched chain alkyl group having from 1 to 32 carbon atoms, preferably from 1 to 22 carbon atoms, an alkenyl group, a cyclic alkyl group, an aralkyl group or a cyclic alkenyl group (which each may have one or more substituents as defined for the above described substituent $R_1$), an aryl group or a heterocyclic group (which each also may have one or more substituents as defined for the above described substituent $R_1$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.,), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a thioureido group (e.g., a thioureido group, an N-alkylthioureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., a n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), an acyloxy group (e.g., a benzoyloxy group, etc.), a sulfonyloxy group (e.g., a benzenesulfonyloxy group, etc.), a cyano group, a hydroxy group, a mercapto group, a halogen atom, a nitro group or a sulfo group.

Of the magenta dye forming couplers represented by the general formula (I), those wherein $R_2$ represents an anilino group, an acylamino group or an arylureido group and $R_1$ represents an aryl group which is substituted with a chlorine atom at least one of the o-positions are particularly preferred.

When Za, Zb, Zc or Zd represents a substituted methine group in general formula (I), the substituents may be selected from those as defined for $R_2$.

The nitrogen-containing ring formed by Za, Zb, Zc and Zd may further contain a condensed ring. For example, a 5-membered or 6-membered ring containing two adjacent groups selected from Za to Zd, preferably a hydrocarbon ring such as a cyclohexene ring, a cyclopentene ring, a benzene ring, and a naphthalene ring, etc., or a heterocyclic ring such as pyridine ring, a pyrimidine ring, a dihydrofuran ring, a dihydrothiophene ring, etc. can be present. These rings may be substituted with one or more substituents selected from those as defined for $R_2$. Za, Zb, Zc and Zd may be the same or different. However, a benzotriazolyl-1 group and benzotriazolyl-2 group are excluded from the condensed ring described above.

Particularly preferred couplers among the couplers of the general formula (I) used in the present invention are those wherein (1) the group of the formula

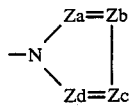

represents a 5-membered monocyclic nitrogen-containing aromatic heterocyclic group in which each of Za, Zb, Zc and Zd that each represents a methine group, a substituted methine group or —N=, or (2) the group of the formula

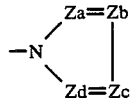

represents

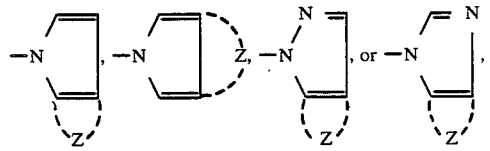

wherein Z represents a non-metallic atomic group necessary to complete a 5-membered or 6-membered ring.

The term "substituted methine group" has the same meaning as defined in general formula (I). The groups of

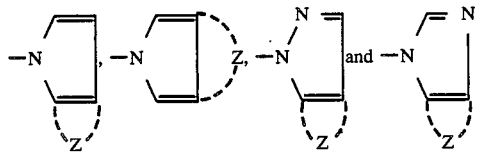

may be substituted with one or more substituents selected from those as defined for the substituted methine group. The 5-membered or 6-membered condensed ring portion represented by Z includes the condenced rings defined above for the general formula (I).

Specific examples of preferred nitrogen-containing heterocyclic groups represented by the formula

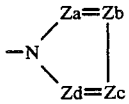

include a 1-imidazolyl group, a 2-methyl-1-imidazolyl group, a 2-methylthio-1-imidazolyl group, a 2-ethylthio-1-imidazolyl group, a 2,4-dimethyl-1-imidazolyl group, a 4-methyl-1-imidazolyl group, a 4-nitro-1-imidazolyl group, a 4-chloro-1-imidazolyl group, a 4-phenyl-1-imidazolyl group, a 4-acetyl-1-imidazolyl group, a 4-tetradecanamido-1-imidazolyl group, a 1-pyrolyl group, a 3,4-dichloro-1-pyrolyl group, a 2-isoindolyl group, a 1-indolyl group, a 1-pyrazolyl group, a 1-benzimidazolyl group, a 5-bromo-1-benzimidazolyl group, a 5-octadecanamido-1-benzimidazolyl group, a 2-methyl-1-benzimidazolyl group, a 5-methyl-1-benzimidazolyl group, a 7-purinyl group, a 2-indazolyl group, a 1,2,4-4-triazolyl group, a 1,2,3-1-triazolyl group, a 1-tetrazolyl group, etc.

The compound represented by general formula (I) may be connected to a main chain of a polymer at the protion of $R_1$, $R_2$ or

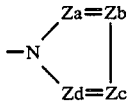

as those described in Japanese Patent Application (OPI) Nos. 35730/85 and 224352/83, and U.S. Pat. No. 4,367,828, etc.

Specific examples of preferred Compounds represented by general formula (I) are set forth below, but the present invention is not to be construed as being limited thereto.

M-1

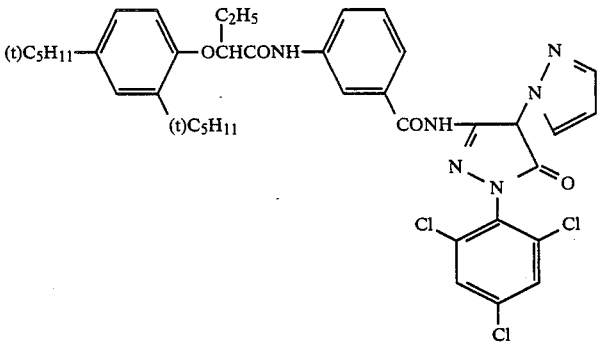

M-2

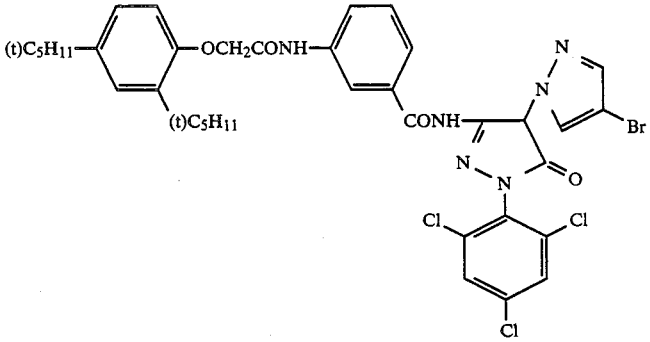

-continued
M-3
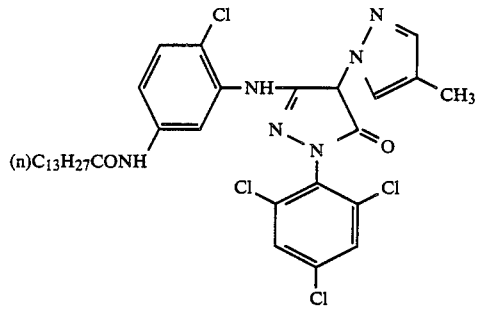
M-4
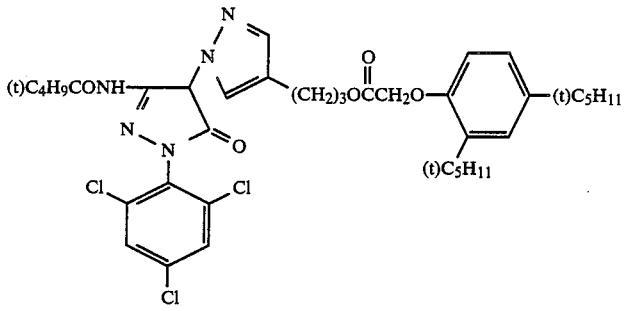
M-5
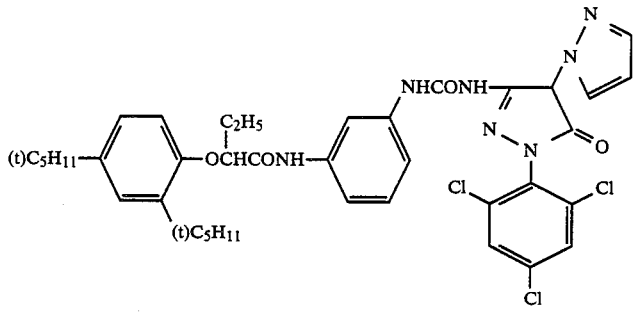
M-6
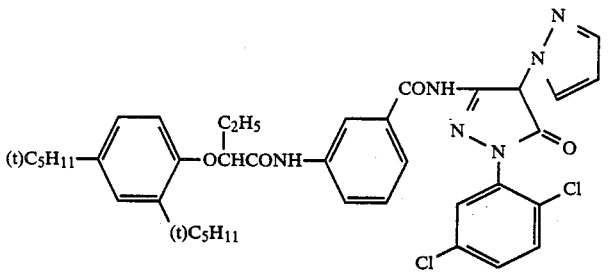
M-7
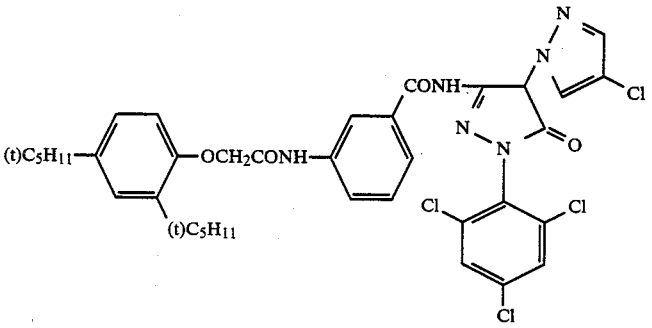

-continued
M-8
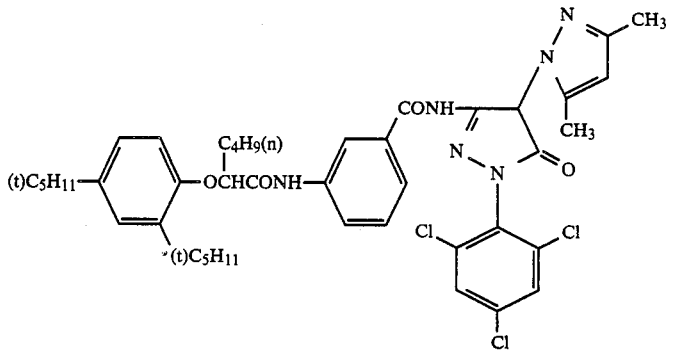
M-9
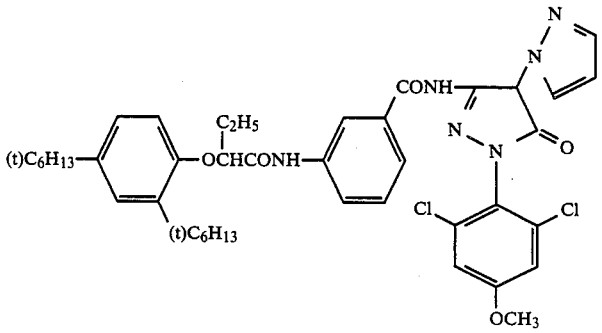
M-10
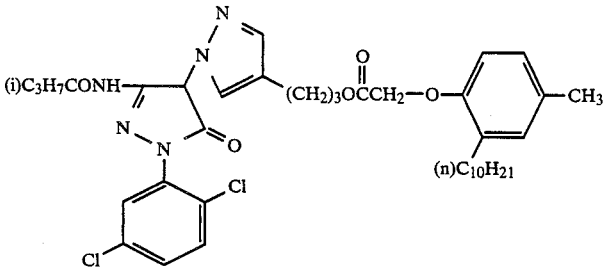
M-11
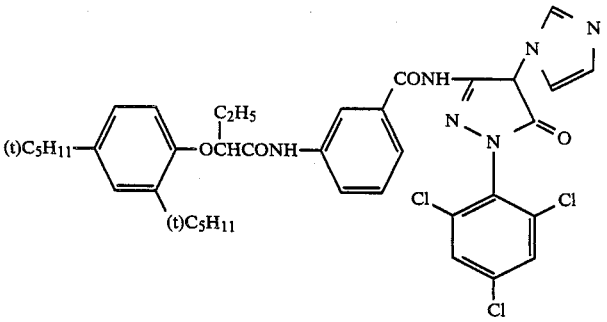
M-12
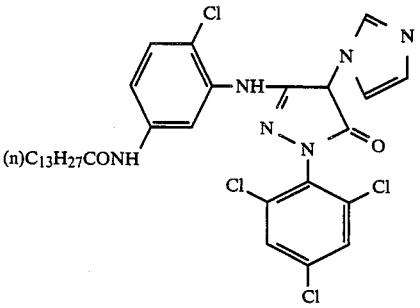

-continued
M-13
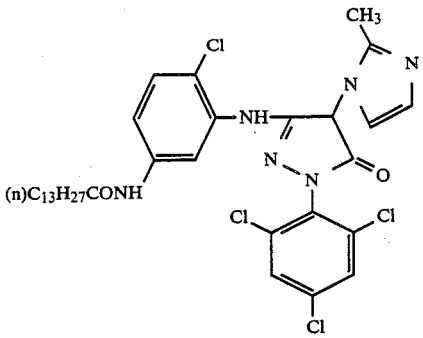
M-14
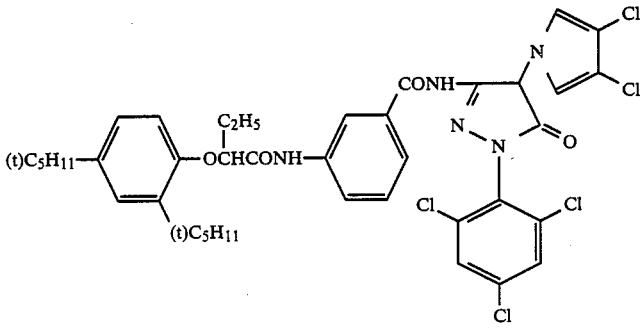
M-15
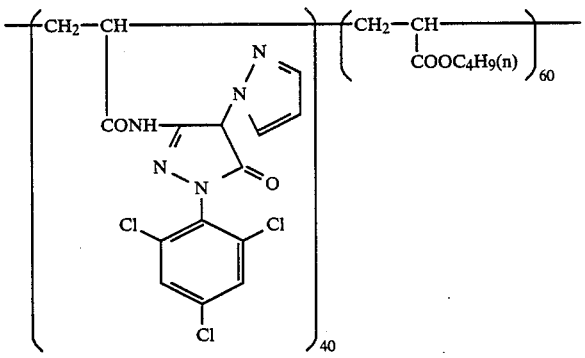
M-16
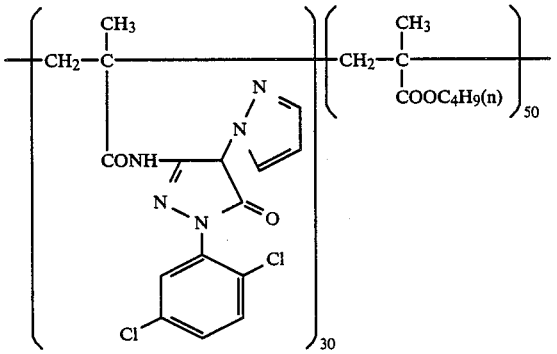

-continued
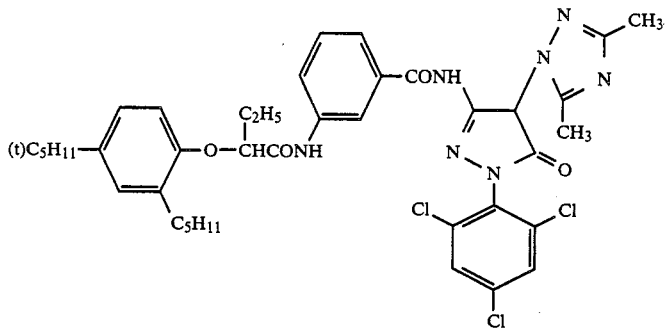
M-17
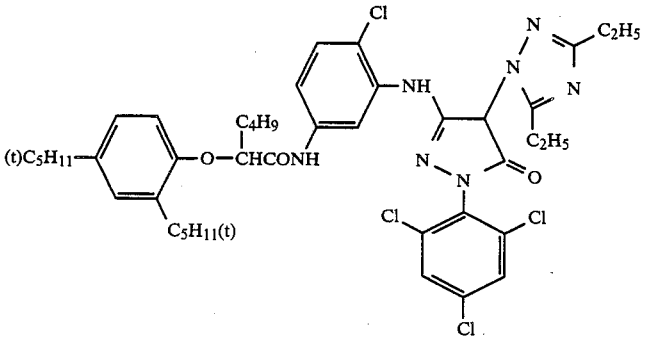
M-18
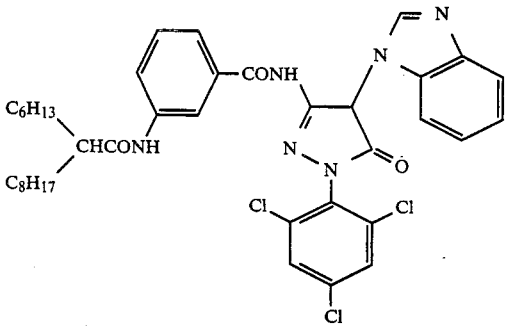
M-19
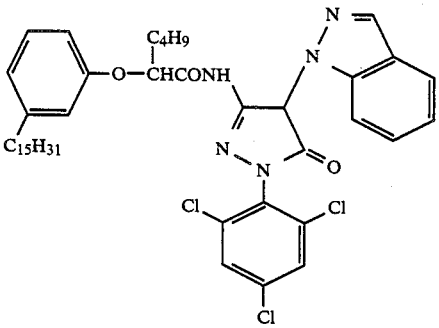
M-20

-continued
M-21
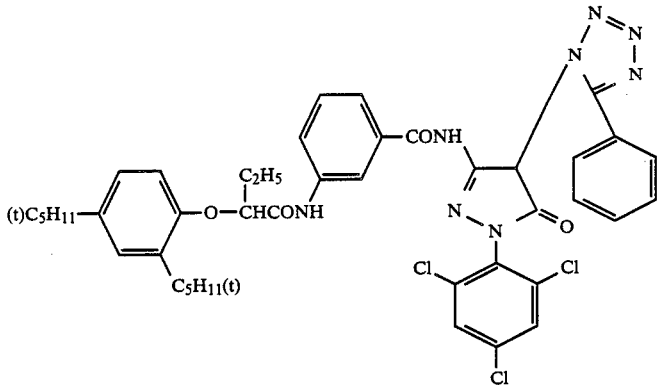
M-22
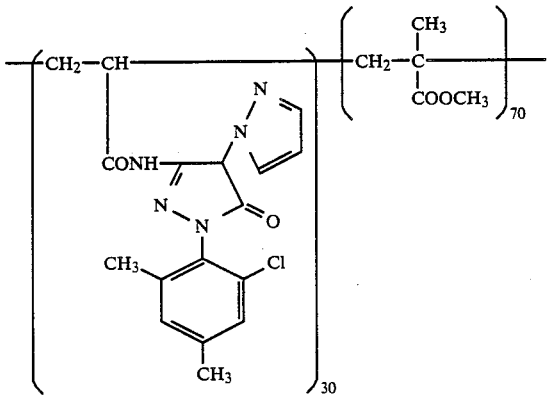
M-23
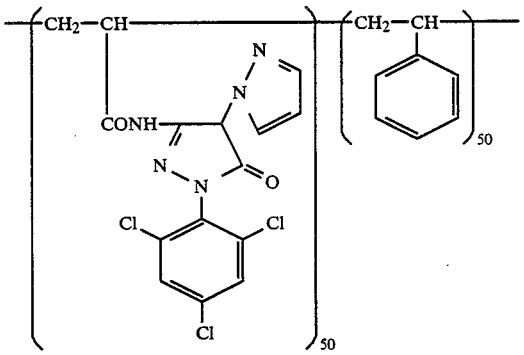
M-24
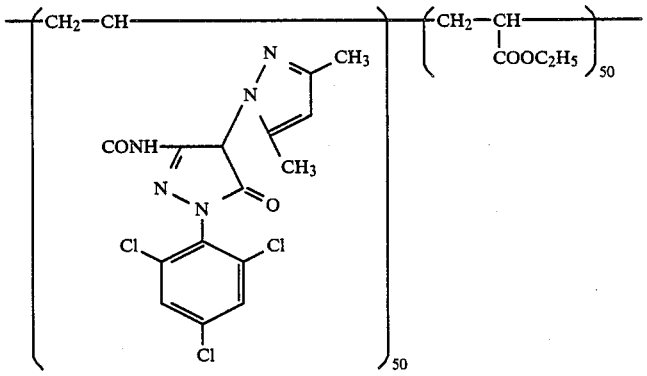

-continued
M-25
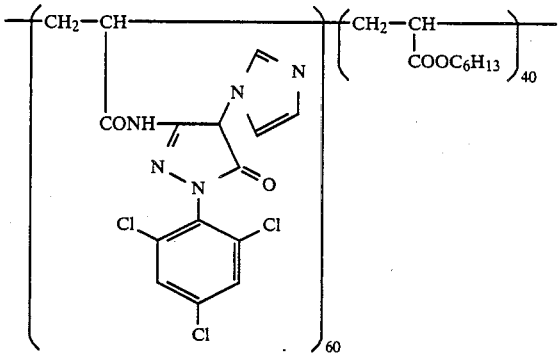
M-26
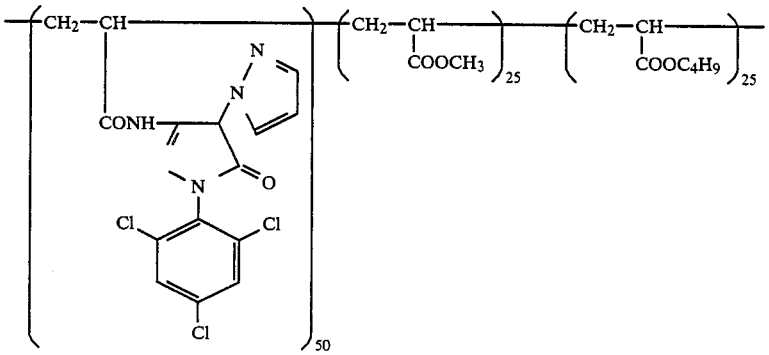
M-27
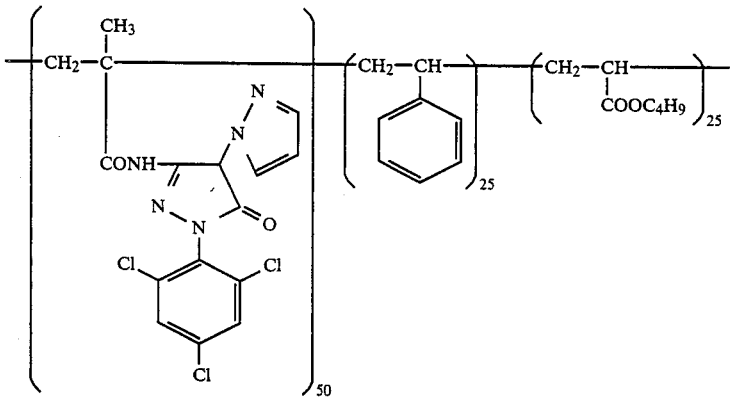
M-28
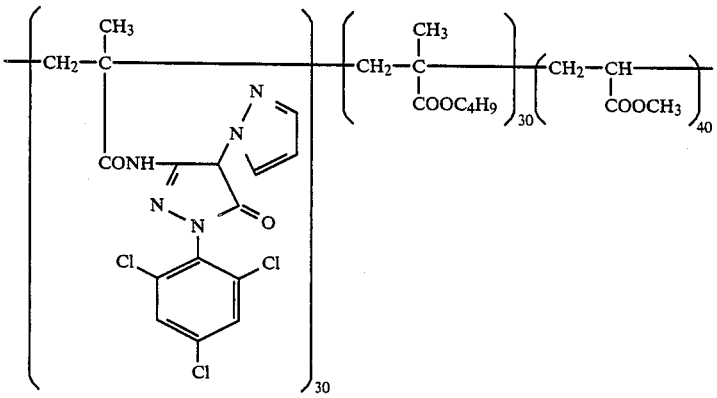

-continued
M-29
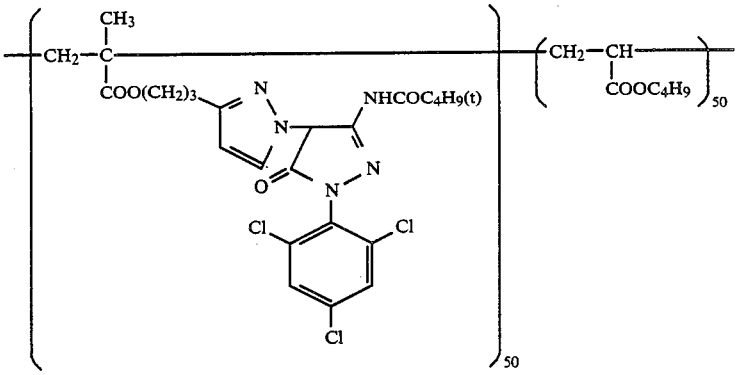
M-30
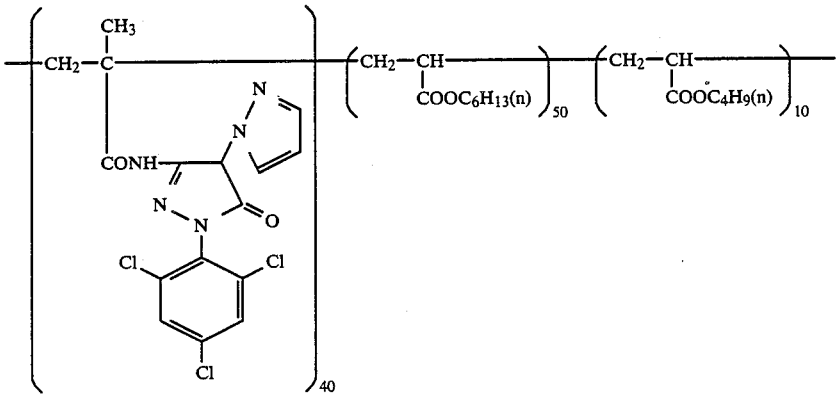
M-31
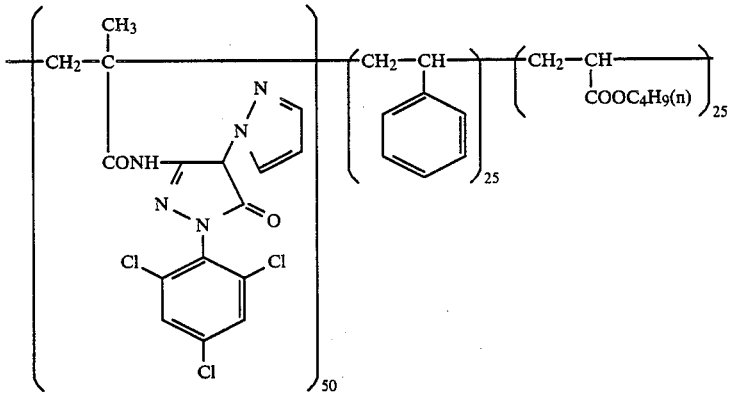
M-32
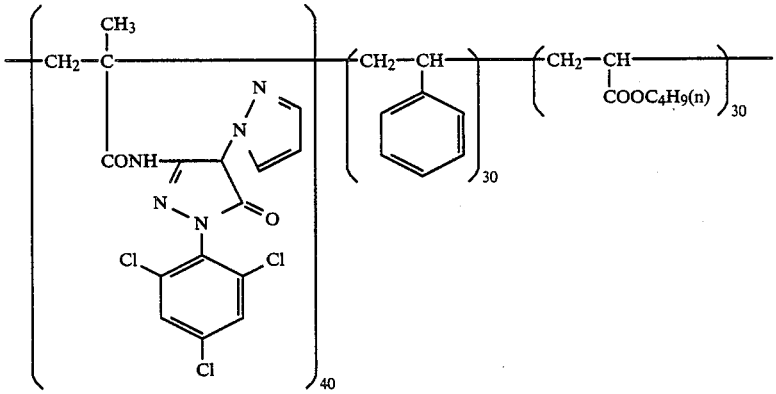

-continued
M-33
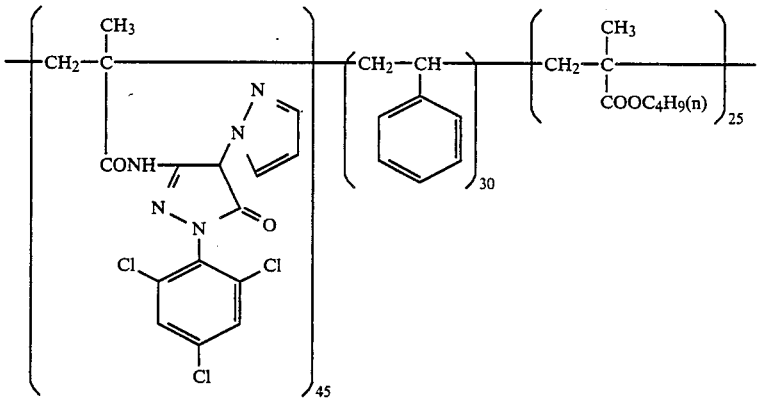
M-34
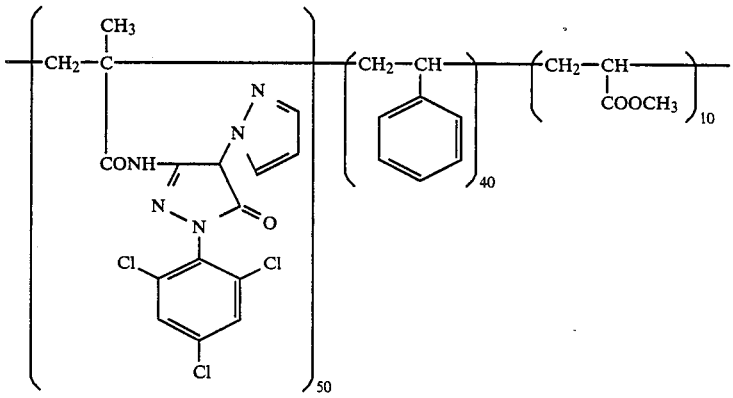
M-35
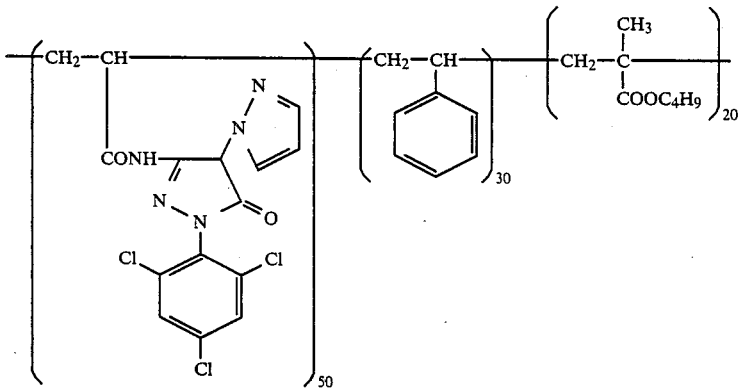
M-36
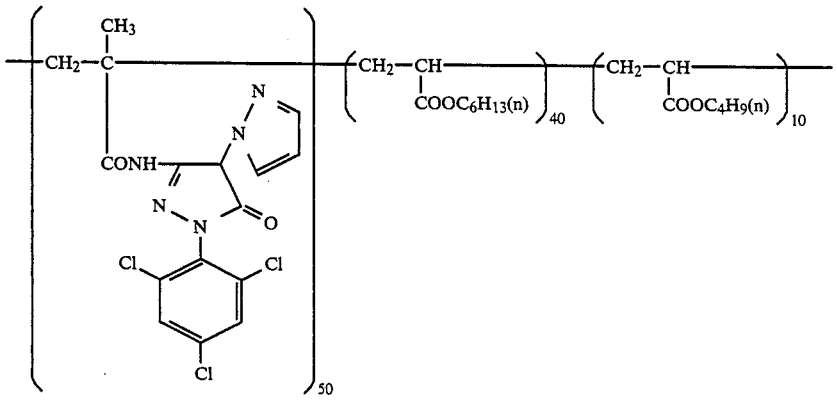

In the above formulae (M-15), (M-16) and (M-22) to (M-36), numerical values indicated mean a ratio of the component in a percent by weight.

The compounds represented by the general formula (I) can be synthesized according to the methods as described in Japanese Patent Application (OPI) Nos. 20826/76, 118034/80, 38043/81, 38044/81, 40825/81 and 94752/82, etc.

The compound represented by the general formula (II) which can be used in the present invention will be described in more detail.

In the above described general formula (II), the ballast group represented by R′ is a group which imparts a diffusion-resistant property to the compound has a total of from 8 to 40 carbon atoms, preferably from 12 to 32 carbon atoms, and represents a straight chain or branched chain alkyl group (e.g., a hexyl group, an octyl group, a dodecyl group, a pentadecyl group, etc.), an alkenyl group (e.g., an allyl group, etc.), an alkynyl group (e.g., a propargyl group, etc.), a cyclic alkyl group (e.g., a cyclopentyl group, a cyclohexyl group, a norbornyl group, etc.), an aralkyl group (e.g., a benzyl group, a β-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acrylanilino group, a hydroxy group, a mercapto group, etc.

R′ may further represent an aryl group (e.g., a phenyl group, an α-or β-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino groups, a dialkylamino group, an anilino group, an N-alkylanilino group, an N-arylanilino group, an N-acylanilino group, a hydroxy group, a mercapto group, etc.

Furthermore, R′ may represent a heterocyclic group (e.g., a 5-membered or 6-membered heterocyclic ring containing as a hetero atom at least one of a nitrogen atom, an oxygen and a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkyl sulfonyl group, an arylsulfonyl group, an alkylcarbamoyl group, an arylcarbamoyl group, an alkylthiocarbamoyl group or an arylthiocarbamoyl group.

Preferably, R′ represents an alkyl group or an aryl group.

In a general formula (II), $M^{n+}$ can be selected from an ion of a group I element the Periodic Table (e.g., $H^+$, $Na^+$, $K^+$, $Cs^+$, etc.), an ion of a group II element in the Periodic Table (e.g., $Mg^{2+}$, $Ca^{2+}$, $Ba^{2+}$, etc.), an ion of a group VIII element in the Periodic Table (e.g., $Fe^{2+}$, $Fe^{3+}$, $Co^{2+}$, $Co^{3+}$, $Ni^{2+}$, etc.), and an ammonium ion which may be represented by the formula

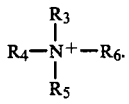

Of these anions, an anion of a group I element, an anion of a group II element and an ammonium ion are preferred. Particularly preferred ions are $H^+$, $Na^+$, $K^+$ and $NH_4^+$, and $H^+$ is most preferred.

In the above described ammonium ion, $R_3$, $R_4$, $R_5$ and $R_6$, which may be the same or different, each represents a hydrogen atom, an alkyl group (e.g., a methyl group, an ethyl group, a tert-butyl group, etc.), a substituted alkyl group, an aralkyl group (e.g., a benzyl group, a phenethyl group, etc.), a substituted aralkyl group, an aryl group (e.g., a phenyl group, a naphthyl group, etc.) or a substituted aryl group, the total number of carbon atoms included in $R_3$, $R_4$, $R_5$ and $R_6$ being up to 20, and any two of $R_3$ to $R_6$ may be connected with each other to form a ring.

Suitable examples of the substituents for the alkyl group, the aralkyl group and the aryl group include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), a acylamino group (e.g., an acetylamino group, etc.), a sulfonamido group (e.g., a methylsulfonamido group, etc.), a sulfamoyl group (e.g., a methylsulfamoyl group, etc.), a halogen atom (e.g., a fluorine atom, a chlorine atom, a bromine atom, etc.), a carboxy group, a carbamoyl group (e.g, a methylcarbamoyl group, etc.), an alkoxycarbonyl group (e.g., a methoxycarbonyl group, etc.), and a sulfonyl group (e.g., a methylsulfonyl group, etc.), etc. When two or more of these substituents are present, they may be the same or different.

Specific examples of preferred compounds represented by the general formula (II) are set forth below, but the present invention is not to be construed as being limited thereto.

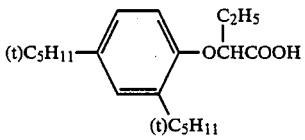

(A-1)

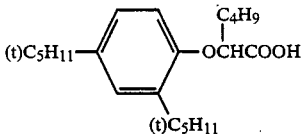

(A-2)

-continued
(A-3)
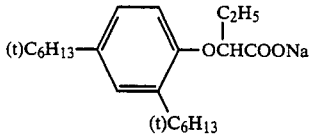
(A-4)
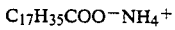
(A-5)
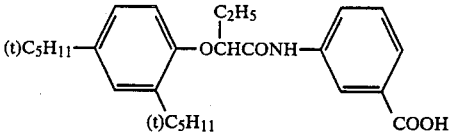
(A-6)
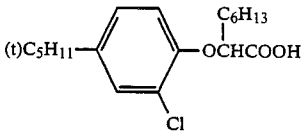
(A-7)
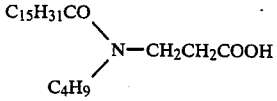
(A-8)
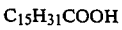
(A-9)
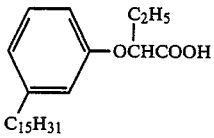
(A-10)
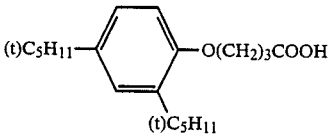
(A-11)
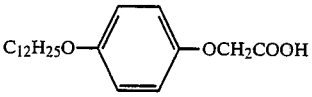
(A-12)
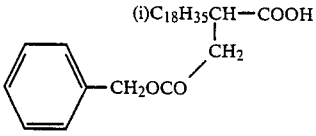
(A-13)
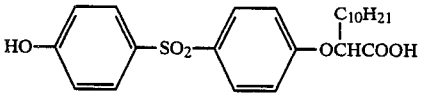
(A-14)
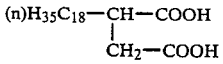
(A-15)
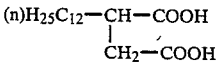
(A-16)
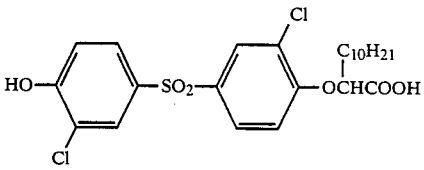
(A-17)
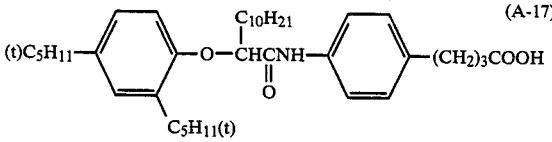
(A-18)
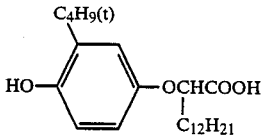
(A-19)
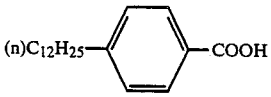
(A-20)
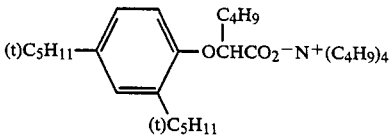
(A-21)
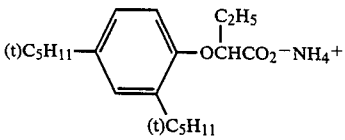
(A-22)
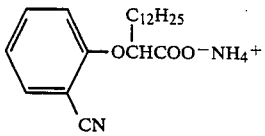

-continued (A-23)

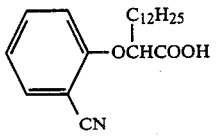

(A-24)

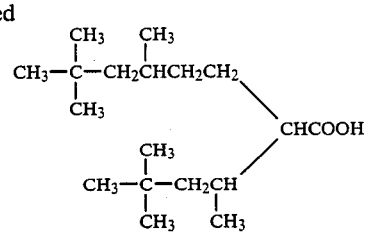

(A-25)

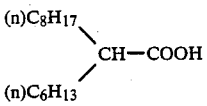

(A-26)

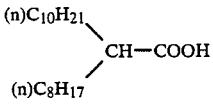

(A-27)

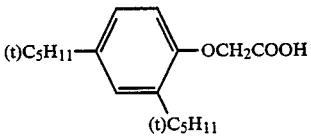

(A-28)

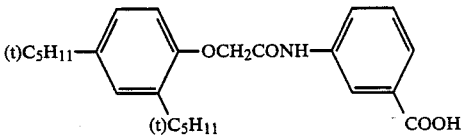

(A-29)

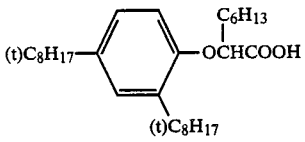

(A-30)

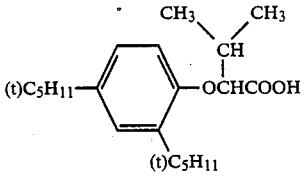

(A-31)

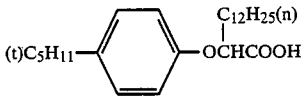

(A-32)

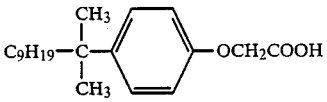

(A-33)

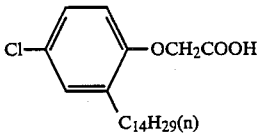

(A-34)

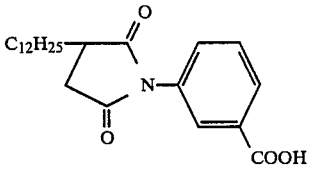

(A-35)

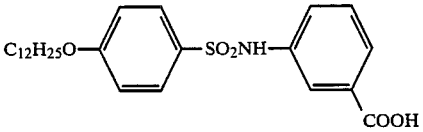

The magenta coupler represented by the general formula (I) used in the present invention can be added to a light-sensitive silver halide emulsion layer or an adjacent layer thereto of the silver halide color photographic material. It is preferred to add the magenta coupler to a light-sensitive silver halide emulsion layer.

The magenta coupler can be preferably added in a range from about $5\times10^{-4}$ mol to 1 mol, particularly from about $3\times10^{-3}$ mol to 0.4 mol, per mol of silver halide present in the same layer or the adjacent layer.

The compound represented by the general formula (II) used in the present invention is added to a layer which contains the magenta coupler described above. The amount of the compound added is preferably in a range from about 0.003 mol to 1 mol, more preferably from about 0.01 mol to 0.5 mol and most preferably from about 0.03 to 0.3 mol, per mol of the magenta coupler.

The mechanism is not completely clear by which the compound represented by the general formula (II) used in the present invention controls the increase in magenta density of color photographic materials containing the magenta coupler represented by the general formula (I) after color development processing. Without being limited by theory, however, it can be considered as follows.

Assuming that, for example, the coupling-off group of the magenta coupler is a group of

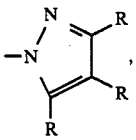

the magenta coupler undergoes a coupling reaction with an oxidation product of an aromatic primary amine developing agent to form a leuco body as shown below, when the compound represented by general formula (II) is not present.

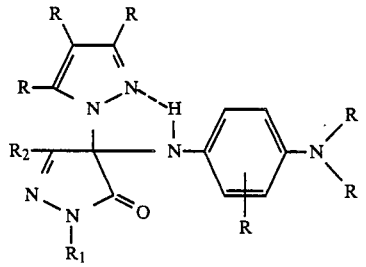

wherein the groups represented by R, which may be the same or different, each represents a hydrogen atom or a substituent; and $R_1$ and $R_2$ each has the same meaning as defined above.

This intermediate compound is rather stable and remains after the development step and the drying step in the color photographic material. It gradually releases the coupling-off group with a lapse of time to form a magenta dye. Thus, the increase in magenta density occurs during preservation of the color images.

In contrast, when the compound represented by general formula (II) is present, it is considered that it provides a proton to the above-described intermediate compound to render it unstable and/or it protonates a released coupling-off group, and thus the stability of the system is increased, whereby the magenta dye is formed at the beginning stage.

Further, the mechanism by which the magenta coupler used in the present invention tends to decrease sensitivity of silver halide during storage of the color photographic light-sensitive material and the mechanism by which the compound represented by the general formula (II) prevents such decrease in sensitivity although it is not so clear. Without being bound by theory, it is believed to be as follows.

Again assuming that, for example, the coupling-off group of the magenta coupler is a group of

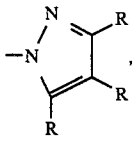

the coupler may from a complex represented by formula (a) below with $Ag^+$ ion in gelatin or adsorb onto a silver halide grain during the production or storage of the photographic light-sensitive material to cause the desensitizing function.

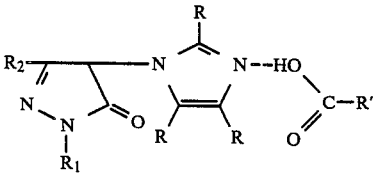

(a)

In contrast, when the compound represented by the general formula (II) is present, it is believed that the compound may form a compound represented by formula (b) below and prevent the interaction of the magenta coupler with a silver ion and/or a silver halide grain.

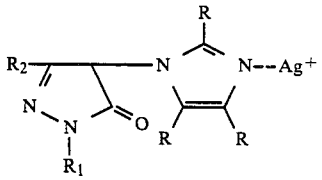

(b)

As is apparent from the above-described mechanisms, the effects of the present invention are only achieved by the combination according to the present invention and the present invention is completely different from the combinations described in European Patent Application (OPI) No. 71,122 and U.S. Pat. No. 3,700,454.

Preferred embodiments of the method for processing the silver halide color photographic material include (1) a method for processing the silver halide color photographic material according to the present invention wherein the period of time from the beginning of a color development step to the end of a drying step is at most 15 minutes, (2) a method for processing the silver halide color photographic material according to the present invention wherein the duration of a drying step is at most 8 minutes, and (3) a method for processing the silver halide color photographic material according to the present invention including the steps of (a) treating the silver halide color photographic material with a both having fixing ability, and thereafter (b) subjecting the color photographic material to a water washing or stabilizing step, wherein the amount of replenisher for the washing water or stabilizing solution is from about 1 to 50 times the weight amount carried over from the preceding bath per unit area of the color photographic material.

The termi "period of time from the beginning of a color development step to the end of a drying step is at most 15 minutes" means that the period from the time when the color photographic light-sensitive material is immersed into a color developing solution to the time when the drying step is finished is about 15 minutes or less.

Further, the term "duration of a drying step" in the case of an automatic developing machine, means a period from the time when the color photographic material enters a drying zone of the automatic developing machine to the time when the color photographic material comes out of the drying zone, and in other cases means a period from the time when the color photographic material is put into a drying appoaratus to the time when it is taken out of the apparatus.

In the preferred processing method (1) of the present invention, the period of time from the beginning of a color development step to the end of a drying step is at most 15 minutes. Since the effect of the present invention can be obtained without limitation of the processing time, the processing time should be short in view of the user's needs. Therefore, the period of time from the beginning of a color development step to the end of a drying step is preferably from about 3 to 14 minutes, more preferably from about 4 to 12 minutes, and most preferably from about 5 to 10 minutes.

In the preferred processing method (2) of the present invention, the drying time is at most 8 minutes. The drying time may be shortened if the color light-sensitive material is dried sufficiently for practical use, and is generally as little as about 30 seconds. The effect of the present invention can be obtained without limitation of the drying time, and the drying time is preferably from about 45 seconds to 6 minutes, and more preferably from about 1 to 5 minutes in view of drying the material sufficiently and shortening the processing time.

In the preferred processing methods (1), (2), (3) and of the present invention, the drying temperature in the drying step may be selected in a wide range, if the properties of the color light-sensitive material are not deteriorated. The preferred drying temperature is from about 25° to 70° C., and more preferably from about 40° to 65° C. near the surface of the light-sensitive material.

Specific examples of the processing steps according to the present invention are set forth below, but the present invention is not to be construed as being limited thereto.

1. Color Development-Bleaching-(Water Washing)-Fixing-(Water Washing)-Fixing-(Water Washing)-(Stabilizing)
2. Color Development-Bleach-Fixing-(Water Washing)-(Stabilizing)
3. Color Development-Bleaching-Bleach-Fixing-(Water Washing)-(Stabilizing)
4. Color Development-Bleaching-Bleach-Fixing-Fixing-(Water Washing)-(Stabilizing)
5. Color Development-Bleaching-Fixing-Bleach-Fixing-(Water Washing)-(Stabilizing)
6. Black-and-White Development-Water Washing-(Reversal)-Color Development-(Conditioning)-Bleaching-Fixing-(Water Washing)-(Stabilizing)
7. Black-and-White Development-Water Washing-(Reversal)-Color Development-(Conditioning)-Bleach-Fixing-(Water Washing)-(Stabilizing)
8. Black-and-White Development-Water Washing-(Reversal)-Color Development-(Conditioning)-Bleaching-Bleach-Fixing-(Water Washing)-(Stabilizing)

In the above described processing steps, the steps in the parentheses ( ) can be eliminated depending on the kinds, purposes and uses of the photographic light-sensitive materials processed, but Water Washing and Stabilizing cannot both be eliminated in the processing method described above, which is one of the preferred embodiments of the present invention.

The above described processing solutions will be described in detail below.

Color Developing Solution

A color developing solution which can be used in development processing of the color photographic light-sensitive material according to the present invention is an alkaline aqueous solution containing preferably an aromatic primary amine type developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, chloride, phosphate, p-toluenesulfonate, tetraphenylborate or p-(tert-octyl)-benzenesulfonate thereof, etc. These diamines are preferably employed in the form of salts thereof, since the salts are generally more stable than their free forms.

The aminophenol type derivatives include, for example, o-aminophenol, p-aminophenol, 4-amino-2-methylphenol, 2-amino-3-methylphenol, 2-oxy-3-amino-1,4-dimethylbenzene, etc.

In addition, the compounds as described in L.F.A. Mason, *Photographic Processing Chemistry,* pages 226 to 229 (Focal Press 1966), U.S. Pat. Nos. 2,193,015 and 2,592,364, Japanese Patent Application (OPI) No. 64933/73, etc., may be used.

Two or more color developing agents may be employed in combination, if desired.

The color developing solution can further contain pH buffering agents, such as carbonates, borates or phosphates of alkali metals, etc.; development inhibitors or anti-fogging agents such as bromides, iodides, benzimidazoles, benzothiazoles or mercapto compounds, etc.; preservatives such as hydroxylamine, triethanolamine, the compounds as described in West German Patent Application (OPI) No. 2,622,950, sulfites bisulfites, etc.; organic solvents such as diethylene glycol, etc.; development accelerators such as benzyl alcohol, polyethylene glycol, quaternary ammonium salts, amines, thicyanates, 3,6-dithiaoctane-1,8-diol, etc.; dye forming couplers; competing couplers; nucleating agents such as sodium borohydride, etc.; auxiliary developing agents such as 1-phenyl-3-pyrazolidone, etc.; viscosity imparting agents; and chelating agents including aminopolycarboxyic acids represented by ethylenediaminetetraacetic acid, nitrilotriacetic acid, cyclohexanediaminetetraacetic acid, iminodiacetic acid, n-hydroxymethylethylenediaminetriacetic acid, diethylenetriaminepentaacetic acid, triethylenetetraminehexaacetic acid, the compounds as described in Japanese Patent Application (OPI) No. 195845/83, etc., organic phosphonic acids such as 1-hydroxyethylidene-1,1'-diphosphonic acid, those as described in *Research Disclosure,* No. 18170 (May, 1979), etc., aminophosphonic acids such as aminotris(methylenephosphonic acid), ethylenediamine-N,N,N',N'-tetramethylenephosphonic acid, etc., phosphonocarboxylic acid as described in Japanese Patent Application (OPI) Nos. 102726/77, 42730/78 121127/79, 4024/80, 4025/80, 126241/80, 65955/80 and 65956/80, *Research Disclosure,* No. 18170 (May, 1977), etc.

The color developing agent can be used in an amount ranging generally from about 0.1 g to about 30 g, preferably from about 1 g to about 15 g, per liter of the color developing solution. The pH of the color developing solution used is usually about 7 or more, and preferably in a range from about 9 to about 13. Further, the amount of replenishment for the color developing solution can be reduced using a replenisher in which concentrations of halogenides, color developing agents, etc., are controlled.

The processing temperature of the color developing solution is preferably from about 20° C. to 50° C., more preferably from about 30° C. to 40° C. The processing time for the color development step is generally from about 20 seconds to 10 minutes, preferably from about 30 seconds to 5 minutes.

In the case of development processing for reversal color photographic light-sensitive materials, color development is usually conducted after black-and-white development. In a black-and-white developing solution, known black-and-white developing agents, for example, dihydroxybenzenes such as hydroquinone, hydroquinone monosulfonate, etc., 3-pyraazolidones such as 1-phenyl-3-pyrazolidone, etc., or aminophenols such as N-methyl-p-aminophenol, etc., may be employed, individually or in a combination.

Bleaching Solution, Bleach-Fixing Solution, Fixing Solution

After color development, the photograhic emulsion layers are usually subjected to a bleach processing. The bleach processing can be performed simultaneously with a fix processing using a mono-bath bleach-fixing solution (blix processing), or it can be performed independently from the fix processing. Further, for the purpose of rapid processing, a processing method by first bleach processing and then bleach-fix processing may be employed.

Examples of bleaching agents which can be employed in the present invention include compounds of a multivalent metal such as iron (III), cobalt (III), chromium (VI), copper (II), etc. (for example, ferricyanides, etc.); peracids; quinones; nitroso compounds; dichloromates; organic complex salts of iron (III) or cobalt (III), (for example, complex salts of aminopolycarboxylic acids (such as amino polycarbonic acids, e.g., ethylenediaminetetraacetic acid, diethylenetriaminepentaacetic acid, etc.), or organic acids such as citric acid, tartaric acid, malic acid, etc.; persulfates; hydrogen peroxide, permanganates; etc. Of these compounds, organic complex salts of iron (III) and persulfates are preferred in view of rapid processing and reduced environmental pollution.

Specific examples of useful aminopolycarboxylic acids suitable for forming organic complex salts of iron (III) are set forth below.

Ethylenediaminetetraacetic acid
Diethylenetriaminepentaacetic acid
Ethylenediamine-N-(β-oxyethyl)-N,N,N'-triacetic acid
1,2-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
1,3-Diaminopropanetetraacetic acid
Iminodiacetic acid
Hydroxyliminodiacetic acid
Dihydroxyethylglycine
Ethyl ether diaminetetraacetic acid
Glycol ether diaminetetraacetic acid
Ethylenediaminetetrapropionic acid
Ethylenediaminedipropionic acid
Phenylenediaminetetraacetic acid The above-described compounds may be in the form of ammonium salts, sodium salts or potassium salts.

Of these compounds, iron (III) complex salt of ethylenediaminetetraacetic acid, (diethylenetriaminepentaacetic acid, cyclohexanediamine tetraacetic acid, 1,3-diaminopropanetetraacetic acid or methyliminodiacetic acid are preferred because of their high bleaching power.

The iron (III) complex salts may be used in the form of a complex salt per se, or may be formed in situ in solution by using an iron (III) salt (e.g., ferric sulfate, ferric chloride, ferric nitrate, ferric ammonium sulfate or ferric phosphate, etc.) and a chelating agent. When they are used in the form of a complex salt, they may be used alone or as a combination of two or more. On the other hand, where a complex is formed in situ in solution by using a ferric salt and a chelating agent, one, two or more ferric salts may be used. Further, one, two or more chelating agents may also be used. In every case, a chelating agent may be used in an excess amount of that necessary for forming a ferric ion complex salt.

The bleaching solution or the bleach-fixing solution containing the above-described ferric ion complex may further contain metal ions or complexes of metals other than iron such as cobalt, copper, etc., or hydrogen peroxide.

Suitable examples of persulfates which can be employed in the bleach processing or bleach-fix processing according to the present invention include alkali metal persulfates such as potassium persulfate, sodium persulfate, etc., ammonium persulfate, etc.

The bleaching solution or the bleach-fixing solution according to the present invention can contain rehalogenating agents such as bromides (e.g., potassium bromide, sodium bromide, ammonium bromide, etc.), chlorides (e.g., potassium chloride, sodium chloride, ammonium chloride, etc.), or iodides (e.g., ammonium iodide, etc.). Further, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, t artaric acid, etc.), corrosion preventing agents (e.g., ammonium nitrate, guanidine, etc.), or the like may be added.

The amount of bleaching agent is usually from about 0.1 to 2 mols per liter of the bleaching solution, and the pH of the bleaching solution is preferably from about 0.5 to 8.0, when a ferric ion complex salt is used, and particularly from about 4.0 to 7.0, when a ferric ion complex salt of an aminopolycarboxylic acid, aminopolyphosphonic acid, phosphonocarboxylic acid or organic phosphonic acid is used. In the case of using a persulfate, the amount of a persulfate is preferably from about 0.1 to 2 mols per liter of the bleaching solution, and the pH of the bleaching solution is preferably from about 1 to 5.

As fixing agents which can be employed in the fixing solution or bleach-fixing solution according to the present invention, known fixing agents, that is, water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas may be used alone individually or in combination with two or more. In addition, a special bleach-fixing solution containing a combination of a fixing agent and a large amount of a halide compound such as potassium iodide as described in Japanese Patent Application (OPI) No. 144354/80 can be used.

In the fixing solution or bleach-fixing solution, it is desirable that the amount of fixing agent is from about 0.2 to 4 mols per liter of the fixing solution or bleach-fixing solution. In the bleach-fixing composition, it is desirable that the ferric ion complex salt is present in an amount of from about 0.1 to 2 mols and the amount of fixing agent is from about 0.2 to 4 mols, per liter of the bleach-fixing solution. Further, the pH of the fixing solution or bleach-fixing solution is preferably from about 4.0 to 9.0, particularly preferably from about 5.0 to 8.0.

The fixing solution or bleach-fixing solution can contain the aforesaid additives to be added to the bleaching solution and preservatives such as sulfites (e.g., sodium sulfite, potassium sulfite, ammonium sulfite, etc.), bisulfite, hydroxylamine, hydrazine, aldehyde-bisulfite adducts (e.g., acetaldehyde-sodium bisulfite adduct), etc. Further, various fluorescent brightening agents, defoaming agents, surface active agents, polyvinyl pyrrolidone, organic solvents (e.g., methanol. etc.), etc., may be incorporated.

In the bleaching solution, the bleach-fixing solution or a prebath thereof, a bleach accelerating agent can be used, if desired. Specific examples of suitable bleach accelerating agents include compounds having a mercapto group or a disulfide group as described in U.S. Pat. No. 3,893,858, West German Pat. Nos. 1,290,812 and 2,059,988, Japanese Patent Application (OPI) Nos. 32736/78, 57831/78, 37418/78, 65732/78, 72623/78, 95630/78, 96631/78, 104232/78, 124424/78, 141623/78 and 28426/78, *Research Disclosure,* No. 17129 (July, 1978), etc.; thiazolidine derivatives as described in Japanese Patent Application (OPI) No. 140129/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Pat. No. 1,127,715, Japanese Patent Application (OPI) No. 16235/83, etc.; polyethyleneoxides as described in West German Pat. Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; iodine ions; and bromine ions. Of these compounds, the compounds having a mercapto group or a disulfide group are preferred in view of their large bleach accelerating effects. Particularly, compounds as described in U.S. Pat. No. 3,893,858, West German Pat. No. 1,290,812 and Japanese Patent Application (OPI) No. 95630/78 are preferred.

After the fixing step or the bleach-fixing step, it is typical to conduct a processing step including water washing and stabilizing. It is also possible to employ a simplified processing method, that is, to carry out only a water washing step or to carry out only a stabilizing step without conducting a substantial water washing step.

The water washing step in the present invention has the function of removing the components of the processing solutions adhered to or contained in color photographic light-sensitive materials, and the components of the color photographic light-sensitive materials which are no longer necessary, in order to maintain preferred image preservability and physical properties of the layers after processing.

The stabilizing step is a step capable of increasing image preservability to an extent which cannot be obtained by the water washing step in addition to the function of the water washing step described above, and a stabilizing solution is a liquid containing a component capable of imparting an image stabilizing function.

While the water washing step can be conducted in a single bath, a multi-stage countercurrent water washing process using two or more tanks is ordinarily employed. The amount of water required for the water washing step can be appropriately determined depending on the type and purpose of the color photographic light-sensitive material. For example, it can be calculated based on the method as described in S. R. Goldwasser, "Water Flow Rates in Immersion-Washing of Motion Picture Film", *Journal of the Society of Motion Picture and Television Engineers,* Vol. 64, pages 248 to 253 (May, 1955).

In the case of reducing the amount of washing water, the propagation of bacteria or molds may cause problems. In order to solve such problems, it is preferred to employ water for washing in which the amounts of calcium and magnesium are reduced, as described in Japanese Patent Application No. 131632/86, or to add to water for washing antibiotics and antimolds, for example, the compounds as described in *J. Antibact. Antifung. Agents,* Vol. 11, No. 5, pages 207 to 223 (1983), H. Horiguchi, *Bokin-Bobai No Kagaku (Chemistry of Bacteria and Mold Inhibitor),* etc.

Further, a chelating agent, for example, ethylenediaminetetraacetic acid, diethylenetriaminepentaacetic acid, etc. may be added to washing water.

When reducing the amount of washing water, it is generally used in a range from about 100 ml ot 2,000 ml per $m^2$ of the color photographic light-sensitive material. Particularly, an amount of water within a range from about 200 ml to 1000 ml per $m^2$ is preferably used for improving color image stability while saving water.

The pH range in the water washing step is usually from about 5 to 9.

In the water washing step, it is preferred to water in which the concentration of calcium and magnesium is reduced to about 5 mg/l or less.

In the stabilizing step, an aldehyde compound such as formalin, etc., or a surface active agent as a water draining agent may be used. However, the aldehyde compound such as formalin is not necessary for the color photographic light-sensitive material containing the coupler according to the present invention. In addition, various compounds can be added to the stabilizing bath for the purpose of stabilizing images. For example, it is possible to add various buffers for adjusting pH of layers after the processing (for example, borates, metaborates, borax, phosphates, carbonates, potassium hydroxide, sodium hydroxide, aqueous ammonia, monocarboxylic acids, dicarboxylic acids, polycarboxylic acids, etc., which can be used alone or in combinations), chelating agents and sterilizers which are the same as those employed in the washing water. Further, fluorescent brightening agents may be added if desired. Moreover, it is possible to add various kinds of ammonium salts as ammonium chloride, ammonium sulfite, ammonium sulfate, ammonium thiosulfate, etc.

The pH of the stabilizing bath is usually from about 3 to 8. In some cases, a low pH range from about 3 to 5 may be preferably used depending on the type of the light-sensitive material and the end use thereof.

In Processing Method (3) which is one of the preferred processing methods according to the present invention, the term "amount carried over from the preceding bath" means the amount of the preceding bath solution, which is adhered to or contained in the color photographic light-sensitive material and introduced into the water washing step or stabilizing step. The amount can be determined, for example, in the following manner.

Method for determination of amount carried over 1 meter of a sample is removed from the processing sequence after the fixing step and just before introduction of the sample into the water washing bath or the stabilizing bath, immediately immersed in 1 liter of distilled water and maintained at 30° C. for 10 minutes while stirring with a magnetic stirrer. Then, the concentration of thiosulfate ion $C_1$ (g/l) in the liquid is determined. Also, the concentration of thiosulfate ion $C_2$ (g/l) in the preceding fixing solution was determined. From these values the amount carried over A (ml) was calculated according to the following equation.

$$C1 \times \frac{(1000 + A)}{A} = C2$$

The determination of the concentration of thiosulfate ion can be carried out using an acidic iodine titration method after sulfite ions are masked with formaldehyde.

Now, the water washing step and the stabilizing step used in Processing Method (3) according to the present invention will be described in more detail below.

The time of processing for the water washing step or the stabilizing step is preferably about two minutes or less.

The amount of replenishment to the water washing step or the stabilizing step is in a range from about 1 to 50 times, preferably from about 3 to 30 times, and more preferably from about 5 to 20 times, of the amount carried over from the preceding bath per unit area of the color photographic light-sensitive material. It is desired that the water washing step or the stabilizing step be conducted using two or more tanks, preferably from two to six tanks and more preferably from two to four tanks. In the above described range of replenishment, the propagation of bacteria or molds in the water washing or stabilizing tanks may cause problems. In order to solve the problem, it is preferred to remove calcium and magnesium from the bath and to add antibiotics and antimolds, for example, the compounds as described in *J. Antibact. Antifung. Agents,* Vol. 11, No. 5, pages 207 to 223 (1983), H. Horiguchi, *Bokin-Bobai No Kagaku* (*Chemistry of Bacteria and Mold Inhibition*), etc. to the bath.

Suitable examples of antibiotics and antimolds include an isothiazolone type antibiotic such as 5-chloro-2-methyl-4-isothiazolin-3-one, 2-methyl-4-iosthiazolin-3-one, etc., a benzisothiazolone type such as 1,2-benzisothiazolin-3-one, etc., a triazole derivative such as benzotriazole, etc., a sulfamide type antibiotic such as sulfonylamide, etc., a chlorine type antibiotic such as sodium hypochlorite, sodium dichloroisocyanurate, etc., an organic arsenic type antimold such as 10,10'-oxybisphenoxy arsenic, etc.

Further, as a water softening agent, an aminopolycarboxylic acid such as ethylenediaminetetraacetic acid, diethylenetriamine pentaacetic acid, cyclohexanediaminetetraacetic acid, etc., a phosphonic acid or an aminophosphonic acid such as 1-hydroxyethylidene-1,1-diphosphonic acid, ethylenediaminetetramethylenephosphonic acid, etc. may be added to the bath. Such a chelating agent is preferably employed in the form of a sodium salt or a potassium salt.

In the washing water or the stabilizing solution, it is preferred that the concentration of calcium and magnesium present is not more than about 5 mg, particularly not more than about 3 mg per liter of the liquid. By reducing the concentration of calcium and magnesium in the washing water or the stabilizing solution, it is possible to remarkably control the propagation of bacteria and molds therein.

The controlling function can be further increased by using the antibiotics, antimolds, water softening agents described above in combination.

In order to reduce the amount of calcium and magnesium compounds in the washing water or the stabilizing solution to the above described range, various known methods can be utilized. For example, the content of calcium and magnesium compounds in a water washing processing solution (including a replenisher) to be used can be decreased by a method employing an ion exchange resin or a reverse permeation device.

As an ion exchange resin, while various cationic exchange resins can be used, it is preferred to use a sodium type cationic exchange resin which can substitute calcium and magnesium with sodium. Further, a hydrogen type cationic exchange resin is also usable. However, since such an exchange resin renders the pH of water treated acidic, it is preferably used together with a hydroxy type anionic exchange resin.

Of the cationic exchange resins, a strong acidic cationic exchange resin containing a copolymer of styrene and divinylbenzene as a substratum and a sulfone group as an ion exchange group is preferred. Suitable examples of such ion exchange resins include Diaion SK-1B, Diaion PK-216 (trade names for products manufactured by Mitsubishi Chemical Industries Ltd.), etc. Particularly, a copolymer in which the amount of divinylbenzene is from about 4 to 16% by weight based on the total weight of monomers used in the preparation thereof is preferred as a substratum for the ion exchange resin.

Preferred examples of anionic exchange resins which are employed together with hydrogen type cationic exchange resins include a strong basic anionic exchange resin containing a copolymer of styrene and divinylbenzene as a substratum and a testing amine group or a quaternary ammonium group as an ion exchange group. Specific examples of such anionic exchange resins include Diaion SA-10A , Diaion PA-418 (trade names for products manufactured by Mitsubishi Chemical Industries Ltd.), etc.

In order to remove calcium and magnesium from water using such an ion exchange resin, any known method can be employed. It is preferred to pass water to be treated through a column filled with an ion exchange resin. At a rate of from about 1 to 100 times, preferably from about 5 to 50 times the volume of the resin used per one hour.

Various known reverse permeation devices can be employed without limitation in the procedure. It is preferred, however, to use a super small device, such as one having an area of reverse permeation membrane of about 3 $m^2$ or less and operating at a pressure of about 30 $kg/m^2$ or less, particularly 2 $m^2$ or less and about 20 $kg/m^2$ or less, respectively. By means of using such a small size device, workability is improved and a sufficiently large water saving effect can be obtained. Further, water may be passed through active carbon or a magnetic field.

Suitable examples of the reverse permeation membrane used in reverse permeation devices include a cellulose acetate membrane, as ethyl cellulose-polyacrylic acid membrane, a polyacrylonitrile membrane, a polyvinyl carbonate membrane, a polyethersulfone membrane, etc.

The water pressure is usually in a range from about 5 to 60 $kg/cm^2$. However, in order to achieve the purpose of the present invention, a pressure of about 30 $kg/cm^2$ or less is sufficient. Further, a so-called low pressure permeation device having a pressure of about 10 $kg/cm^2$ or less can be effectively employed.

Any type of reverse permeation membrane structure, such as a spiral type, a tubular type, a halofiber type, a pleat type, and a rod type, can be used.

Moreover, it is possible to irradiate with ultraviolet rays of at least one of the replenishing tanks and processing containing various buffers (for example, borates, metaborates, borax, phosphates, carbonates, potassium hydroxide, sodium hydroxide, aqueous ammonia, monocarboxylic acids, dicarboxylic acids, polycarboxylic acids, etc., which can be used alone or in combination) in order to adjust the pH of the layers. Further, a fluorescent brightening agent may be added depending on the use, if desired. Moreover, it is possible to add various ammonium salts such as ammonium chloride, ammonium sulfite, ammonium sulfate, ammonium thiosulfate, etc.

The pH of the washing water or the stabilizing solution is generally from about 4 to 9, preferably from 5 to 8. Moreover, an acidic stabilizing solution (pH about 4 or less) which contains acetic acid may be used depending on the purpose.

The processing time for the water washing or stabilizing step is usually from about 10 seconds to 10 minutes, preferably from about 20 seconds to 5 minutes and more preferably from about 20 seconds to 3 minutes and 30 seconds. It is preferred that the processing time for the water washing or stabilizing step be reduced by a combination with a chemical or physical washing accelerating method. The temperature of the water washing or stabilizing step can be from about 20° C. to 50° C. and is preferably from about 30° C. to 40° C.

In the processing method of the photographic material according to the present invention, it is preferred to incorporate a p-hydroxybenzoic acid ester into the silver halide color photographic material.

Useful p-hydroxybenzoic acid esters are those represented by the following formula (PHB)

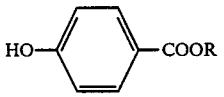

(PHB)

wherein R represents an alkyl group, a substituted alkyl group, an aralkyl group or a substituted aralkyl group each having from 1 to 18 carbon atoms in total.

Examples of the substituents for the alkyl group or the aralkyl group include an aryl group (for example, a phenyl group, etc.), a nitro group, a hydroxy group, a cyano group, a sulfo group, an alkoxy group (for example, methoxy group, etc.), an aryloxy group (for example, a phenoxy group, etc.), an acyloxy group (for example, an acetoxy group, etc.); an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc), an alkoxycarbonyl group (for example, a methoxycarbonyl group, etc.), or a sulfonyl group (for example, a methylsulfonyl group, etc.), etc. When two or more substituents are present, they may be the same or different.

R preferably is an unsubstituted alkyl group, and a methyl group, an ethyl group, a n-propyl group, or a n-butyl group is particularly preferred. An n-butyl group is most preferred.

The p-hydroxybenzoic acid ester used in the present invention can be easily synthesized according to a conventional ester synthesis method. More specifically, p-oxybenzoic acid, an alcohol and sulfuric acid are heated at 70° to 80° C. After the reaction, the mixture is allowed to cool and the ester thus-deposited is decolorized and recrystallized from ethanol. Further, commercial products can be easily obtained.

The p-hydroxybenzoic acid ester can be added to any layer of the color light-sensitive material.

The amount of the p-hydroxybenzoic acid ester to be added is from about 0.001 g to 0.05 g, preferably from about 0.005 g to 0.02 g per square meter of the color photographic light-sensitive material. The p-hydroxybenzoic acid ester may be added to the color photographic light-sensitive material by dissolving it to a solvent which does not affect the photographic properties (for example, water, methanol, ethanol, ethyl acetate, etc.) or directly as a powder at any stage of the production of the color photographic light-sensitive material.

In the methods for processing silver halide color photographic materials according to the present invention, the processing time and the composition of the processing solution of each processing step can be determined depending on the kind of the photographic materials and the end use purpose thereof. The following embodiments are preferred, but the present invention is not to be construed as being limited thereto.

The color developing step is conducted using 2-methyl-4-(N-ethyl-N-β-hydroxyethyl)aniline, as the color developing agent, at a processing temperature of preferably from 37° C. to 40° C., in a processing time of from 2 min to 3 min 15 sec and, particularly, from 2 min 30 sec to 3 min 15 sec.

For the silver removing step, four bath embodiments, that is, (A) separate bleaching and fixing, (B) bleach-fixing, (C) bleaching and bleach-fixing, and (D) fixing and bleach-fixing are employed at a temperature for the processing solution of from about 37° to 40° C. In embodiment (A), the pH of the bleaching solution is preferably from about 5.0 to 6.0 and particularly, from about 5.0 to 5.5, and the bleaching time is preferably from about 1 min to 3 min. Further, in embodiment (A), ammonium thiosulfate is preferably used in the fixing solution and the fixing time is preferably from about 2 min to 4 min. The preferred bleaching agent used in embodiment (A) includes an iron (III) complex salt of ethylenediaminetetraacetic acid, 1,3-diaminopropanetetraacetic acid or diethylenetriaminepentaacetic acid.

In embodiment (B), the pH of the bleach-fixing solution is from about 6.0 to 7.5 and an iron (III) complex salt of ethylenediaminetetraacetic acid, diethylenetriaminepentaacetic acid or cyclohexanediaminetetraacetic acid is preferably used as the bleaching agent. The bleach-fixing time in embodiment (B) is preferably from about 2 min to 5 min.

In embodiment (C), the pH of the bleaching solution is from about 5.0 to 6.5 and the pH of the subsequent bleach-fixing solution is preferably from about 6.0 to 7.5. An iron (III) complex salt of ethylenediaminetetraacetic acid, diethylenetriaminepentaacetic acid or cyclohexanediaminetetraacetic acid is preferably used as the bleaching agent and the bleaching time is preferably from about 30 sec to 2 min and the bleach-fixing time is preferably from about 1 min to 4 min.

In embodiment (D), the fixing time is from about 30 sec to 2 min and the bleach-fixing time is from about 2 min to 5 min. The pH of the fixing solution is preferably from about 6.0 to 8.0 and the pH of the bleach-fixing solution is preferably from about 6.0 to 7.5. An iron (III) complex salt of ethylenediaminetetraacetic acid, diethylenetriaminepentaacetic acid or cylohexanediaminetetraacetic acid is preferred as the bleaching agent.

In embodiments (A)-(D), a bleach accelerating agent is preferably incorporated into a bath having a bleaching ability and/or a preceding bath thereof. Particularly preferred compounds, as the bleach accelerating agents are those as described in U.S. Pat. No. 3,893,858, Japanese Patent Application (OPI) Nos. 95630/78 and 52534/79, and West German Pat. No. 1,290,812.

The water washing step is preferably conducted in a countercurrent replenishment system using two to three tanks and the amount of replenishment is preferably from about 200 ml to 1000 ml per $m^2$ of the color photographic light-sensitive material in view of water saving. The temperature of the water washing baths is from about 25° C. to 40° C. and particularly, from about 35° C. to 40° C. is suitable in view of the improvement in the water washing speed, and it is possible to conduct water washing within about 20 sec to 2 min at such a water washing temperature. The pH of the water washing step is preferably from about 6.0 to 8.0.

In the water washing step various kinds of sterilizers and antibacterial agents can be used, and water having a reduced calcium and magnesium content as described in Japanese Patent Application No. 131632/86 is preferably employed in view of safety.

The stabilizing step requires from about 20 sec to 2 min. When the stabilizing step is followed by the water washing step, one tank may be used in each step, but, when eliminating the water washing step, the stabilizing step is constituted with a countercurrent system using two to three tanks. When eliminating the water washing step, the content of formalin solution (37 w/v%) in the stabilizing solution is preferably from about 0.5 ml to 1 ml per liter of the solution. Further, formalin may be omitted when processing the photographic light-sensitive material using the two-equivalent magenta coupler according to the present invention. In the method for processing the photographic light-sensitive material according to the present invention, it is preferred that the process does not include a step with a solution containing an aldehyde compound. The pH of the stabilizing solution is preferably from about 3 to 8.

The drying step is usually set at around 50° C. and the time required therefor is about 2 min. In order to shorten the drying time, drying may be conducted for about 30 sec to 2 min at about 55° C. to 60° C.

In the photographic emulsion layers of the photographic light-sensitive material used in the present invention, any of silver halide selected from silver bromide, silver iodobromide, silver iodochlorobromide, silver chlorobromide and silver chloride may be used. A preferably employed silver halide is silver iodobromide or silver iodochlorobromide each containing about 30 mol% or less of silver iodide. Silver iodobromide containing from about 2 mol% to about 25 mol% of silver iodide is particularly preferred.

Silver halide grains in the silver halide emulsion may have a regular crystal structure, for example, a cubic, octahedral or tetradecahedral structure, etc., an irregular crystal structure, for example, a spherical structure, etc. a crystal defect, for example, a twin plane structure, etc., or a composite structure thereof.

The grain size of silver halide may be varied and includes those from fine grains having a projected area diameter of about 0.1 micron or less to large size grains having a projected area diameter about 10 microns. Further, a monodispersed emulsion having a narrow grain size distribution and a polydispersed emulsion having a broad grain size distribution may be used.

The silver halide photographic emulsion used in the present invention can be prepared using known methods, for example, those described in *Research Disclosure,* No. 17643 (December, 1978), pages 22 to 23, "I. Emulsion Preparation and Types" and ibid., No. 18716 (November, 1979), page 648, etc.

The photographic emulsion used in the present invention can be prepared in any suitable manner, for example, by the methods as described in P. Glafkides, *Chimie et Physique Photographique,* (Paul Montel 1967), G. F. Duffin, *Photographic Emulsion Chemistry,* (The Focal Press 1966), and V. L. Zelikman et al., *Making and Coating Photographic Emulsion,* (The Focal Press 1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one example of the double jet process, a "controlled double jet process", in which the pAg in a liquid phase where silver halide is formed is maintained at a predetermined level, can be employed. This process can produce a silver halide emulsion in which the crystal form is regular and the grain size is nearly uniform.

Two or more kinds of silver halide emulsions which are prepared separately may be used as a mixture thereof.

Silver halide emulsions composed of regular grains as described above can be obtained by controlling the pAg and pH during the step of formation of silver halide grains. The detail thereof are described, for example, in *Photographic Science and Engineering,* Vol. 6, pages 159 to 165 (1962), *Journal of Photographic Science,* Vol. 12, page 242 to 251 (1964), U.S. Pat. No. 3,655,394, and British Pat. No. 1,413,748, etc.

Representative monodispersed emulsions are those containing silver halide grains having an average grain size of about 0.1 micron or more in which at least about 95% by weight of the total silver halide grains have a size within the range of ±40% of the average grain size. In the present invention, it is preferred to employ a monodispersed emulsion containing silver halide grains having an average grain size of from about 0.25 microns to 2 microns, in which at least about 95% by weight or by number of particles of the total silver halide grains have a size within the range of ±20% of the average grains size. Methods for preparation of such monodispersed emulsion are described in U.S. Pat. Nos. 3,574,628 and 3,655,394, British Pat. No. 1,413,748, etc. Further, monodispersed emulsions described in Japanese Patent Application (OPI) Nos. 8600/73, 39027/76, 83097/76, 137133/78, 48521/79, 99419/79, 37635/83 and 49938/83, etc. can be preferably employed in the present invention.

Further, tabular silver halide grains having an aspect ratio of about 5 or more can be employed in the present invention. The tabular grains may be simply prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, British Pat. No. 2,112,157, etc. When employing tabular silver halide grains, many advantages, for example, increase in spectral sensitizing efficiency with a sensitizing dye, improvement in graininess and improvement in sharpness, etc. are obtained as described in U.S. Pat. No. 4,434,226, and the other publications cited.

The crystal structure of silver halide grains may be uniform, composed of different halide compositions between the inner portion and the outer portion, or a stratified structure. Examples of such emulsion grains are described in British Pat. No. 1,027,146, U.S. Pat. Nos. 3,505,068 and 4,444,877, and Japanese Patent Application No. 248469/83, etc.

Further, silver halide emulsions in which silver halide grains having different compositions are connected by epitaxial-junctions or silver halide emulsions in which silver halide grains are connected with compounds other than silver halide such as silver thiocyanate, lead oxide, etc. may also be employed. Examples of these emulsion grains are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

Moreover, a mixture of grains having a different crystal structure may be used.

The photographic emulsions used in the present invention are usually physically ripened, chemically ripened and spectrally sensitized. Various kinds of additives which can be employed in these steps are described in *Research Disclosure,* No. 17643 (December, 1978) and ibid., No. 18716 (November, 1979) as mentioned above, and as summarized in the Table below.

Further, known photographic additives which can be used in the present invention are also described in the above mentioned Research Disclosures, as summarized in the Table below.

| | Kind of Additives | RD 17643 | RD 18716 |
|---|---|---|---|
| 1. | Chemical Sensitizers | Page 23 | Page 648, right column |
| 2. | Sensitivity Increasing Agents | | Page 648, right column |
| 3. | Spectral Sensitizers and Super Sensitizers | Pages 23 to 24 | Page 648, right column to page 649, right column |
| 4. | Whitening Agents | Page 24 | |
| 5. | Antifoggants and Stabilizers | Pages 24 to 25 | Page 649, right column |
| 6. | Light-Absobers, Filter Dyes and Ultraviolet Ray Absorbers | Pages 25 to 26 | Page 649, right column to page 650, left column |
| 7. | Antistaining Agents | Page 25, right column | Page 650, left column to right column |
| 8. | Dye Image Stabilizers | Page 25 | |
| 9. | Hardeners | Page 26 | Page 651, left column |
| 10. | Binders | Page 26 | Page 651, left column |
| 11. | Plasticizers and Lubricants | Page 27 | Page 650, right column |
| 12. | Coating Aids and Surfactants | Pages 26 to 27 | Page 650, right column |
| 13. | Antistatic Agents | Page 27 | Page 650, right column |

-continued

| Kind of Additives | RD 17643 | RD 18716 |
|---|---|---|
| | | column |

In the present invention, various color couplers can be employed and specific examples thereof are described in the patents cited in *Research Disclosure,* No. 17643, "VII-C" to "VII-G". As dye forming couplers, couplers capable of providing three primary colors (i.e., yellow, magenta and cyan) in the substractive process upon color development are important. Specific examples of preferred diffusion-resistant, four-equivalent or two-equivalent couplers are described in the patents cited in *Research Disclosure,* No. 17643, "VII-C" and "VII-D" cited above. In addition, the couplers described below are preferably employed in the present invention.

Typical yellow couplers used in the present invention, include hydrophobic acylacetamide type couplers having a ballast group. Specific examples thereof are described in U.S. Pat. Nos. 2,407,210, 2,875,027 and 3,265,506, etc. In the present invention two-equivalent yellow couplers are preferably employed.

Typical examples of two equivalent yellow couplers include yellow couplers of oxygen atom releasing type as described in U.S. Pat. Nos. 3,408,194, 3,447,928, 3,933,501 and 4,022,620, etc. and yellow couplers of nitrogen atom releasing type as described in Japanese Patent Publication No. 10739/83, U.S. Pat. Nos. 4,401,752 and 4,326,024, *Research Disclosure,* No. 18053 (April, 1979), British Pat. Nos. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzoylacetanilde type couplers are characterized by providing high color density.

As magenta couplers used in the present invention, hydrophobic indazolone type couplers, cyanoacetyl type couplers, and preferably 5-pyrazolone type couplers and pyrazoloazole type couplers each having ballast group are preferred. Of 5-pyrazolone type couplers, those substituted with an arylamino group or an acylamino group at the 3-position thereof are preferred in view of hue and color density of dyes formed therefrom. Typical examples thereof are described in U.S. Pat. Nos. 2,311,082, 2,343,703, 2,600,788, 2,908,573, 3,062,653, 3,152,896 and 3,936,015, etc. As releasing groups for two-equivalent 5-pyrazolone type couplers, nitrogen atom releasing groups as described in U.S. Pat. No. 4,310,619 and arylthio groups as described in U.S. Pat. No. 4,351,897 are particularly preferred. Further, 5-pyrazolone type couplers having a ballast group as described in European Pat. No. 73,636 are advantageous since they provide high color density.

Examples of pyrazoloazole type couplers include pyrazolobenzimidazoles as described in U.S. Pat. No. 3,061,432, and preferably pyrazolo[5,1-c][1,2,4]triazoles as described in U.S. Pat. No. 3,725,067, pyrazolotetrazoles as described in *Research Disclosure,* No. 24220 (June, 1984), Japanese Patent Application (OPI) No. 33552/85 and pyrazolopyrazoles as described in *Research Disclosure,* No. 24220 (June, 1984), Japanese Patent Application (OPI) No. 43659/85. Imidazo[1,2-b]pyrazoles as described in U.S. Pat. No. 4,500,630 are preferred and pyrazolo[1,5-b][1,2,4triazoles as described in U.S. Pat. No. 4,540,645 are particularly preferred in view of less yellow subsidiary absorption and light fastness of dyes formed therefrom.

Cyan couplers used in the present invention include hydrophobic and diffusion-resistant naphthol type and phenol type couplers. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group higher than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German patent application (OLS) No. 3,329,729, and European Pat. No. 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Cyan couplers having a sulfonamido group, or an amido group, etc. at the 5-position of the naphthol nucleus as described in European patent No. 161,626A are also excellent in fastness of color images formed therefrom and can be preferably employed in the present invention.

It is preferred to use colored couplers together in color photographic light-sensitive materials for photographic in order to correct undesirable absorptions. Typical examples include yellow-colored magenta couplers as described in U.S. Pat. No. 4,163,670, Japanese patent publication No. 39413/82, etc. and magenta-colored cyan couplers as described in U.S. Pat. Nos. 4,004,929 and 4,138,258 and British Pat. No. 1,146,368, etc. Other examples of colored couplers are described in *Research Disclosure,* No. 17643, "VII-G" as mentioned above.

Further, couplers capable of forming appropriately diffusible dyes can be used together in order to improve graininess. Specific examples of such types of magenta couplers are described in U.S. Pat. No. 4,366,237 and British Pat. No. 2,125,570, etc. and those of yellow, magenta and cyan couplers are described in European Pat. No. 96,570 and West German patent application (OLS) No. 3,234,533, etc.

Dye forming couplers may form polymers including dimers or higher polymers. Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can be also employed preferably in the present invention. Specific examples of useful DIR couplers capable of releasing a development inhibitor are described in the patents cited in *Research Disclosure,* No. 17643, "VII-F" described above.

Of DIR couplers, those of deactivation type in a developing solution as represented by Japanese patent application (OPI) No. 151944/82, those of timing type as represented by U.S. Pat. No. 4,248,962 and Japanese patent application (OPI) No. 154234/82 and those of reactive type as represented by Japanese patent application No. 39653/84 are preferably employed in combination with those of the present invention. Further, DIR couplers of deactivation type in a developing solution as described in Japanese patent application (OPI) Nos. 151944/82 and 217932/83, Japanese patent application Nos. 75474/84, 82214/84 and 90438/84, etc. and DIR couplers of reactive type as described in Japanese patent application No. 39653/84, etc. are particularly preferred.

In the photographic light-sensitive material of the present invention, couplers which release imagewise a nucleating agent, a development accelerator or a precursor thereof at the time of development can be employed. Specific examples of such compounds are described in British Pat. Nos. 2,097,140 and 2,131,188, etc. Couplers which release a nucleating agent capable of adsorption to silver halide are particularly preferred and specific examples thereof are described in Japanese patent application (OPI) Nos. 157638/84 and 170840/84, etc.

Furthermore, competing couplers (for example, couplers as described in U.S. Pat. No. 4,130,427, etc.), polyvalent couplers (for example, couplers as described in U.S. Pat. Nos. 4,283,472, 4,338,393 and 4,310,618, etc.), DIR redox compound releasing couplers (for example, couplers as described in Japanese patent application (OPI) No. 185950/85, etc.), couplers capable of releasing a dye which turns to a colored form after being released (for example, couplers as described in European Pat. No. 173,302, etc.), etc. may be employed in the photographic light-sensitive material of the present invention.

The couplers which can be used in the present invention can be introduced into the photographic light-sensitive material according to various known dispersing methods. Typical examples of the dispersing methods include a solid dispersing method, an alkali dispersing method, preferably a latex dispersing method and more preferably an oil droplet in water type dispersion method. By means of the oil droplet in water type dispersing method, couplers are dissolved in either an organic solvent having a high boiling point of 175° C. or more, an auxiliary solvent having a low boiling point, or a mixture thereof, and then the solution is finely dispersed in an aqueous medium such as water or an aqueous gelatin solution, etc. in the presence of a surface active agent. Specific examples of organic solvents having a high boiling point are described in U.S. Pat. No. 2,322,027, etc. In order to prepare a dispersion, phase inversion may be performed. Further, dispersions are utilized for coating after removing or reducing the auxiliary solvent therein by distillation, noodle washing or ultrafiltration, etc., if desired.

The processes and effects of latex dispersing methods and specific examples of latexes for loading are described in U.S. Pat. No. 4,199,363, West German patent application (OLS) Nos. 2,541,274 and 2,541,230, etc.

Suitable supports which can be used in the present invention are described, for example, in *Research Disclosure,* No. 17643, page 28 and ibid., No. 18716, page 647, right column to page 648, left column, as described above.

The present invention is described in detail with reference to the following examples, but the present invention is not to be construed as being limited thereto.

Unless otherwise indicated, all parts, percents, and ratios are by weight.

EXAMPLE 1

Sample 101

On a transparent cellulose triacetate film support were coated an emulsion layer which had been prepared by mixing a silver halide emulsion and a dispersion of Coupler Cp-1 with tricresyl' phosphate and a protective layer, each having the composition set forth below to prepare Sample 101.

| | |
|---|---|
| First Layer: Emulsion Layer | |
| Negative type silver chlorobromide emulsion (silver bromide: 4 mol %, average particle size: 0.6 μm) | 0.79 g/m$^2$ (as silver) |
| Coupler Cp-1 | 0.43 g/m$^2$ |
| Tricresyl phosphate | 0.45 g/m$^2$ |
| Gelatin | 1.5 g/m$^2$ |
| Second Layer: Protective Layer | |
| 2,4-Dichloro-6-hydroxy-s-triazine sodium salt | 0.10 g/m$^2$ |
| Gelatin | 2.5 g/m$^2$ |

Samples 102 to 105

Samples 102 to 105 were prepared in the same manner as described for Sample 101, except using equimolar amounts of Couplers Cp-2 and Cp-3 for comparison and Couplers M-29 and M-12 according to the present invention in place of Coupler Cp-1 in Sample 101, respectively.

Samples 106 to 110

Samples 106 to 110 were prepared in the same manner as described for Samples 101 to 105, except adding Compound A-10 according to the present invention in an amount of 0.08 g/m$^2$ to the emulsion layer of Samples 101 to 105, respectively.

Samples 111 to 120

Samples 111 to 120 were prepared in the same manner as described for Samples 101 to 105, except adding Compound A-15 (Samples 111 to 115) and Compound A-20 (Samples 116 to 120) according to the present invention in an amount of 0.08 g/m$^2$ to the emulsion layer of Samples 101 to 105, respectively.

These samples were subjected to exposure for sensitometry and then color development processing set forth below. The samples thus-processed were subjected to density measurement through a green filter (BPN-53), manufactured by Fuji Photo Film Co., Ltd.), which was designated Condition A.

Further, the samples processed were preserved under the condition of 60° C. and 70% relative humidity for 24 hours and thereafter subjected to density measurement in the same manner as described above, which was designated Condition B.

The results thus-obtained are shown in Table 1 below.

Moreover, these samples were subjected to exposure for sensitometry, and immediately (Condition C) or after preservation at 45° C. and 80% relative humidity for 3 days (Condition D) subjected to the same color development processing as described above. These samples thus-processed were subjected to density measurement in the same manner as described above, and sensitivity was determined as the reciprocal of the exposure amount required for obtaining an optical density of fog +0.2. The sensitivity of each sample under Condition D against the sensitivity under Condition C is shown in Table 1 below.

The color development processing was performed as follows at 38° C.

| | |
|---|---|
| 1. Color Development | 3 min. 15 sec. |
| 2. Bleaching | 6 min. 30 sec. |
| 3. Washing with Water | 3 min. 15 sec. |
| 4. Fixing | 6 min. 30 sec. |
| 5. Washing with Water | 3 min. 15 sec. |
| 6. Stabilizing | 3 min. 15 sec. |

The compositions of the processing solutions used for the above-described steps were as follows.

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Sodium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 liter |
| pH | 10.0 |
| Bleaching Solution: | |
| Ammonium iron (III) ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing Solution: | |
| Disodium Ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |
| Stabilizing Solution: | |
| Formalin (40%) | 2.0 ml |
| Polyoxyethylene-p-monononylphenylether (average degree of polymerization: about 10) | 0.3 g |
| Water to make | 1.0 liter |

TABLE 1

| Sample | Coupler | Additive | Color Density* Condition A | Color Density* Condition B | Sensitivity** |
|---|---|---|---|---|---|
| 101 (Comparison) | Cp-1 | — | 1.54 | 1.53 | −0.10 |
| 102 (Comparison) | Cp-2 | — | 1.52 | 1.52 | −0.10 |
| 103 (Comparison) | Cp-3 | — | 2.91 | 3.58 | −0.11 |
| 104 (Comparison) | M-29 | — | 2.42 | 2.83 | −0.24 |
| 105 (Comparison) | M-12 | — | 2.86 | 3.35 | −0.22 |
| 106 | Cp-1 | A-10 | 1.53 | 1.52 | −0.10 |

TABLE 1-continued

| Sample | Coupler | Additive | Color Density* Condition A | Color Density* Condition B | Sensitivity** |
|---|---|---|---|---|---|
| (Comparison) | | | | | |
| 107 (Comparison) | Cp-2 | A-10 | 1.51 | 1.50 | −0.09 |
| 108 (Comparison) | Cp-3 | A-10 | 2.88 | 3.56 | −0.10 |
| 109 (Present Invention) | M-29 | A-10 | 2.83 | 2.84 | −0.12 |
| 110 (Present Invention) | M-12 | A-10 | 3.33 | 3.35 | −0.10 |
| 111 (Comparison) | Cp-1 | A-15 | 1.53 | 1.53 | −0.09 |
| 112 (Comparison) | Cp-2 | A-15 | 1.51 | 1.50 | −0.10 |
| 113 (Comparison) | Cp-3 | A-15 | 2.85 | 3.56 | −0.12 |
| 114 (Present Invention) | M-29 | A-15 | 2.82 | 2.84 | −0.13 |
| 115 (Present Invention) | M-12 | A-15 | 3.30 | 3.34 | −0.11 |
| 116 (Comparison) | Cp-1 | A-21 | 1.52 | 1.53 | −0.09 |
| 117 (Comparison) | Cp-2 | A-21 | 1.52 | 1.51 | −0.09 |
| 118 (Comparison) | Cp-3 | A-21 | 2.80 | 2.79 | −0.11 |
| 119 (Present Invention) | M-29 | A-21 | 2.80 | 2.82 | −0.12 |
| 120 (Present Invention) | M-12 | A-21 | 3.25 | 3.26 | −0.11 |

*Color density obtained at the exposure amount of 2 CMS.
**Balance of reciprocals of the exposure amounts (Δ log E).

From the results shown in Table 1 it can be seen that with Samples 104 and 105 using the two-equivalent magenta coupler according to the present invention above, having a high color forming property, a severe increase in magenta density occured after development processing. On the contrary, Samples 109, 110, 114, 115, 119 and 120 wherein the magenta coupler is employed together with the compound according to the present invention, exhibited not only a high color forming property but also stable image density after development processing. Further, it is also apparent that when Coupler Cp-3, which is a two-equivalent magenta coupler but outside the scope of the present invention was used, stabilization of the color image could not be achieved. Therefore, the effectiveness of the combination according to the present invention is demonstrated.

Moreover, it is apparent from the results shown in Table 1 above that a severe decrease in sensitivity occurred when Samples 104 and 105, in which the coupler according to the present invention was used alone, was subjected to the degradation condition (Condition D) after exposure. On the contrary, such a decrease in sensitivity was prevented by the combination according to the present invention.

The comparative couplers used herein are as follows.

(Cp-1)

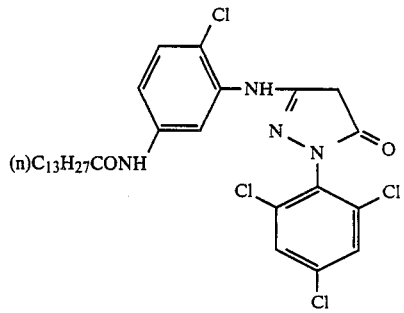

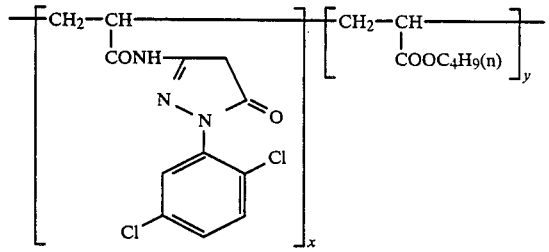

x:y = 1:1 wt/wt
average molecular weight 15,000

(Cp-3)

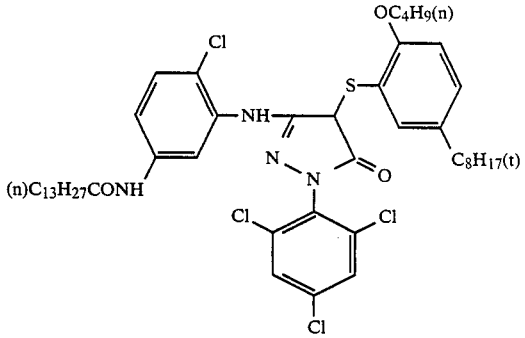

EXAMPLE 2

Sample 201

On a transparent cellulose triacetate film support were coated layers having the compositions set forth below to prepare a multilayer color photographic light-sensitive material, which was designated as Sample 201. The coated amount of silver halide emulsion is shown as the coated amounts of silver.

| | |
|---|---|
| First Layer: Antihalation Layer | |
| A gelatin layer containing the following: | |
| Black colloidal silver | 0.15 g/m² |
| Ultraviolet Light Absorbing Agent U-1A | 0.08 g/m² |
| Ultraviolet Light Absorbing Agent U-2A | 0.12 g/m² |
| Second Layer: Intermediate Layer | |
| A gelatin layer containing the following: | |
| 2,5-Di-tert-pentadecylhydroquinone | 0.18 g/m² |
| Coupler C-1A | 0.11 g/m² |
| Third Layer: First Red-Sensitive Emulsion Layer | |
| A gelatin layer containing the following: | |
| Silver iodobromide emulsion (silver iodide: 4 mol %, average particle size: 0.4 μm) | 1.2 g/m² |
| Sensitizing Dye I | $1.4 \times 10^{-4}$ mol per mol of silver |

-continued

| | | |
|---|---|---|
| Sensitizing Dye II | $0.4 \times 10^{-4}$ mol per mol of silver | |
| Sensitizing Dye III | $5.6 \times 10^{-4}$ mol per mol of silver | |
| Sensitizing Dye IV | $4.0 \times 10^{-4}$ mol per mol of silver | |
| Coupler C-2A | | 0.45 $g/m^2$ |
| Coupler C-3A | | 0.035 $g/m^2$ |
| Coupler C-4A | | 0.025 $g/m^2$ |
| Fourth Layer: Second Red-Sensitive Emulsion Layer | | |
| A gelatin layer containing the following: | | |
| Silver iodobromide emulsion (silver iodide: 9 mol %, average particle size: 0.8 μm) | | 1.0 $g/m^2$ |
| Sensitizing Dye I | $5.2 \times 10^{-5}$ mol per mol of silver | |
| Sensitizing Dye II | $1.5 \times 10^{-5}$ mol per mol of silver | |
| Sensitizing Dye III | $2.1 \times 10^{-4}$ mol per mol of silver | |
| Sensitizing Dye IV | $1.5 \times 10^{-5}$ mol per mol of silver | |
| Coupler C-2A | | 0.050 $g/m^2$ |
| Coupler C-5A | | 0.070 $g/m^2$ |
| Coupler C-3A | | 0.035 $g/m^2$ |
| Fifth Layer: Intermediate Layer | | |
| A gelatin layer containing: | | |
| 2,5-Di-tert-pentadecylhydroquinone | | 0.08 $g/m^2$ |
| Sixth Layer: First Green-Sensitive Emulsion Layer | | |
| A gelatin layer containing the following: | | |
| Silver iodobromide (silver iodide: 5 mol %, average particle size: 0.4 μm) | | 0.80 $g/m^2$ |
| Sensitizing Dye V | $4.0 \times 10^{-4}$ mol per mol of silver | |
| Sensitizing Dye VI | $3.0 \times 10^{-4}$ mol per mol of silver | |
| Sensitizing Dye VII | $1.0 \times 10^{-4}$ mol per mol of silver | |
| Coupler C-6A | | 0.45 $g/m^2$ |
| Coupler C-7A | | 0.13 $g/m^2$ |
| Coupler C-8A | | 0.02 $g/m^2$ |
| Coupler C-4A | | 0.04 $g/m^2$ |
| Seventh Layer: Second Green-Sensitive Emulsion Layer | | |
| A gelatin layer containing the following: | | |
| Silver iodobromide (silver iodide: 8 mol %, average particle size: 0.9 μm) | | 0.85 $g/m^2$ |
| Sensitizing Dye V | $2.7 \times 10^{-4}$ mol per mol of silver | |
| Sensitizing Dye VI | $1.8 \times 10^{-4}$ mol per mol of silver | |
| Sensitizing Dye VII | $7.5 \times 10^{-4}$ mol per mol of silver | |
| Coupler C-6A | | 0.095 $g/m^2$ |
| Coupler C-7A | | 0.015 $g/m^2$ |
| Eighth Layer: Yellow Filter Layer | | |
| A gelatin layer containing the following: | | |
| Yellow Colloidal Silver | | 0.08 $g/m^2$ |
| 2,5-Di-tert-pentadecylhydroquinone | | 0.090 $g/m^2$ |
| Ninth Layer: First Blue-Sensitive Emulsion Layer | | |
| A gelatin layer containing the following: | | |
| Silver iodobromide emulsion (silver iodide: 5 mol %, average particle size: 0.3 μm) | | 0.37 $g/m^2$ |
| Sensitizing Dye VIII | $4.4 \times 10^{-4}$ mol per mol of silver | |
| Coupler C-9A | | 0.71 $g/m^2$ |
| Coupler C-4A | | 0.07 $g/m^2$ |
| Tenth Layer: Second Blue-Sensitive Emulsion Layer | | |
| A gelatin layer containing the following: | | |
| Silver iodobromide emulsion (silver iodide: 9 mol %, average particle size: 0.9 μm) | | 0.55 $g/m^2$ |
| Sensitizing Dye VIII | $3.0 \times 10^{-4}$ mol per mol of silver | |
| Coupler C-7A | | 0.23 $g/m^2$ |
| Eleventh Layer: First Protective Layer | | |
| A gelatin layer containing the following: | | |
| Ultraviolet Ray Absorbing Agent U-1A | | 0.14 $g/m^2$ |
| Ultraviolet Ray Absorbing Agent U-2A | | 0.22 $g/m^2$ |
| Twelfth Layer: Second Protective Layer | | |
| A gelatin layer containing the following: | | |
| Silver iodobromide emulsion (silver iodide: 2 mol %, average particle size: 0.07 μm) | | 0.25 $g/m^2$ |
| Polymethacrylate Particles (diameter: 1.5 μm) | | 0.10 $g/m^2$ |

Each layer described above further contained Gelatin Hardener H-1 and a surface active agent in addition to the above-described components.

Sample 202

Sample 202 was prepared in the same manner as described for Sample 201, except using the equimolar amount of Coupler M-26 according to the present invention in place of Coupler C-6A in the sixth layer of Sample 201.

Samples 203 to 204

Samples 203 and 204 were prepared in the same manner as described for Samples 201 and 202 except adding Compound A-9 according to the present invention in an amount of 0.09 $g/m^2$ to the sixth layer of Samples 201 and 202, respectively.

Samples 205 to 220

Samples 205 to 220 were prepared in the same manner as described for Samples 201 to 204 except changing the magenta coupler and the additive in the sixth layer to those shown in Table 2 below, respectively.

These samples were subjected to exposure for sensitometry, and immediately (Condition A) or after preservation at 40° C. and 80% relative humidity for 7 days (Condition B) were subjected to color development processing using the steps set forth below at a processing temperature 38° C.

| Processing Step | Time |
|---|---|
| Color development | 3 min 15 sec |
| Bleaching | 6 min 30 sec |
| Washing with Water | 2 min 10 sec |
| Fixing | 4 min 20 sec |
| Washing with Water | 3 min 15 sec |
| Stabilizing | 1 min 05 sec |

The processing solutions used in the color development processing had the following compositions:

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Sodium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 liter |
| pH | 10.0 |
| Bleaching Solution: | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing Solution: | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |

-continued

| Stabilizing Solution: | |
|---|---|
| Formalin (40%) | 2.0 ml |
| Polyoxyethylene-p-mononylphenyl-ether (average degree of polymerization: about 10) | 0.3 g |
| Water to make | 1.0 liter |

The densities of the thus-processed samples were measured using a green filter. The photographic properties thus obtained are shown in Table 2.

TABLE 2

| Sample | Coupler | Additive | Relative Sensitivity* Condition A | Condition B |
|---|---|---|---|---|
| 201 (Comparison) | C-6A | — | 100 | 91 |
| 202 (Comparison) | M-26 | — | 115 | 95 |
| 203 (Comparison) | C-6A | A-9(1) | 98 | 91 |
| 204 (Present Invention) | M-26 | — | 115 | 110 |
| 205 (Comparison) | M-1 | — | 129 | 115 |
| 206 (Comparison) | M-5 | — | 123 | 112 |
| 207 (Comparison) | M-31 | — | 118 | 107 |
| 208 (Comparison) | M-29 | — | 118 | 107 |
| 209 (Present Invention) | M-1 | A-2(2) | 129 | 126 |
| 210 (Present Invention) | M-5 | " | 123 | 123 |
| 211 (Present Invention) | M-31 | " | 120 | 118 |
| 212 (Present Invention) | M-29 | " | 120 | 120 |
| 213 (Present Invention) | M-1 | A-10(3) | 129 | 129 |
| 214 (Present Invention) | M-5 | " | 126 | 123 |
| 215 (Present Invention) | M-31 | " | 120 | 120 |
| 216 (Present Invention) | M-29 | " | 123 | 123 |
| 217 (Present Invention) | M-1 | A-20(4) | 126 | 126 |
| 218 (Present Invention) | M-5 | " | 123 | 120 |
| 219 (Present Invention) | M-31 | " | 118 | 118 |
| 220 (Present Invention) | M-29 | " | 118 | 118 |

*The sensitivity is shown by the relative value of the exposure amount required for obtaining a density of fog +0.2, and the sensitivity of Sample 201 under Condition A is taken as 100.

Added Amounts of the additives are: (1) A-9: 0.09 g/m$^2$, 2) A-2: 0.04 g/m$^2$, 3) A-10: 0.03 g/m$^2$, and (4) A-20: 0.05 g/m$^2$.

As is apparent from the results shown in Table 2, according to the combination of the present invention, the preservability of latent image is improved while maintaining high sensitivity.

The chemical structure of the compounds employed for the preparation of the samples described in Examples 1 and 2 are shown below. The copolymerization ratios are represented in terms of weight ratio.

U-1A

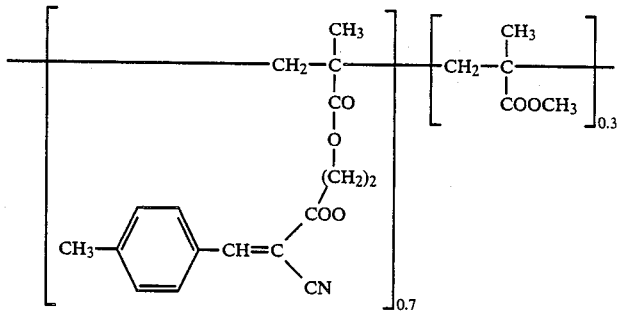

U-2A

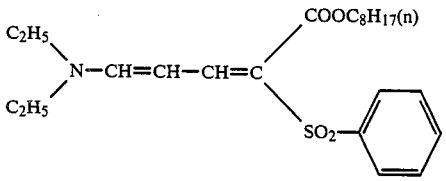

-continued
C-1A
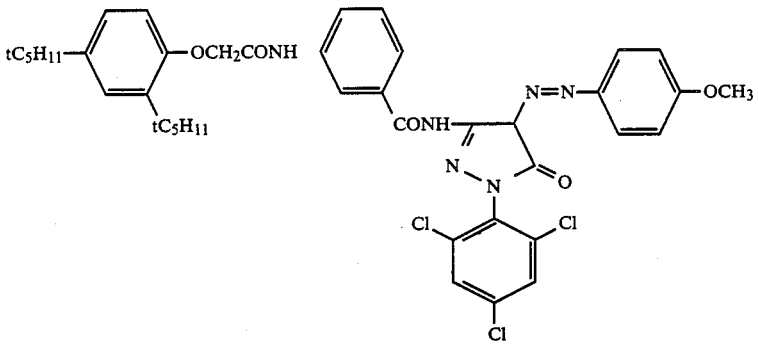
C-2A
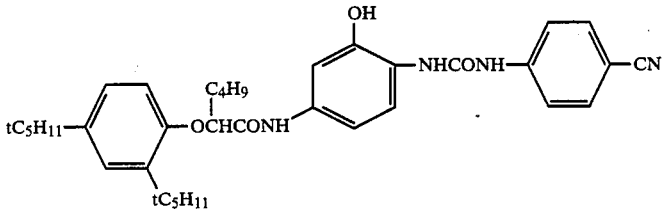
C-3A
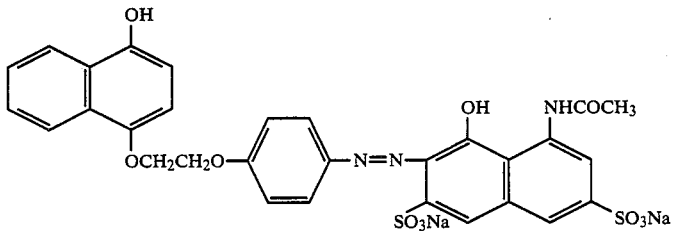
C-4A
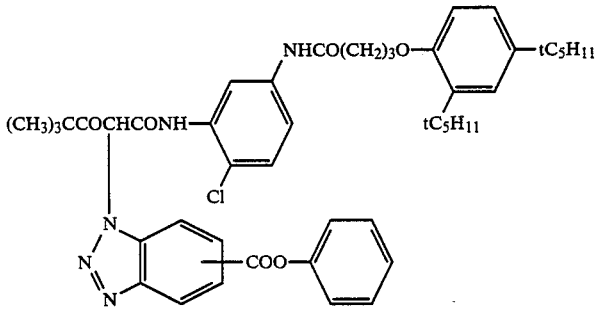
C-5A
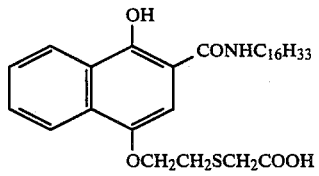
C-6A
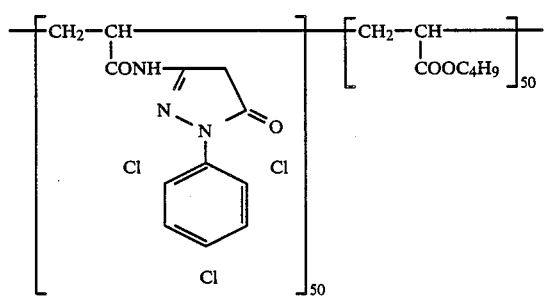

-continued
C-7A
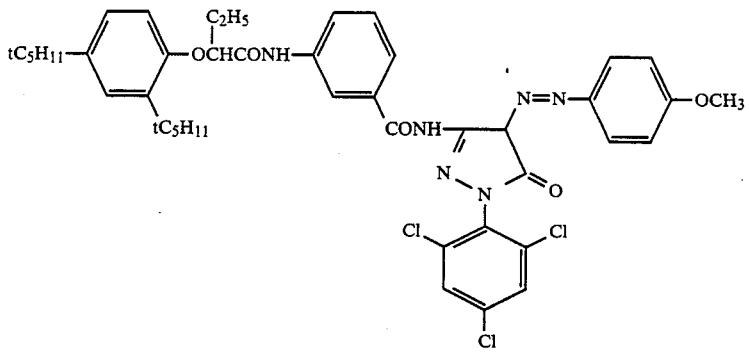
C-8A
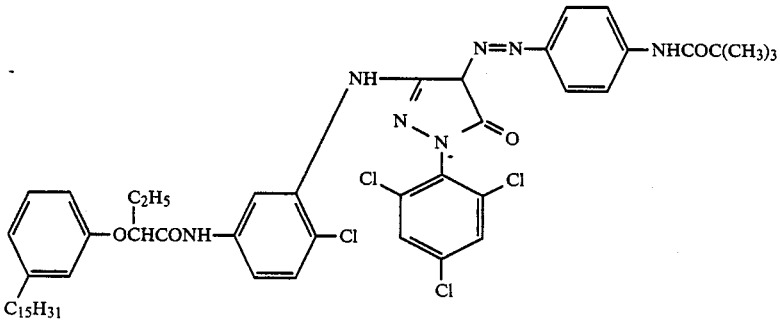
C-9A
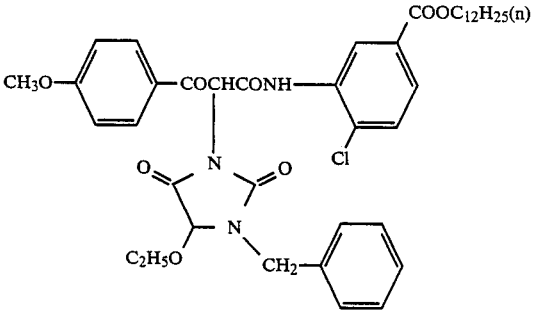
H-1A
$CH_2{=}CH{-}SO_2{-}CH_2CONH{-}(CH_2)_2NHCOCH_2{-}SO_2{-}CH{=}CH_2$
Sensitizing Dye I
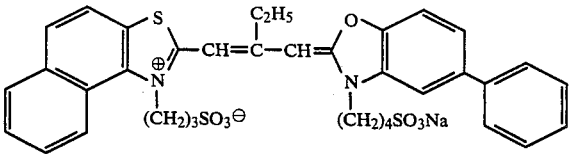
Sensitizing Dye II
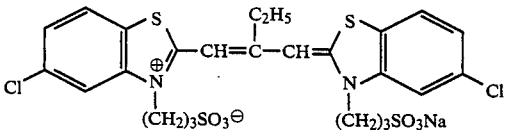
Sensitizing Dye III
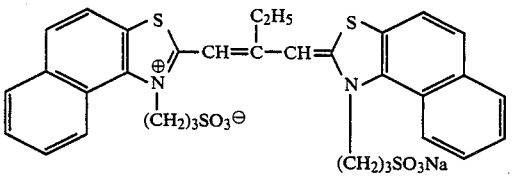

-continued

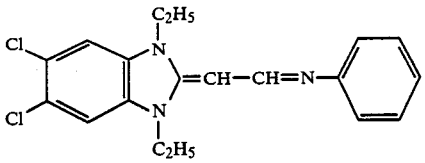

Sensitizing Dye IV

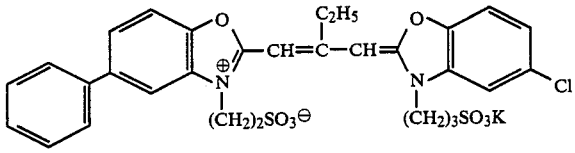

Sensitizing Dye V

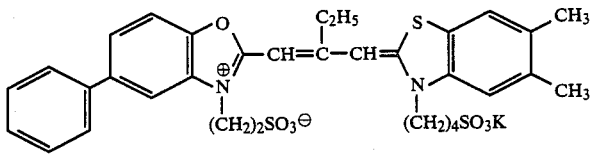

Sensitizing Dye VI

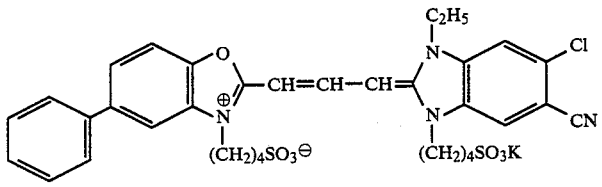

Sensitizing Dye VII

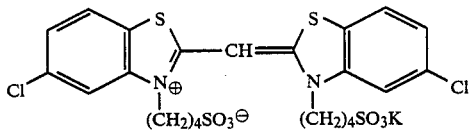

Sensitizing Dye VIII

EXAMPLE 3

Samples 201 to 220 were subjected to wedge exposure in an exposure amount of 25 CMS using a tungsten light source and a filter to adjust the color temperature to 4,800° K. and then were subjected to development processing at 38° C. according to the following processing steps.

| Processing Step | Time |
|---|---|
| Color development | 3 min 15 sec |
| Bleaching | 1 min |
| Bleach-Fixing | 3 min 15 sec |
| Washing with Water | 1 min 40 sec |
| Stabilizing | 40 sec |
| Drying | 1 min (at 50° C.) |

The processing solutions used in the color development processing had the following compositions:

| Color Developing Solution: | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 liter |
| pH | 10.0 |

-continued

| Bleaching Solution: | |
|---|---|
| Iron (III) ammonium ethylenediaminetetraacetate | 120.0 g |
| Disodium ethylenddiaminetetraacetate | 10.0 g |
| Aqueous ammonia | 17.0 ml |
| Ammonium nitrate | 10.0 g |
| Ammonium bromide | 100.0 g |
| Bleach Accelerating Agent $(CH_3)_2N—C_2H_4—S—S—C_2H_4—N(CH_3)_2$ | $5 \times 10^{-3}$ mol |
| Water to make | 1.0 liter |
| pH | 6.5 |
| **Bleach-Fixing Solution:** | |
| Iron (III) ammonia ethylenediaminetetraacetate | 50.0 g |
| Disodium ethylenediaminetetraacetate | 5.0 g |
| Sodium sulfite | 12.0 g |
| Ammonium thiosulfate (70% aq. soln.) | 240.0 ml |
| Aqueous ammonia | 10.0 ml |
| Water to make | 1.0 liter |
| pH | 7.3 |
| **Stabilizing Solution:** | |
| Formalin (37% w/v) | 2.0 ml |
| Polyoxyethylene-p-monononylphenylether (average degree of polymerization: about 10) | 0.3 g |
| Water to make | 1.0 liter |

Just after the development processing, magenta density ($C_E$) of the area exposed to 0.5 CMS of each sample was measured. Further, these processed samples were preserved under condition of 50° C. and 70% relative humidity for 24 hours and then the magenta density ($D_F$) of each sample was measured. The results obtained are shown in Table 3 below.

TABLE 3

| Sample | Coupler | Additive | $D_E$ Magenta Density just after Processing | $D_F$ Magenta Density after Preservation at 50° C., 70% RH for 24 hours |
|---|---|---|---|---|
| 201 (Comparison) | C-6 | — | 2.05 | 2.07 |
| 202 (Comparison) | M-26 | — | 2.20 | 2.31 |
| 203 (Comparison) | C-6 | A-9 | 2.05 | 2.07 |
| 204 (Present Invention) | M-26 | " | 2.31 | 2.32 |
| 205 (Comparison) | M-1 | — | 2.37 | 2.55 |
| 206 (Comparison) | M-5 | — | 2.34 | 2.52 |
| 207 (Comparison) | M-31 | — | 2.28 | 2.41 |
| 208 (Comparison) | M-29 | — | 2.26 | 2.39 |
| 209 (Present Invention) | M-1 | A-2 | 2.57 | 2.57 |
| 210 (Present Invention) | M-5 | " | 2.52 | 2.53 |
| 211 (Present Invention) | M-31 | " | 2.42 | 2.42 |
| 212 (Present Invention) | M-29 | " | 2.39 | 2.40 |
| 213 (Present Invention) | M-1 | A-10 | 2.54 | 2.56 |
| 214 (Present Invention) | M-5 | " | 2.51 | 2.52 |
| 215 (Present Invention) | M-31 | " | 2.40 | 2.41 |
| 216 (Present Invention) | M-29 | " | 2.39 | 2.40 |
| 217 (Present Invention) | M-1 | A-20 | 2.56 | 2.57 |
| 218 (Present Invention) | M-5 | " | 2.53 | 2.54 |
| 219 (Present Invention) | M-31 | " | 2.42 | 2.43 |
| 220 (Present Invention) | M-29 | " | 2.42 | 2.42 |

From the results shown in Table 3, it is apparent that in the samples containing only the magenta coupler according to the present invention, a change in magenta density occurred after development processing, although the color forming property was high. On the contrary, the samples further containing the compound according to the present invention exhibited both a high color forming property and stable color image density after development processing.

EXAMPLE 4

Sample 401

On a cellulose triacetate film support provided with a subbing layer were coated layers having the compositions set forth below to prepare a multilayer color photographic light-sensitive material, which was designated as Sample 401.

With respect to the compositions of the layers, coated amounts are shown in units of g/m², coated amounts of silver halide and colloidal silver are shown by the amount of silver coated in units of g/m², and amounts of sensitizing dyes and couplers are shown as a molar amount per mol of silver halide present in the layer.

| | |
|---|---|
| **First Layer: Antihalation Layer** | |
| Black colloidal silver | 0.18 (as silver) |
| Gelatin | 1.40 |
| **Second Layer: Intermediate Layer** | |
| 2,5-Di-tert-pentadecylhydroquinone | 0.18 |
| C-1 | 0.07 |
| C3 | 0.02 |
| U-1 | 0.08 |
| U-2 | 0.08 |
| HBS-1 | 0.10 |
| HBS-2 | 0.02 |
| Gelatin | 1.04 |
| **Third Layer: First Red-Sensitive Emulsion Layer** | |
| Silver Iodobromide Emulsion (silver iodide: 6 mol %, average particle size: 0.8 μm) | 0.50 (as silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| C-10 | 0.0050 |
| Gelatin | 1.20 |
| **Fourth Layer: Second Red-Sensitive Emulsion Layer** | |
| Silver Iodobromide Emulsion (silver iodide: 5 mol %, average particle size: 0.85 μm) | 1.15 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| C-10 | 0.004 |
| HBS-1 | 0.005 |
| Gelatin | 1.50 |
| **Fifth Layer: Third Red-Sensitive Emulsion Layer** | |
| Silver Iodobromide Emulsion (silver iodide: 10 mol %, average particle size: 1.5 μm) | 1.50 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.32 |
| HBS-1 | 0.32 |
| Gelatin | 1.63 |
| **Sixth Layer: Intermediate Layer** | |
| Gelatin | 1.06 |
| **Seventh Layer: First Green-Sensitive Emulsion Layer** | |
| Silver Iodobromide Emulsion (silver iodide: 6 mol %, average particle size: 0.8 μm) | 0.35 (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |

-continued

| | |
|---|---|
| C-6 | 0.180 |
| C-1 | 0.010 |
| C-7 | 0.042 |
| C-8 | 0.025 |
| HBS-1 | 0.20 |
| Gelatin | 0.70 |
| Eighth Layer: Second Green-Sensitive Emulsion Layer | |
| Silver Iodobromide Emulsion (silver iodide: 5 mol %, average particle size: 0.85 μm) | 0.75 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.035 |
| C-8 | 0.004 |
| C-1 | 0.002 |
| C-7 | 0.015 |
| HBS-1 | 0.15 |
| Gelatin | 0.80 |
| Ninth Layer: Third Green-Sensitive Emulsion Layer | |
| Silver Iodobromide Emulsion (silver iodide: 10 mol %, average particle size: 1.5 μm) | 1.80 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-11 | 0.012 |
| C-1 | 0.001 |
| HBS-2 | 0.69 |
| Gelatin | 1.74 |
| Tenth Layer: Yellow Filter Layer | |
| Yellow Colloidal Silver | 0.05 (as silver) |
| 2,5-Di-tert-pentadecylhydroquinone | 0.03 |
| Gelatin | 0.95 |
| Eleventh Layer: First Blue-Sensitive Emulsion Layer | |
| Silver Iodobromide Emulsion (silver iodide: 6 mol %, average particle size: 0.6 μm) | 0.24 (as silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| Twelfth Layer: Second Blue-Sensitive Emulsion Layer | |
| Silver Iodobromide Emulsion (silver iodide: 10 mol %, average particle size: 1.0 μm) | 0.45 (as silver) |
| Sensitizing Dye VIII | $2.1 \times 10^{-4}$ |
| C-9 | 0.098 |
| HBS-1 | 0.03 |
| Gelatin | 0.46 |
| Thirteenth Layer: Third Blue-Sensitive Emulsion Layer | |
| Silver Iodobromide Emulsion (silver iodide: 10 mol %, average particle size: 1.8 μm) | 0.77 (as silver) |
| Sensitizing Dye VIII | $2.2 \times 10^{-4}$ |
| C-9 | 0.036 |
| HBS-1 | 0.07 |
| Gelatin | 0.69 |
| Fourteenth Layer: First Protective Layer | |
| Silver iodobromide emulsion (silver iodide: 1 mol %, average particle size: 0.07 μm) | 0.5 (as silver) |

-continued

| | |
|---|---|
| U-1 | 0.11 |
| U-2 | 0.17 |
| Butyl p-Hydroxybenzoic acid | 0.012 |
| HBS-1 | 0.90 |
| Gelatin | 0.80 |
| Fifteenth Layer: Second Protective Layer | |
| Polymethyl methacrylate particle (diameter: about 1.5 μm) | 0.54 |
| S-1 | 0.15 |
| S-2 | 0.10 |
| Gelatin | 0.72 |

Gelatin Hardener H-2 and a surface active agent were added to each of the layers in addition to the above described components.

Sample 402

Sample 402 was prepared in the same manner as described for Samples 401 except for further adding Compound A-5 according to the present invention in an amount of 0.016 g/m$^2$ and 0.012 g/m$^2$ to the seventh layer and eighth layer of Samples 401, respectively.

Samples 403 and 404

Samples 403 and 404 were prepared in the same manner as described for Sample 401 and 402, respectively except using 0.70 times by mole of M-26 according to the present invention in place of C-6 used in the seventh layer and the eighth layer of Samples 401 and 402, respectively.

Samples 401 to 404 were subjected to wedge exposure in an exposure amount of 20 CMS at a color temperature of 4800° K. and then processed using an automatic developing machine in the following manner.

TABLE 4

| Step | Processing I Time | Processing II Time | Processing III Time | Processing IV Time |
|---|---|---|---|---|
| Color Development | 3 min. 15 sec. | 3 min. 15 sec. | 3 min. 15 sec. | 3 min. 15 sec. |
| Bleaching | 4 min. 20 sec. | 2 min. 00 sec. | 1 min. 00 sec. | 30 sec. |
| Bleach-Fixing | 4 min. 20 sec. | 3 min. 15 sec. | 3 min. 15 sec. | 2 min. 30 sec. |
| Washing with Water (1) | 1 min. 15 sec. | 1 min. 15 sec. | 40 sec. | 20 sec. |
| Washing with Water (2) | 2 min. 00 sec. | 2 min. 00 sec. | 1 min. 00 sec. | 20 sec. |
| Stabilizing | 1 min. 05 sec. | 40 sec. | 40 sec. | 20 sec. |
| Drying | 2 min. 00 sec. | 1 min. 15 sec. | 1 min. 15 sec. | 40 sec. |
| All steps | 18 min. 15 sec. | 13 min. 40 sec. | 11 min. 05 sec. | 7 min. 55 sec. |

In the above described processing steps, the washing with water steps were carried out using a countercurrent water washing process from Washing with Water (2) to Washing with Water (1).

The composition of each processing solution used is illustrated below.

The amounts of replenishment for the processing solutions were 1,200 ml/m$^2$ of the color photographic light-sensitive material with respect to the color development step and 800 ml/m$^2$ of the color photographic light-sensitive material with respect to other processing steps including the water washing step. Further, the amount of processing solution carried over from the processing bath to the water washing step was 50 ml/m$^2$ of the color photographic light-sensitive material.

Tank

-continued

| | Solution | Replenisher |
|---|---|---|
| Color Developing Solution: | | |
| Diethylenetriaminepentaacetic acid | 1.0 g | 1.1 g |
| 1-Hydroxyethylidene-1,1-diphosphonic acid | 2.0 g | 2.2 g |
| Sodium Sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethyl amino)-2-methylaniline sulfate | 4.5 g | 5.0 g |
| Water to make | 1.0 liter | 1.0 liter |
| pH | 10.00 | 10.05 |
| Bleaching Solution: (both Tank Solution and Replenisher | | |
| Ammonium Iron (III) ethylenediaminetetra-acetate | | 120.0 g |
| Disodium ethylenediaminetetraacetate | | 10.0 g |
| Ammonium nitrate | | 10.0 g |
| Ammonium bromide | | 100.0 g |
| Bleach accelerating agent: | | $5 \times 10^{-3}$ mol |

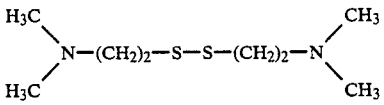

| | |
|---|---|
| adjusted pH to 6.3 with aqueous ammonia | |
| Water to make | 1.0 liter |
| Bleach-Fixing Solution: (both Tank Solution and Replenisher) | |
| Ammonium iron (III) ethylenediaminetetra-acetate | 50.0 g |
| Disodium ethylenediaminetetraacetate | 5.0 g |
| Sodium sulfite | 12.0 g |
| Aqueous solution of ammonium thiosulfate (70%) | 240.0 ml |
| adjusted pH to 7.3 with aqueous ammonia | |
| Water to make | 1.0 liter |

Washing Water

Tap water containing 32 mg/l of calcium ion and 7.3 mg/l of magnesium ion was passed through a column filled with an H type strong acidic cation exchange resin and an OH type strong basic anion exchange resin to prepare water containing 1.2 mg/l of calcium ion and 0.4 mg/l of magnesium ion. To the thus-treated water was added sodium dichloroisocyanurate in an amount of 20 mg/l.

| Stabilizing Solution: (both Tank Solution and Replenisher) | |
|---|---|
| Formalin (37% w/v) | 2.0 ml |
| Polyoxyethylene-p-monononylphenylether (average degree of polymerization = 10) | 0.3 g |
| Disodium ethylenediaminetetraacetate | 0.05 g |
| Water to make | 1.0 liter |
| | pH 5.8 |

Drying

The temperature of drying was 50° C.

With these thus-processed samples, the change in magenta dye density of the area having an initial density of 2.0, and change in magenta stain in the minimum density area after preservation of the samples under conditions of 60° C. and 70% relative humidity for 3 weeks. The results are shown in Table 5 below.

TABLE 5

| No. | Sample | Processing | Processing Time | Change in Magenta density | Change in Magenta stain |
|---|---|---|---|---|---|
| 1 | 401 | I | 18'15" | −0.15 | −0.03 |
| 2 | 402 | I | 18'15" | −0.16 | −0.02 |
| 3 | 403 | I | 18'15" | +0.01 | +0.01 |
| 4 | 404 | I | 18'15" | −0.01 | +0.01 |
| 5 | 401 | II | 13'40" | −0.16 | −0.03 |
| 6 | 402 | II | 13'40" | −0.16 | −0.03 |
| 7 | 403 | II | 13'40" | +0.09 | +0.04 |
| 8 | 404 | II | 13'40" | −0.01 | +0.01 |
| 9 | 401 | III | 11'05" | −0.16 | −0.03 |
| 10 | 402 | III | 11'05" | −0.15 | −0.03 |
| 11 | 403 | III | 11'05" | +0.12 | +0.05 |
| 12 | 404 | III | 11'05" | 0 | +0.01 |
| 13 | 401 | IV | 7'55" | −0.15 | −0.02 |
| 14 | 402 | IV | 7'55" | −0.14 | −0.02 |
| 15 | 403 | IV | 7'55" | +0.15 | +0.05 |
| 16 | 404 | IV | 7'55" | +0.01 | +0.01 |

From the results shown in Table 5 it can be seen that Samples 401 and 402 not containing the magenta coupler represented by the general formula (I) according to the present invention underwent a severe reduction in magenta density after processing, although the performance were stable in any of the processings, that Sample 403 using only the magenta coupler represented by general formula (I) exhibited a severe change in density in the case of short time processing, although showing less density change after the processing in Processing I which required a processing time greater than that according to the present invention, and that Sample 404 according to the present invention showed less change in the density under any of the processing times. Therefore, it is possible to provide a processed film within a short period of time by the present invention, which is useful in view of economy and, particularly, extremely advantageous for laboratories in which development processing in a short period of time is highly desired.

EXAMPLE 5

In the following examples, the coated amounts of the components are set forth in the same manner as described in Example 4.

| | |
|---|---|
| First Layer: Antihalation Layer | |
| Black colloidal silver | 0.2 |
| Gelatin | 1.3 |
| C-1 | 0.06 |
| UV-1 | 0.1 |
| UV-2 | 0.2 |
| HBS-1 | 0.01 |
| HBS-2 | 0.01 |
| Second Layer: Intermediate Layer | |
| First grain silver bromide (average particle size 0.07 μm) | 0.15 |
| Gelatin | 1.0 |
| C-3 | 0.02 |
| HBS-1 | 0.1 |
| Third Layer: First Red-Sensitive Emulsion Layer | |
| Silver iodobromide emulsion (silver iodide: 2 mol %, average particle size: 0.3 μm) | 0.4 |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| C-12 | 0.060 |
| C-13 | 0.075 |
| C-15 | 0.010 |
| C-3 | 0.03 |
| HBS-1 | 0.03 |
| HBS-3 | 0.012 |

-continued

| | |
|---|---|
| **Fourth Layer: Second Red-Sensitive Emulsion Layer** | |
| Silver iodobromide emulsion (silver iodide: 5 mol %, average particle size: 0.5 μm) | 0.7 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| C-12 | 0.24 |
| C-13 | 0.24 |
| C-10 | 0.05 |
| C-2 | 0.04 |
| HBS-2 | 0.05 |
| HBS-3 | 0.10 |
| **Fifth Layer: Third Red-Sensitive Emulsion Layer** | |
| Silver iodobromide emulsion (silver iodide: 10 mol %, average particle size: 0.7 μm) | 1.0 |
| Gelatin | 1.0 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| C-3 | 0.05 |
| C-5 | 0.1 |
| C-12 | 0.03 |
| HBS-3 | 0.01 |
| HBS-2 | 0.05 |
| **Sixth Layer: Intermediate Layer** | |
| Gelatin | 1.0 |
| Sodium n-octadecylhydroquinonesulfonate | 0.03 |
| HBS-1 | 0.05 |
| **Seventh Layer: First Green-Sensitive Emulsion Layer** | |
| Silver iodobromide emulsion (silver iodide: 4 mol %, average particle size: 0.3 μm) | 0.30 |
| Sensitizing Dye V | $5.0 \times 10^{-4}$ |
| Sensitizing Dye VI | $2.0 \times 10^{-4}$ |
| Gelatin | 0.10 |
| C-14 | 0.2 |
| C-8 | 0.05 |
| C-7 | 0.05 |
| HBS-1 | 0.5 |
| **Eighth Layer: Second Green-Sensitive Em:lsion Layer** | |
| Silver iodobromide emulsion (silver iodide: 5 mol %, average particle size: 0.5 μm) | 0.4 |
| Sensitizing Dye V | $5.0 \times 10^{-4}$ |
| Sensitizing Dye VI | $2.0 \times 10^{-4}$ |
| Gelatin | 0.8 |
| C-14 | 0.25 |
| C-1 | 0.012 |
| C-7 | 0.037 |
| C-8 | 0.03 |
| HBS-1 | 0.2 |
| **Ninth Layer: Third Green-Sensitive Emulsion Layer** | |
| Silver iodobromide emulsion (silver iodide: 6 mol %, average particle size: 0.7 μm) | 0.85 |
| Gelatin | 1.0 |
| Sensitizing Dye V | $3.5 \times 10^{-4}$ |
| Sensitizing Dye VI | $1.4 \times 10^{-4}$ |
| C-14 | 0.10 |
| C-7 | 0.01 |
| C-1 | 0.02 |
| HBS-2 | 0.10 |
| HBS-2 | 0.05 |
| **Tenth Layer: Yellow Filter Layer** | |
| Gelatin | 1.2 |
| Yellow Colloidal Silver | 0.08 |
| 2,5-Di-tert-octylhydroquinone | 0.1 |
| HBS-1 | 0.1 |
| **Eleventh Layer: First Blue-Sensitive Emulsion Layer** | |
| Silver iodobromide emulsion (silver iodide: 4 mol %, average particle size: 0.3 μm) | 0.4 |
| Gelatin | 1.0 |
| Sensitizing Dye VIII | $2.0 \times 10^{-4}$ |
| C-9 | 0.9 |
| C-15 | 0.05 |

-continued

| | |
|---|---|
| HBS-2 | 0.2 |
| **Twelfth Layer: Second Blue-Sensitive Emulsion Layer** | |
| Silver iodobromide emulsion (silver iodide: 10 mol %, average particle size: 1.5 μm) | 0.5 |
| Gelatin | 0.6 |
| Sensitizing Dye V | $1.0 \times 10^{-4}$ |
| C-9 | 0.25 |
| C-15 | 0.05 |
| HBS-3 | 0.07 |
| **Thirteenth Layer: First Protective Layer** | |
| Gelatin | 0.8 |
| UV-1 | 0.1 |
| UV-2 | 0.2 |
| HBS-1 | 0.01 |
| HBS-2 | 0.01 |
| **Fourteenth Layer: Second Protective Layer** | |
| Gelatin | 0.45 |
| Polymethyl methacrylate particles (diameter: 1.5 μm) | 0.2 |
| hardening Agent H-1 | 0.4 |
| Formaldehyde Scavenger S-1 | 0.5 |
| Formaldehyde Scavenger S-2 | 0.1 |

Each layer described above further contained a surface active agent as a coating aid in addition to the above described components.

Samples 502 and 504

Samples 502 and 504 were prepared in the same manner as Sample 501 except using 0.6 times by mole of Coupler C-16, Couplers M-5 and M-29 according to the present invention in place of Coupler C-14 used in the seventh, eighth and ninth layers of Sample 501, respectively.

Samples 505 to 508

Samples 505 to 508 were prepared in the same manner as described for Samples 501 to 504 except further adding Compound A-6 according to the present invention to the seventh, eighth and ninth layers of Samples 501 to 504 in amounts of 0.007 g/m$^2$, 0.010 g/m$^2$ and 0.002 g/m$^2$, respectively.

Samples 501 to 508 thus-prepared were subjected to wedge exposure of 20 CMS at a color temperature of 4,800° K. and then processed using an automatic developing machine in the following manner.

TABLE 6

| Step | Processing V Time | Processing VI Time | Processing VII Time |
|---|---|---|---|
| Color Development | 3 min. 15 sec. | 3 min. 15 sec. | 2 min. 45 sec. |
| Bleaching | 4 min. 20 sec. | 3 min. 00 sec. | 2 min. 00 sec. |
| Fixing | 4 min. 20 sec. | 4 min. 00 sec. | 2 min. 00 sec. |
| Stabilizing (1) | 1 min. 30 sec. | 30 sec. | 20 sec. |
| Stabilizing (2) | 2 min. 00 sec. | 30 sec. | 20 sec. |
| Stabilizing (3) | 1 min. 05 sec. | 40 sec. | 20 sec. |
| Drying | 2 min. 00 sec. | 1 min. 30 sec. | 1 min. 00 sec. |
| All Steps | 18 min. 30 sec. | 13 min. 25 sec. | 8 min. 45 sec. |

In the above described processing steps, the stabilizing steps (1), (2) and (3) were carried out using a countercurrent stabilizing process of (3)→(2)→(1).

The amounts of replenishment for the processing solvents were 600 ml/m$^2$ of the color photographic light-sensitive material with respect to the color development step and 700 ml/m$^2$ of the color photographic light-sensitive material with respect to other processing steps.

The composition of each processing solution used is illustrated below.

| | Tank Solution | Replenisher |
|---|---|---|
| Color Developer Solution: | | |
| Diethylenetriaminepentaacetic acid | 1.0 g | 2.0 g |
| 1-Hydroxyethylidene-1,1-diphosphonic acid | 2.0 g | 3.3 g |
| Sodium sulfite | 4.0 g | 5.0 g |
| Potassium carbonate | 30.0 g | 38.0 g |
| Potassium bromide | 1.4 g | — |
| Potassium iodide | 1.3 mg | — |
| Hydroxylamine sulfate | 2.4 g | 3.2 g |
| 4-(N—Ethyl-N—β-hydroxyethyl amino)-2-methylaniline sulfate | 4.5 g | 7.2 g |
| Water to make | 1 l | 1 l |
| pH | 10.00 | 10.05 |
| Bleaching Solution: | | |
| Ammonium Iron (III) Ethylenediaminetetraacetic acid | 70 g | 80 g |
| Ammonium Fe(III) 1,3-Diaminopropanetetraacetate | 50.0 g | 57 g |
| Aqueous ammonia | 7 ml | 5 ml |
| Ammonium nitrate | 10.0 g | 12.0 g |
| Ammonium bromide | 150 g | 170 g |
| Water to make | 1 l | 1 l |
| pH | 5.5 | 5.0 |
| Fixing Solution: | | |
| Disodium ethylenediaminetetraacetate | 1.0 g | 1.2 g |
| Sodium sulfite | 4.0 g | 5.0 g |
| Sodium bisulfite | 4.6 g | 5.8 g |
| Ammonium thiosulfate (70% aq. soln.) | 175 ml | 20 ml |
| Water to make | 1.0 l | 1.0 l |
| pH | 6.6 | 6.6 |
| Stabilizing Solution: | | |
| Formalin (37% w/v) | 0.75 ml | 1.0 ml |
| Polyphenyletheroxyethylene-p-monononylphenylether (average degree of polymerization: 10) | 0.3 g | 0.45 g |
| 5-Chloro-2-methyl-4-isothiazolin-3-one | 0.03 g | 0.045 g |
| Water to make | 1.0 l | 1.0 l |

Drying

The temperature of drying was 55° C.

With these thus-processed samples, the change in magenta dye density of the area having an initial density of 2.0 after the preservation of the samples under conditions of 60° C. and 70% relative humidity for 3 weeks was determined. The results are shown in Table 7

TABLE 7

| No. | Sample | Processing | Processing Time | Magenta Fading (Change in Magenta Density) |
|---|---|---|---|---|
| 1 | 501 | V | 18'30" | −0.14 |
| 2 | 502 | " | " | −0.10 |
| 3 | 503 | " | " | +0.01 |
| 4 | 504 | " | " | −0.10 |
| 5 | 505 | " | " | −0.15 |
| 6 | 506 | " | " | −0.11 |
| 7 | 507 | " | " | 0 |
| 8 | 508 | " | " | −0.01 |
| 9 | 501 | VI | 13'25" | −0.15 |
| 10 | 502 | " | " | −0.12 |
| 11 | 503 | " | " | +0.06 |
| 12 | 504 | " | " | +0.07 |
| 13 | 505 | " | " | −0.15 |
| 14 | 506 | " | " | −0.11 |
| 15 | 507 | " | " | +0.01 |
| 16 | 508 | " | " | 0 |
| 17 | 501 | VII | 8'45" | −0.16 |
| 18 | 502 | " | " | −0.13 |
| 19 | 503 | " | " | +0.14 |
| 20 | 504 | " | " | +0.15 |
| 21 | 505 | " | " | −0.15 |
| 22 | 506 | " | " | −0.12 |
| 23 | 507 | " | " | +0.02 |
| 24 | 508 | " | " | +0.01 |

It is apparent from the results shown in Table 7 that Samples 507 and 508 according to the present invention had excellent color image stability after processing in any of the processing methods and the processing method according to the present invention is particularly effective in laboratories in which development processing in a short period of time is highly desired.

EXAMPLE 6

The same procedure as described in Example 5 was conducted except changing Processing Methods V to VII and the compositions of the processing solution to those set forth below.

| Step | Processing V' Time | Processing VI' Time | Processing VII' Time |
|---|---|---|---|
| Color Development | 3 min. 15 sec. | 3 min. 15 sec. | 2 min. 45 sec. |
| Bleaching | 4 min. 20 sec. | 3 min. 00 sec. | 2 min. 00 sec. |
| Fixing | 4 min. 20 sec. | 4 min. 00 sec. | 2 min. 00 sec. |
| Washing with Water (1) | 1 min. 30 sec. | 30 sec. | 20 sec. |
| Washing with Water (2) | 2 min. 00 sec. | 30 sec. | 20 sec. |
| Stabilizing | 1 min. 05 sec. | 40 sec. | 20 sec. |
| Drying | 2 min. 00 sec. | 1 min. 30 sec. | 1 min. 00 sec. |
| All Steps | 18 min. 30 sec. | 13 min. 25 sec. | 8 min. 45 sec. |

In the above described processing steps, the washing with water steps (1) and (2) were carried out in accordance with a countercurrent water washing system from step (2) to step (1).

The composition of each processing solution used in the above described processing is described below.

| | Tank Solution | Replenisher |
|---|---|---|
| Color Developing Solution: | | |
| Diethylenetriaminepentaacetic acid | 3.0 g | 3.0 g |
| Potassium carbonate | 37 g | 37 g |
| 1-Hydroxyethyledene-1,1-diphosphonic acid | 2.0 g | 2.2 g |
| Sodium sulfite | 3.2 g | 4.5 g |
| Potassium bromide | 1.2 g | 0.95 g |
| Hydroxylamine sulfate | 2.7 g | 3.4 g |
| 4-(N—Ethyl-N—β-hydroxyethyl amino)-2-methylaniline sulfate | 4.0 g | 5.0 g |
| Potassium iodide | 5 mg | — |
| Water to make | 1 liter | 1 liter |
| Adjusted pH with potassium hydroxide to | 10.05 | 10.10 |
| Bleaching Solution: | | |
| Ammonium bromide | 177 g | 177 g |
| Ammonium iron (III) ethylene- | 120 g | 120 g |

-continued

| | | |
|---|---|---|
| diaminetetraacetic acid | | |
| Ethylenediaminetetraacetic acid | 10 g | 10 g |
| Aqueous ammonia | 10 ml | 4 ml |
| Ammonium nitrate | 10.0 g | 12.0 g |
| Water to make | 1 liter | 1 liter |
| Adjusted pH with aqueous ammonia or acetic acid to | 6.0 | 5.7 |
| Fixing Solution: | | |
| Same as described in Example 5. | | |
| Washing Water: (both Tank Solution and Replenisher) | | |
| 2-Methyl-4-isothiazolin-3-one | 3 mg | |
| 5-Chloro-2-methyl-4-isothiazolin-3-on | 6 mg | |
| Ethylene glycol | 1.5 ml | |
| Water to make | 1 liter | |
| Stabilizing Solution: (both Tank Solution and Replenisher) | | |
| Formalin (37% w/v) | 4.0 ml | |
| Ethyleneglycol | 2 g | |
| Surface Active Agent | 0.4 g | |

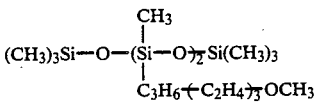

| | |
|---|---|
| Water to make | 1.0 liter |

From the results obtained it can be seen that Samples 507 and 508 according to the present invention had excellent color image stability after processing, as same as in Example 5.

EXAMPLE 7

Samples 401 to 404 prepared in Example 4 were subjected to wedge exposure in an exposure amount of 20 CMS at a color temperature of 4,800° K. and then processed using an automatic developing machine according to the processing steps shown in Table 8.

TABLE 8

| Processing Step | Processing Time | Processing Temperature |
|---|---|---|
| Color Development | 3 min. 15 sec. | 37.8° C. |
| Bleaching | 6 min. 30 sec. | 37.8° C. |
| Washing with Water (1) | 2 min. 10 sec. | 24° C. |
| Fixing | 4 min. 20 sec. | 37.8° C. |
| Washing with Water (2) | 2 min. 10 sec. | 24° C. |
| Washing with Water (3) | 2 min. 10 sec. | 24° C. |
| Stabilizing | 2 min. 10 sec. | 37.8° C. |
| Drying | shown in Table 9 | 48° C. |

In the above processing steps, the washing with water steps (2) and (3) were carried out in accordance with the countercurrent water washing system from step (3) to step (2).

The amounts of replenishment for the processing solutions were 1,100 ml for the color development step, 600 ml for the bleaching step, 1,000 ml for the fixing step, 1,000 ml for the stabilizing step and 11,000 ml for the washing with water step per $m^2$ of the color photographic light-sensitive material.

The composition of each processing solution used in the processing is described below.

| | Tank Solution | Replenisher |
|---|---|---|
| Color Developing Solution: | | |
| Diethylenetriaminepentaacetic acid | 3.0 g | 3.0 g |
| Potassium carbonate | 37 g | 37 g |
| 1-Hydroxyethylidene-1,1-diphosphonic acid | 2.0 g | 2.2 g |
| Sodium sulfite | 3.2 g | 4.5 g |
| Potassium bromide | 1.2 g | 0.95 g |
| Hydroxylamine sulfate | 2.7 g | 3.4 g |
| 4-(N—Ethyl-N—β-hydroxyethyl amino)-2-methylaniline sulfate | 4.0 g | 5.0 g |
| Potassium iodide | 5 mg | — |
| Water to make | 1 liter | 1 liter |
| Adjusted pH with potassium hydroxide to | 10.05 | 10.10 |
| Bleaching Solution: | | |
| Ammonium bromide | 177 g | 177 g |
| Ammonium iron (III) ethylenediaminetetraacetic acid | 120 g | 120 g |
| Ethylenediaminetetraacetic acid | 10 g | 10 g |
| Aqueous ammonia | 10 ml | 4 ml |
| Ammonium nitrate | 10.0 g | 12.0 g |
| Water to make | 1 liter | 1 liter |
| Adjusted pH with aqueous ammonia or acetic acid to | 6.0 | 5.7 |
| Fixing Solution: | | |
| Disodium ethylenediaminetetraacetate | 1.0 g | 1.2 g |
| Sodium sulfite | 4.0 g | 5.0 g |
| Sodium bisulfite | 4.6 g | 5.8 g |
| Ammonium thiosulfate (70% aq. soln.) | 175 ml | 20 ml |
| Water to make | 1.0 l | 1.0 l |
| pH | 6.6 | 6.6 |
| Stabilizing Solution: (both Tank Solution and Replenisher) | | |
| Formalin (37% w/v) | 4.0 ml | |
| Ethylene glycol | 2 g | |
| Surface Active Agent | 0.4 g | |

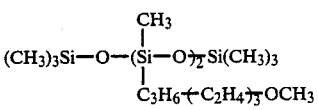

| | |
|---|---|
| Water to make | 1.0 liter |

With the samples thus-processed, magenta dye densities at the exposure amount of 0.05 CMS were measured just after the drying step and after one day, and the value of (density after one day)−(density just after processing) was determined. The results obtained are shown in Table 9 below.

Additionally, the magenta densities of Samples 403 and 404 at each processing step are illustrated in FIG. 1. The processing steps are indicated in terms of (A) after completion of the color development, (B) after imersion in the bleaching bath for 1 minute, (C) after completion of the bleaching, (D) after completion of the stabilizing, (E) after drying for 5 minutes, and (F) after drying for 10 minutes. At the steps (A) to (D), the material was removed from the processing sequence, imersed in Michaelis phospholic acid buffer solution (pH: 7.0) for 30 seconds, and dried with cool air for 10 minutes; and the magenta density excluding the density of silver and silver halide was measured.

Further, the samples thus-processed were preserved under conditions of 40° C. and 80% relative humidity (forced degradation conditions) for 14 days and then the value of (density after forced degradation conditions for 14 days)−(density after one day) was determined. The results are also shown in Table 9 below.

TABLE 9

| No. | Sample | Drying Time (min.) | Change in Magenta Density | Change in Density under Forced Degradation Conditions |
|---|---|---|---|---|
| 1 (Comparison) | 401 | 10 | +0.01 | −0.32 |
| 2 (Comparison) | 402 | " | 0.00 | −0.31 |
| 3 (Comparison) | 403 | " | +0.01 | −0.05 |
| 4 (Comparison) | 404 | " | 0.00 | −0.05 |
| 5 (Comparison) | 401 | 7 | 0.00 | −0.31 |
| 6 (Comparison) | 402 | " | +0.01 | −0.31 |
| 7 (Comparison) | 403 | " | +0.04 | −0.04 |
| 8 (Present Invention) | 404 | " | 0.00 | −0.05 |
| 9 (Comparison) | 401 | 5 | 0.00 | −0.32 |
| 10 (Comparison) | 402 | " | +0.01 | −0.31 |
| 11 (Comparison) | 403 | " | +0.07 | −0.05 |
| 12 (Present Invention) | 404 | " | 0.00 | −0.04 |
| 13 (Comparison) | 401 | 3 | +0.01 | −0.32 |
| 14 (Comparison) | 402 | " | 0.00 | −0.32 |
| 15 (Comparison) | 403 | " | +0.08 | −0.05 |
| 16 (Present Invention) | 404 | " | +0.01 | −0.04 |

From the results shown in Table 9, it is apparent that the samples using couplers outside the scope of the present invention exhibited a severe decrease in density under forced degradation conditions, although showing less density change after processing by any of the drying times. The samples using the coupler according to the present invention but not containing the compound represented by the general formula (II) according to the present invention exhibited severe density change after processing when of using a drying time of 7 minutes or less, although showing less density decrease under forced degradation condition. In contrast, in the samples using the combination of the present invention, not only was the density decrease under the forced degradation condition reduced, but also the density change after the processing was lower for all drying times.

EXAMPLE 8

The same procedure as described in Example 7 was conducted except using washing water having the composition shown below, and changing the amount of replenisher thereof to 850 ml per $m^2$ of the color photographic light-sensitive material and the temperature thereof to 35° C. The results similar to those as described in Table 9 were obtained.

| Washing Water: (both Tank Solution and Replenisher) | |
|---|---|
| 2-Methyl-4-isothiazolin-3-one | 3 mg |
| 5-Chloro-2-methyl-4-isothiazolin-3-on | 6 mg |
| Ethylene glycol | 1.5 ml |

-continued

| Washing Water: (both Tank Solution and Replenisher) | |
|---|---|
| Water to make | 1 liter |

EXAMPLE 9

The same procedure as described in Example 7 was conducted except changing the processing steps and the compositions of the processing solutions to those shown in Table 10 below. Results similar to those described in Table 9 were obtained.

The above examples demonstrate that the silver halide color photographic material according to the present invention containing the two-equivalent pyrazolone magenta coupler and the carboxylic acid compound has high sensitivity and provides a magenta color image having good preservability.

A method for processing the silver halide color photographic material is also a part of the present invention. According to the method according to the present invention, color images having good sharpness and preservability without formation of color fog and degradation of color forming properties are obtained in a short processing time, even when the amount of water for washing or a stabilizing solution is significantly reduced.

TABLE 10

| Processing Step | Processing Time | Processing Temperature |
|---|---|---|
| Color Development | 3 min. 15 sec. | 38° C. |
| Bleaching | 6 min. 30 sec. | 38° C. |
| Washing with Water | 2 min. 10 sec. | 35° C. |
| Fixing | 4 min. 20 sec. | 38° C. |
| Washing with Water | 1 min. 05 sec. | 35° C. |
| Washing with Water | 2 min. 10 sec. | 35° C. |
| Stabilizing | 1 min. 05 sec. | 38° C. |
| Drying | Same as in Example 7 | 50° C. |

The amount of replenishment for the washing with water step was changed to 850 ml per $m^2$ of the color photographic light-sensitive material.

The composition of each processing solution used is illustrated below.

| | Tank Solution | Replenisher |
|---|---|---|
| Color Developing Solution: | | |
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethyl amino)-2-methylaniline sulfate | 4.5 g | 5.0 g |
| Water to make | 1.0 liter | 1.0 liter |
| pH | 10.00 | 10.05 |
| Bleaching Solution and Fixing Solution: | | |
| Same as described in Example 7. | | |

Washing Water

Tap water containing 32 mg/l of calcium ion and 7.3 mg/l of magnesium ions was passed through a column filled with an H type strong acidic cation exchange resin and an OH type strong basic anion exchange resin to prepare water containing 1.2 mg/l of calcium ion and 0.4 mg/l of magnesium ions. To the water thus-treated was added sodium dichloroisocyanurate in an amount of 20 mg/l.

| Stabilizing Solution: (both Tank Solution and Replenisher) | |
|---|---|
| Formalin (37% w/v) | 2.0 ml |
| Polyoxyethylene-p-monononylphenylether (average degree of polymerization =10) | 0.3 g |
| Disodium ethylenediaminetetraacetate | 0.05 g |
| Water to make | 1.0 liter |
| pH | 5.8 |

EXAMPLE 10

Samples 501 to 508 prepared in Example 5 were subjected to wedge exposure in an exposure amount of 20 CMS at a color temperature of 4,800° K. and then processed using an automatic developing machine according to the processing step shown in Table 11 below.

| Processing Step | Processing Time | Processing Temperature |
|---|---|---|
| Color Development | 3 min. 15 sec. | 37.8° C. |
| Bleaching | 4 min. 20 sec. | 37.8° C. |
| Fixing | 4 min. 20 sec. | 37.8° C. |
| Stabilizing (1) | 1 min. 05 sec. | 35.0° C. |
| Stabilizing (2) | 2 min. 10 sec. | 35.0° C. |
| Stabilizing (3) | 1 min. 05 sec. | 35.0° C. |
| Drying | Shown in Table 12 below | 55° C. |

In the above described processing steps, the stabilizing steps (1), (2) and (3) were carried out using a countercurrent stabilizing process of (3)→(2)→(1).

The amounts of replenishment for the processing solutions were 900 ml/m$^2$ of the color photographic light-sensitive material with respect to the color development step and 700 ml/m$^2$ of the color photographic light-sensitive material with respect to other processing steps.

The composition of each processing solution used is illustrated below.

| Color Developing Solution, Bleaching Solution and Fixing Solution: | | |
|---|---|---|
| Same as described in Example 7. | | |
| Stabilizing Solution: | Tank Solution | Replenisher |
| Formalin (37% w/v) | 0.75 ml | 1.0 ml |
| Polyoxyethylene-p-monononyl-phenylether (average degree of polymerization =10) | 0.3 g | 0.45 g |
| 5-Chloro-2-methyl-4-isothiazolin-3-one | 0.03 g | 0.045 g |
| Water to make | 1.0 liter | 1 liter |

With these thus-processed samples, the change in magenta dye density was determined in the same manner as described in Example 7. The results obtained are shown in Table 12 below.

TABLE 12

| No. | Sample | Drying Time (min.) | Change in Magenta Density | Change in Density under Forced Degradation Condition |
|---|---|---|---|---|
| 1 (Comparison) | 501 | 10 | 0.00 | −0.28 |
| 2 (Comparison) | 502 | " | +0.01 | −0.25 |
| 3 (Comparison) | 503 | " | +0.01 | −0.03 |
| 4 (Comparison) | 504 | " | 0.00 | −0.04 |
| 5 (Comparison) | 505 | " | −0.01 | −0.27 |
| 6 (Comparison) | 506 | " | 0.00 | −0.24 |
| 7 (Comparison) | 507 | " | +0.01 | −0.03 |
| 8 (Comparison) | 508 | " | 0.00 | −0.03 |
| 9 (Comparison) | 501 | 7 | 0.00 | −0.27 |
| 10 (Comparison) | 502 | " | 0.00 | −0.25 |
| 11 (Comparison) | 503 | " | +0.03 | −0.03 |
| 12 (Comparison) | 504 | " | +0.04 | −0.03 |
| 13 (Comparison) | 505 | " | −0.01 | −0.28 |
| 14 (Comparison) | 506 | " | 0.00 | −0.25 |
| 15 (Present Invention) | 507 | " | 0.00 | −0.04 |
| 16 (Present Invention) | 508 | " | −0.01 | −0.03 |
| 17 (Comparison) | 501 | 4 | +0.01 | −0.27 |
| 18 (Comparison) | 502 | " | +0.01 | −0.24 |
| 19 (Comparison) | 503 | " | +0.08 | −0.04 |
| 20 (Comparison) | 504 | " | +0.09 | −0.04 |
| 21 (Comparison) | 505 | " | 0.00 | −0.28 |
| 22 (Comparison) | 506 | " | +0.01 | −0.24 |
| 23 (Present Invention) | 507 | " | 0.00 | −0.03 |
| 24 (Present Invention) | 508 | " | +0.01 | −0.03 |

It is apparent from the results shown in Table 12 that the samples according to the present invention exhibited not only reduced decrease in density under forced degradation conditions but also less density change after processing, even when a drying step of short duration was used. It is possible to achieve short time and low cost finishing which is desired in laboratories by means of the short drying times of the method according to the present invention and thus, the present invention is worthwhile economically.

EXAMPLE 11

Sample 401 prepared in Example 4 was cut into strips 35 mm in width, used to photograph standard subjects outdoors, and then processed according to Processing (I), (II) or (III) shown in Table 13 below using an automatic developing machine.

TABLE 13

| Step | Processing Time | Processing Temperature | Amount of Replenishment* Processing (I) | Processing (II) | Processing (III) | Capacity of Tank |
|---|---|---|---|---|---|---|
| Color Development | 3'15" | 38° C. | 38 ml | 38 ml | 38 ml | 8 l |
| Bleaching | 6'30" | 38° C. | 33 ml | 33 ml | 33 ml | 16 l |
| Fixing | 4'20" | 38° C. | 33 ml | 33 ml | 33 ml | 11 l |
| Washing with Water (1) | 1'40" | 35° C. | — | — | — | 4 l |
| Washing with Water (2) | 1'40" | 35° C. | 1200 ml | 30 ml | 10 ml | 4 l |
| Stabilizing | 1'05" | 38° C. | 33 ml | 33 ml | 33 ml | 4 l |
| Drying | 4'00" | 45° C. | — | — | — | — |

*Amount of replenishment per 1 meter of a 35 mm width strip.

In the above described processing steps, the washing with water steps were carried out using a countercurrent water washing process from Washing with Water (2) to Washing with Water (1).

Further, the amount of the fixing solution carried over to the water washing step in each of processings (I), (II) and (III) was 2 ml per 1 meter of a 35 mm width strip.

The composition of each processing solution used is illustrated below.

| | Tank Solution | Replenisher |
|---|---|---|
| Color Developing Solution: | | |
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethyl amino)-2-methylaniline sulfate | 4.5 g | 5.0 g |
| Water to make | 1.0 liter | 1.0 liter |
| pH | 10.00 | 10.05 |
| Bleaching Solution: | | |
| Ammonium bromide | 160 g | 180 g |
| Ammonium iron (III) ethylenediaminetetraacetic acid | 110 g | 130 g |
| Disodium ethylenediaminetetraacetate dihydrate | 10 g | 11 g |
| Ammonium nitrate | 30 g | 33 g |
| Aqueous ammonia (28%) | 7 ml | 5 ml |
| Water to make | 1 liter | 1 liter |
| pH | 6.0 | 5.7 |
| Fixing Solution: | | |
| Ammonium thiosulfate solution (70% w/v) | 170 ml | 200 ml |
| Sodium sulfite | 7.0 g | 8.0 g |
| Sodium bisulfite | 5 g | 5.5 g |
| Disodium ethylenediaminetetraacetate dihydrate | 0.5 g | 0.7 g |
| Water to make | 1.0 l | 1.0 l |
| pH | 6.7 | 6.6 |

Washing Water: (both Tank Solution and Replenisher)

In Processing (I), tap water was used.

In Processing (II) and (III), tap water was passed through a column filled with an H type strong acidic cation exchange resin (Amberlite IR-120B manufactured by Rhom and Haas Co.) and an OH type strong basic anion exchange resin (Amberlite IRA-400 manufactured by Rhom and Haas Co.) at a volume ratio of 1:1 to reduce both calcium and magnesium to less than 1 mg per liter, respectively, and sodium dichloroisocyanurate was added in an amount of 0.02 g per liter.

| Stabilizing Solution: | Tank Solution | Replenisher |
|---|---|---|
| Formalin (37% w/v) | 2.0 ml | 3.0 ml |
| Polyoxyethylene-p-monononylphenyl ether (average degree of polymerization: 10) | 0.3 g | 0.45 g |
| Disodium ethylenediaminetetraacetate | 0.05 g | 0.07 g |
| Water to make | 1 liter | 1 liter |

The amount of Sample 401 processed was 900 meters of a 35 mm width strip in each of Processing (I), (II) and (III).

After conducting the above described running processing, Samples 401 to 404 which had been exposed at the color temperature of 4800° K. and 20 CMS were processed. The magenta dye density of each sample thus processed was measured.

Further, the thus-processed samples were preserved under conditions of 80° C. and 70% relative humidity for 3 days and thereafter the magenta dye density of each sample was again measured. A ratio (%) of change in magenta dye density to the initial density was determined. The results obtained are shown in Table 14 below.

TABLE 14

| No. | Sample | Processing | Replenisher Amount of Washing Water/Amount Carried over from Pre-Bath | Ratio of Change in Magenta Density (%) | Remark |
|---|---|---|---|---|---|
| 1 | 401 | (I) | 600 | −3 | Comparison |
| 2 | 402 | " | " | −3 | " |
| 3 | 403 | " | " | +2 | " |

TABLE 14-continued

| No. | Sample | Processing | Replenisher Amount of Washing Water/Amount Carried over from Pre-Bath | Ratio of Change in Magenta Density (%) | Remark |
|---|---|---|---|---|---|
| 4 | 404 | " | " | −2 | " |
| 5 | 401 | (II) | 40 | −8 | Comparison |
| 6 | 402 | " | " | −8 | " |
| 7 | 403 | " | " | +6 | " |
| 8 | 404 | " | " | −2 | Present Invention |
| 9 | 401 | (III) | 10 | −12 | Comparison |
| 10 | 402 | " | " | −11 | " |
| 11 | 403 | " | " | +7 | " |
| 12 | 404 | " | " | −2 | Present Invention |

From the results shown in Table 14, it can be seen that it is possible to significantly reduce the amount of washing water without reducing image preservability according to the present invention (Nos. 8 and 12). On the contrary, in the comparative examples, image preservability was severely degraded by the water saving processing.

EXAMPLE 12

The same procedure as described in Example 11 was conducted except changing the washing water for Processing methods (II) and (III) to those shown below. The results obtained are shown in Table 15 below.

| Washing Water: (both Tank Solution and Replenisher) | |
|---|---|
| Disodium ethylenediaminetetraacetate (dihydrate) | 0.35 g |
| Water to make | 1 liter |
| adjusted pH to 7.0 with sodium hydroxide. | |

TABLE 15

| No. | Sample | Processing | Replenisher Amount of Washing Water/Amount Carried over from Pre-Bath | Ratio of Change in Magenta Density (%) | Remark |
|---|---|---|---|---|---|
| 1 | 401 | (I) | 600 | −3 | Comparison |
| 2 | 402 | " | " | −3 | " |
| 3 | 403 | " | " | +2 | " |
| 4 | 404 | " | " | −2 | " |
| 5 | 401 | (II) | 40 | −9 | Comparison |
| 6 | 402 | " | " | −9 | " |
| 7 | 403 | " | " | +7 | " |
| 8 | 404 | " | " | −3 | Present Invention |
| 9 | 401 | (III) | 10 | −13 | Comparison |
| 10 | 402 | " | " | −12 | " |
| 11 | 403 | " | " | +8 | " |
| 12 | 404 | " | " | −3 | Present Invention |

EXAMPLE 13

The same procedures as in Example 11 were repeated exept that the washing waters used in Processing methods (II) and (III) and the stabilizing solutions used in Processing methods (I), (II), and (III) were replaced with the washing water and the stabilizing solution shown below, respectively.

| Washing Water: (both Tank Solution and Replenisher) | |
|---|---|
| 2-Methyl-4-isothiazolin-3-one | 3 mg |
| 5-Chloro-2-methyl-4-isothiazolin-3-one | 6 mg |
| Ethylene grycol | 1.5 ml |
| Water to make | 1 liter |
| **Stabilizing Solution: (both Tank Solution and Replenisher)** | |
| Formarin | 4.0 ml |
| Ethylene glycol | 2 g |
| Surface active agent | 0.4 g |

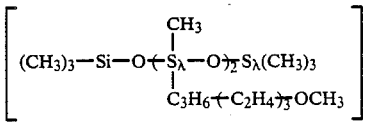

| | |
|---|---|
| Water to make | 1 liter |
| pH | 7.2 |

EXAMPLE 14

Sample 501 prepared in Example 5 was cut and photographed in the same manner as described in Example 11 and then processed according to Processing (IV), (V) or (VI) shown in Table 16 below. In the following processing methods the amount of the solution carried over from the preceding bath to the washing water was 2 ml per 1 meter of a 35 mm width strip. The processing temperature was 38° C. in each processing bath.

TABLE 16

| Processing Step | Processing (IV) Processing Time | Processing (IV) Amount of* Replenishment | Processing (V) Processing Time | Processing (V) Amount of* Replenishment | Processing (VI) Processing Time | Processing (VI) Amount of* Replenishment | Capacity of Tank |
|---|---|---|---|---|---|---|---|
| Color | 3 min. 15 sec. | 15 ml | 3 min. 15 sec. | 15 ml | 3 min. 15 sec. | 15 ml | 8 l |
| Bleaching | 1 min. 00 sec. | 10 ml | 1 min. 00 sec. | 10 ml | 1 min. 00 sec. | 10 ml | 4 l |

TABLE 16-continued

| Processing Step | Processing (IV) Processing Time | Processing (IV) Amount of* Replenishment | Processing (V) Processing Time | Processing (V) Amount of* Replenishment | Processing (VI) Processing Time | Processing (VI) Amount of* Replenishment | Capacity of Tank |
|---|---|---|---|---|---|---|---|
| Bleach-Fixing | 3 min. 15 sec. | 15 ml | 3 min. 15 sec. | 15 ml | 3 min. 15 sec. | 15 ml | 8 l |
| Washing with Water (1) | 1 min. 30 sec. | — | 1 min. 30 sec. | — | 40 sec. | — | 4 l |
| Washing with Water (2) | 1 min. 30 sec. | 1,200 ml | 1 min. 30 sec. | 20 ml | 40 sec. | 20 ml | 4 l |
| Stabilizing | 40 sec. | 15 ml | 40 sec. | 15 ml | 40 sec. | 15 ml | 4 l |
| Drying | 1 min. 15 sec. | — | 1 min. 15 sec. | — | 1 min. 15 sec. | — | — |

*Amount of replenishment per 1 meter of a 35 mm width strip

In the above described processing steps, the washing with water steps were carried out using a countercurrent water washing process from Washing with Water (2) to Washing with Water (1).

The composition of each processing solution used is illustrated below.

| | Tank Solution | Replenisher |
|---|---|---|
| Color Developing Solution: | | |
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.9 g |
| Potassium carbonate | 30.0 g | 42.0 g |
| Potassium bromide | 1.6 g | — |
| Potassium iodide | 2.0 mg | — |
| Hydroxylamine sulfate | 2.4 g | 3.6 g |
| 4-(N-Ethyl-N—β-hydroxyethyl amino)-2-methylaniline sulfate | 5.0 g | 7.3 g |
| Water to make | 1.0 liter | 1.0 liter |
| pH | 10.00 | 10.05 |
| Bleaching Solution: (both Tank Solution and Replenisher) | | |
| Ammonium Iron (III) ethylenediaminetetra-acetate | | 120.0 g |
| Disodium ethylenediaminetetraacetate | | 10.0 g |
| Ammonium nitrate | | 10.0 g |
| Ammonium bromide | | 100.0 g |
| Bleach accelerating agent: | | $5 \times 10^{-3}$ mol |

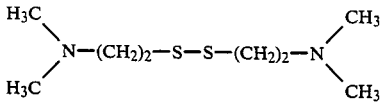

| | |
|---|---|
| adjusted pH to 6.3 with aqueous ammonia | |
| Water to make | 1.0 liter |
| Bleach-Fixing Solution: (both Tank Solution and Replenisher) | |
| Ammonium iron (III) ethylenediaminetetra-acetate | 50.0 g |
| Disodium ethylenediaminetetraacetate | 5.0 g |
| Sodium sulfite | 12.0 g |
| Ammonium bromide | 100.0 g |
| Aqueous solution of ammonium thiosulfate (70%) | 240.0 ml |
| adjusted pH to 7.3 with aqueous ammonia | |
| Water to make | 1.0 liter |

Washing Water

In Processing method (IV), tap water was used.

In Processing methods (V) and (VI), city water was passed through a column filled with a Na type strong acidic cation exchange resin (Diaion SK-1B manufactured by Mitsubishi Chemical Industries Ltd.) to prepare water having the water quality of calcium: 2 mg/l and magnesium: 1.2 mg/l.

Stabilizing Solution

Same as described in Example 11.

The amount of Sample 501 processed was 1,200 meters of a 35 mm width strip in each of Processing methods (IV), (V) and (VI).

After conducting the above described running processing, Samples 501 to 508 which had been exposed at a color temperature of 4,800° K. and 20 CMS were processed. The magenta dye density of each sample thus processed was measured.

Further, the thus-processed samples were preserved under conditions of 80° C. and 70% relative humidity for 3 days and thereafter the magenta dye density of each sample was again measured. A ratio (%) of change in magenta dye density to the initial density was determined. The results obtained are shown in Table 17 below.

TABLE 17

| No. | Sample | Processing | Replenisher Amount of Washing Water/Amount Carried over from Pre-Bath | Ratio of Change in Magenta Density (%) | Remark |
|---|---|---|---|---|---|
| 1 | 501 | (IV) | 600 | −3 | Comparison |
| 2 | 502 | " | " | −2 | " |
| 3 | 503 | " | " | +2 | " |
| 4 | 504 | " | " | +2 | " |
| 5 | 505 | " | " | −3 | " |
| 6 | 506 | " | " | −3 | " |
| 7 | 507 | " | " | −3 | " |
| 8 | 508 | " | " | −3 | " |
| 9 | 501 | (V) | 10 | −7 | Comparison |
| 10 | 502 | " | " | −6 | " |
| 11 | 503 | " | " | +5 | " |
| 12 | 504 | " | " | +5 | " |
| 13 | 505 | " | " | −7 | " |
| 14 | 506 | " | " | −7 | " |

TABLE 17-continued

| No. | Sample | Processing | Replenisher Amount of Washing Water/Amount Carried over from Pre-Bath | Ratio of Change in Magenta Density (%) | Remark |
|---|---|---|---|---|---|
| 15 | 507 | " | " | −3 | Present Invention |
| 16 | 508 | " | " | −3 | Present Invention |
| 17 | 501 | (IV) | 10 | −12 | Comparison |
| 18 | 502 | " | " | −11 | " |
| 19 | 503 | " | " | +9 | " |
| 20 | 504 | " | " | +9 | " |
| 21 | 505 | " | " | −12 | " |
| 22 | 506 | " | " | −11 | " |
| 23 | 507 | " | " | −3 | Present Invention |
| 24 | 508 | " | " | −3 | Present Invention |

It is apparent from the results shown in Table 17 that a degradation of image preservability, such as increase in magenta density or fading of magenta density, occurred in the method outside the scope of the present invention (comparative examples) when water saving processing and short water washing time processing (Processing (VI)) were conducted. On the contrary, water saving and shortened water washing time can be achieved without reducing image preservability according to the present invention.

TABLE 18

(Processing temperature in each bath at 38° C.)

| Processing Step | Processing (VII) Time | Processing (VII) Amount of Replenishment* | Processing (VIII) Time | Processing (VIII) Amount of Replenishment* |
|---|---|---|---|---|
| Color Developer | 3 min. 15 sec. | 15 ml | 3 min. 15 sec. | 15 ml |
| Bleaching | 3 min. 00 sec. | 5 ml | 3 min. 00 sec. | 5 ml |
| Fixing | 4 min. 00 sec. | 30 ml | 4 min. 00 sec. | 30 ml |
| Stabilizing (1) | 30 sec. | — | 30 sec. | — |
| Stabilizing (2) | 30 sec. | — | 30 sec. | — |
| Stabilizing (3) | 30 sec. | 1000 ml | 30 sec. | 30 ml |
| Drying | 1 min. 30 sec. 50° C. | — | 1 min. 30 sec. 50° C. | — |

*per 1 meter of a 35 mm width strip

EXAMPLE 15

The same procedure as described in Example 14 was conducted except changing the processing steps and the processing solutions to those as shown below. As a result, excellent image preservability was obtained according to the present invention, even under significant water saving conditions as described in Example 14.

The composition of each processing solution used is illustrated below.

| | Tank Solution | Replenisher |
|---|---|---|
| Color Developer Solution: | | |
| Diethylenetriaminepentaacetic acid | 1.0 g | 2.0 g |
| 1-Hydroxyethylidene-1,1-diphosphonic acid | 2.0 g | 3.3 g |
| Sodium sulfite | 4.0 g | 5.0 g |
| Potassium carbonate | 30.0 g | 38.0 g |
| Potassium bromide | 1.4 g | — |
| Potassium iodide | 1.3 mg | — |
| Hydroxylamine sulfate | 2.4 g | 3.2 g |
| 4-(N—Ethyl-N—β-hydroxyethyl amino)-2-methylaniline sulfate | 4.5 g | 7.2 g |
| Water to make | 1 l | 1 l |
| pH | 10.00 | 10.05 |
| Bleaching Solution: | | |
| Ammonium iron (III) ethylenediaminetetraacetate dihydrate | 80 g | 90 g |
| Ammonium iron (III) 1,3-ditetraacetate dihydrate | 50 g | 56 g |
| Aqueous ammonia | 7 ml | 5 ml |
| Ammonium nitrate | 10 g | 12 g |
| Ammonium bromide | 150 g | 170 g |
| Water to make | 1.0 liter | 1.0 liter |
| pH | 6.0 | 5.8 |
| Fixing Solution: | | |
| Disodium ethylenediaminetetraacetate | 1.0 g | 1.2 g |
| Sodium sulfite | 4.0 g | 5.0 g |
| Sodium bisulfite | 4.6 g | 5.8 g |
| Ammonium thiosulfate (70% aq. soln.) | 175 ml | 200 ml |
| Water to make | 1.0 l | 1.0 l |
| pH | 6.6 | 6.6 |
| Stabilizing Solution: | | |
| Formalin (37% w/v) | 2.0 ml | 3.0 ml |
| Polyoxyethylene-p-monononyl phenyl ether (average degree of polymerization: 10) | 0.3 g | 0.45 g |
| 5-Chloro-2-methyl-4-isothiazolin-3-one | 0.03 g | 0.045 g |
| Water to make | 1.0 l | 1.0 l |

The chemical structures or compositions of the compounds employed for preparing the samples as described in Examples 4 to 17 are shown below.

U-1
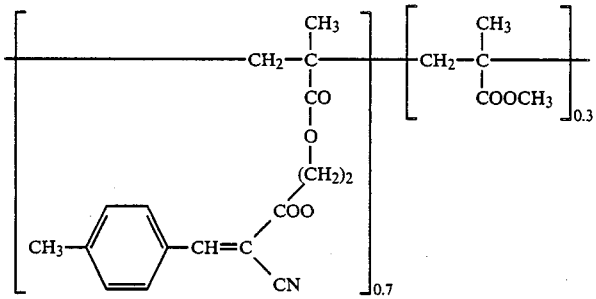
C-1
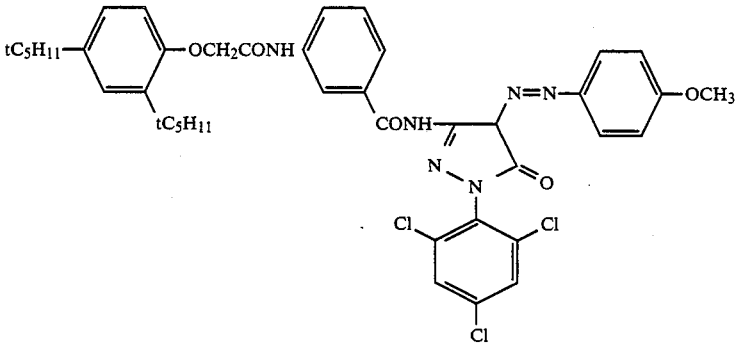
U-2
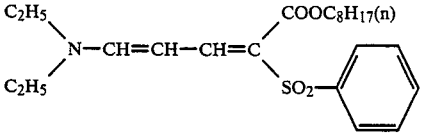
C-2
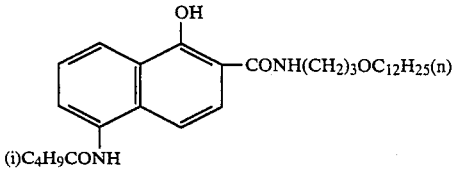
C-3
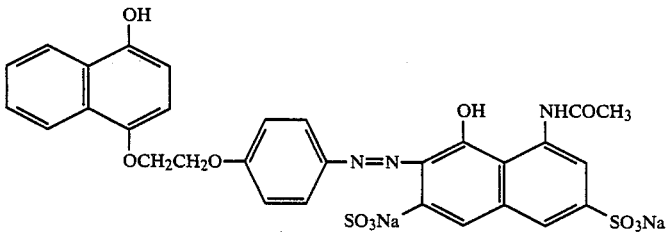
C-4
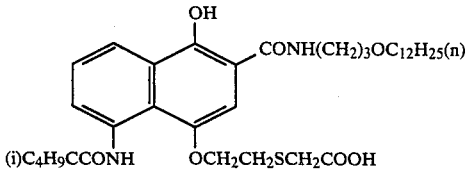

-continued
C-5
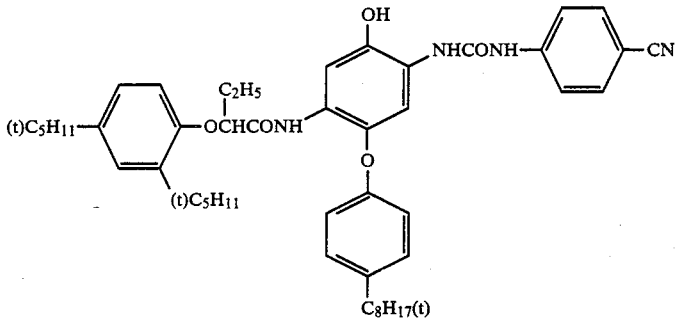
C-6
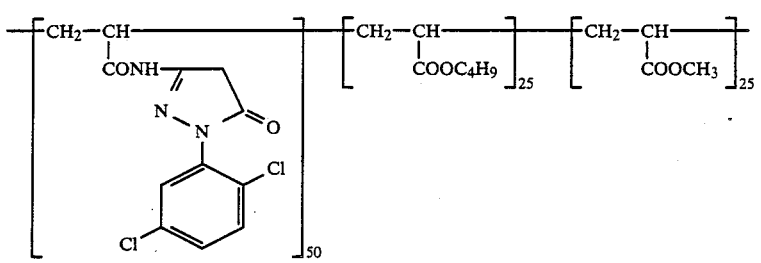
average molecular weight 30,000
C-7
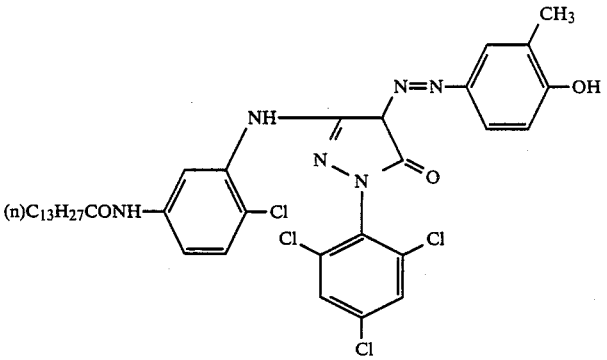
C-8
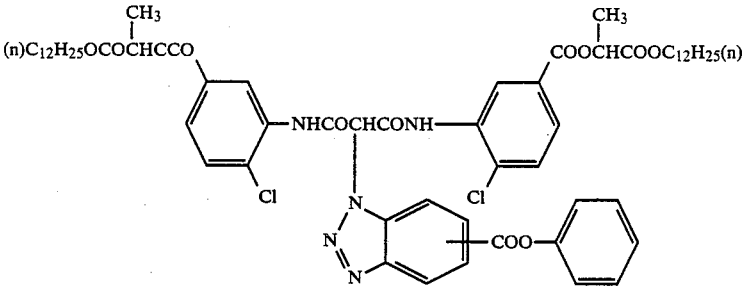
C-9
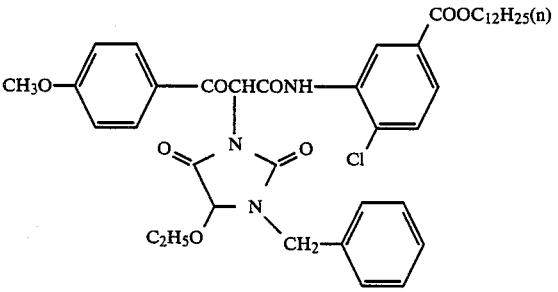

-continued
C-10
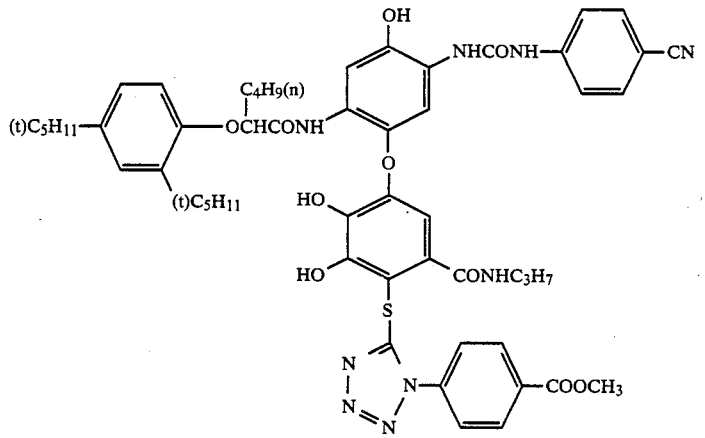
C-11
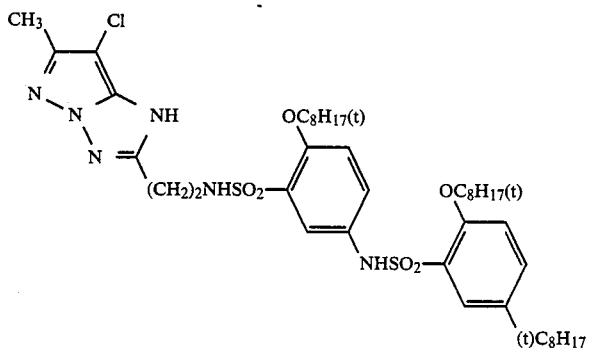
C-12
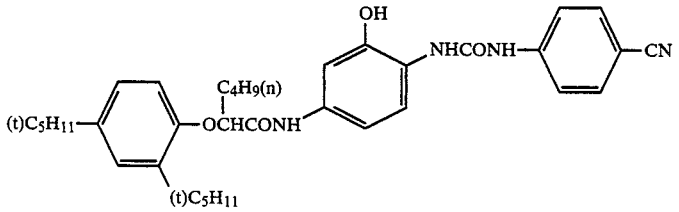
C-13
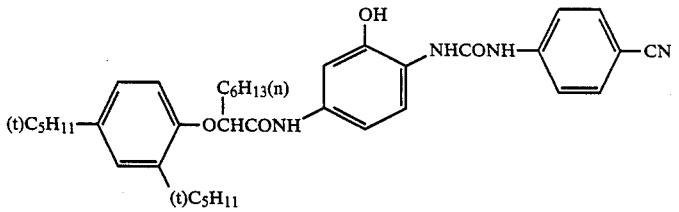
C-14
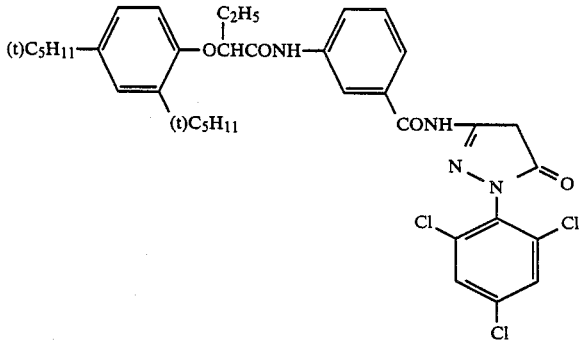

-continued

C-15

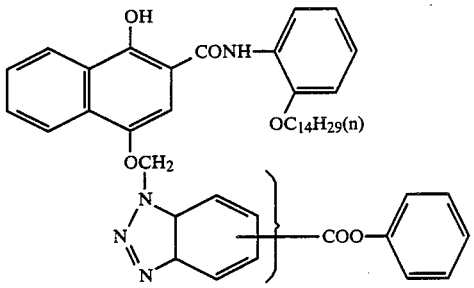

C-16

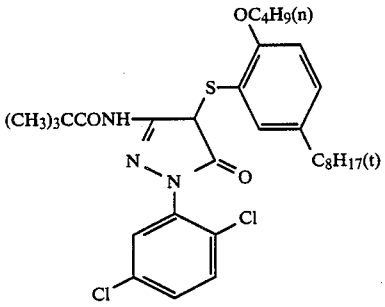

S-1

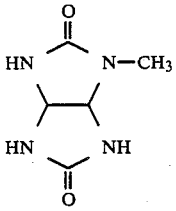

S-2

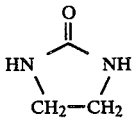

| | |
|---|---|
| Tricresyl Phosphate | HBS-1 |
| Dibutyl Phthalate | HBS-2 |
| Tri-n-hexyl Phosphate | HBS-3 |

H-1

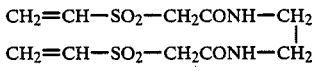

Stabilizing Dyes I to VIII are the same as those employed in Examples 1 and 2.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, at least one layer of said silver halide color photographic material containing the combination of a magenta dye forming coupler represented by general formula (I) and a compound which is not a coupler represented by general formula (II)

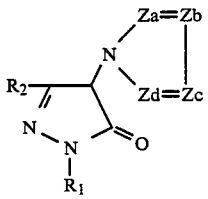

(I)

wherein $R_1$ represents an aromatic group, an aliphatic group or a heterocyclic group; $R_2$ represents a substituent; and Za, Zb, Zc and Zd, which may be the same or different, each represents an unsubstituted methine group, a substituted methine group or —N=, $$(R'—COO^-)_nM^{n+} \quad (II)$$

wherein R′ represents a substituent which imparts a diffusion-resistant property to the compound represented by the general formula (II) and wherein R′ contains a total of from 8 to 40 carbon atoms, and represents a straight chain or branched chain alkyl group, an alkenyl group, an alkynyl group, a cyclic alkyl group, an aralkyl group, a cyclic alkenyl group, an aryl group, or a heterocyclic group; $M^{n+}$ represents a hydrogen ion, a metal ion or an ammonium ion; and n represents an integer from 1 to 4.

2. A silver halide color photographic material as claimed in claim 1, wherein $R_1$ represents a straight chain or branched chain alkyl group having from 1 to 32 carbon atoms, an alkenyl group, a cyclic alkyl group, an aralkyl group, a cyclic alkenyl group, an aryl group, or a heterocyclic group.

3. A silver halide color photographic material as claimed in claim 1, wherein $R_2$ represents a straight chain or branched chain alkyl group having from 1 to 32 carbon atoms, an alkenyl group, a cyclic alkyl group, an aralkyl group, a cyclic alkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a thioureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, an acyloxy group, a sulfonyloxy group, a cyano group, a hydroxy group, a mercapto group, a halogen atom, a nitro group, or a sulfo group.

4. A silver halide color photographic material as claimed in claim 3, wherein $R_2$ represents an anilino group, an acylamino group, or an arylureido group.

5. A silver halide color photographic material as claimed in claim 2, wherein $R_1$ represents an aryl group which is substituted with at least one chlorine atom at an o-position thereof.

6. A silver halide color photographic material as claimed in claim 1, wherein the nitrogen containing ring formed by Za, Zb, Zc and Zd further comprises a condensed ring, with the exception of a benzotriazolyl-1 group and a benzotriazolyl-2 group.

7. A silver halide color photographic material as claimed in claim 1, wherein $M^{n+}$ represents an ion of a group I element in the Periodic Table, an ion of a group II element in the Periodic Table, an ion of a group VIII element in the Periodic Table, or an ammonium ion.

8. A silver halide color photographic material as claimed in claim 7, wherein $M^{n+}$ represents an anion of a group I element in the Periodic Table, and anion of a group II element in the Periodic Table, or an ammonium ion.

9. A silver halide color photographic material as claimed in claim 8, wherein $M^{n+}$ represents $H^+$, $Na^+$, $K^+$, or $NH_4^+$.

10. A silver halide color photographic material as claimed in claim 9, wherein $M^{n+}$ represents $H^+$.

11. A silver halide color photographic material as claimed in claim 1, wherein the amount of said magenta coupler in said layer is from about $5\times10^{-4}$ mol to 1 mol per mol of silver halide present said layer or an adjacent layer.

12. A silver halide color photographic material as claimed in claim 1, wherein the amount of said compound represented by general formula (II) in said layer is from about 0.003 mol to 1 mol per mol of said magenta coupler.

13. A method for processing an imagewise exposed silver halide color photographic material comprising a color developing step and a drying step, said silver halide color photographic material comprising a support having thereon at least one silver halide emulsion layer, at least one layer of said silver halide color photographic material containing the combination of a magenta dye forming coupler represented by general formula (I) and a compound which is not a coupler represented by general formula (II)

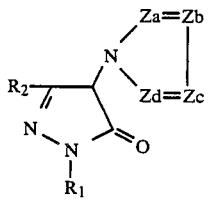

(I)

wherein $R_1$ represents an aromatic group, an aliphatic group or a heterocyclic group; $R_2$ represents a substituent; and Za, Zb, Zc and Zd, which may be the same or different, each represents an unsubstituted methine group, a substituted methine group or —N=, $$(R'-COO^-)_nM^{n+} \quad (II)$$

wherein R′ represents a substituent which imparts a diffusion-resistant proerty to the compound represented by the general formula (II) and wherein R′ contains a total of from 8 to 40 carbon atoms, and represents a straight chain or branched chain alkyl group, an alkenyl group, an alkynyl group, a cyclic alkyl group, an aralkyl group, a cyclic alkenyl group, an aryl group, or a heterocyclic group; $M^{n+}$ represents a hydrogen ion, a metal ion or an ammonium ion; and n represents an integer from 1 to 4, wherein the period of time from the beginning of said color developing step to the end of said drying step is at most about 15 minutes.

14. A method for processing an imagewise exposed silver halide color photographic material comprising a color developing step and a drying step, said silver halide color photographic material comprising a support having thereon at least one silver halide emulsion layer, at least one layer of said silver halide color photographic material containing the combination of a magenta dye forming coupler represented by general formula (I) and a compound which is not a coupler represented by general formula (II)

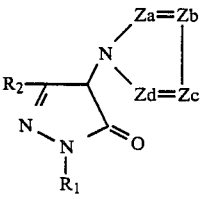

(I)

wherein $R_1$ represents an aromatic group, an aliphatic group or a heterocyclic group; $R_2$ represents a substituent; and Za, Zb, Zc and Zd, which may be the same or different, each represents an unsubstituted methane group, a substituted methine group or —N=, $$(R'—COO^-)_nM^{n+} \quad (II)$$

wherein R′ represents a substituent which imparts a diffusion-resistant property to the compound represented by the general formula (II) and wherein R′ contains a total of from 8 to 40 carbon atoms, and represents a straight chain or branched chain alkyl group, an alkenyl group, an alkynyl group, a cyclic alkyl group, an aralkyl group, a cyclic alkenyl group, an aryl group, or a heterocyclic group; $M^{n+}$ represents a hydrogen ion, a metal ion or an ammonium ion; and n represents an integer from 1 to 4, wherein the duration of said drying step is at most about 8 minutes.

15. A method for processing an imagewise exposed silver halide color photographic material comprising a color developing step and a drying step, said silver halide color photographic material comprising a support having thereon at least one silver halide emulsion layer, at least one layer of said silver halide color photographic material containing the combination of a magenta dye forming coupler represented by general formula (I) and a compound which is not a coupler represented by general formula (II)

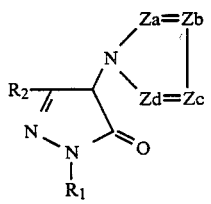

(I)

wherein $R_1$ represents an aromatic group, an aliphatic group or a heterocyclic group; $R_2$ represents a substituent; and Za, Zb, Zc and Zd, which may be the same or different, each represents an unsubstituted methine group, a substituted methine group or —N=, $$(R'—COO^-)_nM^{n+} \quad (II)$$

wherein R′ represents a substituent which imparts a diffusion-resistant property to the compound represented by the general formula (II) and wherein R′ contains a total of from 8 to 40 carbon atoms, and represents a straight chain or branched chain alkyl group, an alkenyl group, an alkynyl group, a cyclic alkyl group, an aralkyl group, a cyclic alkenyl group, an aryl group, or a heterocyclic group; $M^{n+}$ represents a hydrogen ion, a metal ion or an ammonium ion; and n represents an integer from 1 to 4, said method including the steps of (a) treating said silver halide color photographic material with a bath having fixing ability, and thereafter (b) subjecting said color photographic material to a water washing or stabilizing step, wherein the amount of replenisher for the washing water or stabilizing solution is from about 1 to 50 times the weight amount carried over from the preceding bath per unit area of said color photographic material.

16. A method for processing a silver halide color photographic material as claimed in claim 13, wherein the duration of said drying step is from about 4 to 12 minutes.

17. A method for processing a silver halide color photographic material as claimed in claim 16, wherein the duration of said drying step is from about 5 to 10 minutes.

18. A method for processing a silver halide color photographic material as claimed in claim 14, wherein the duration of said drying step is from about 45 seconds to 6 minutes.

19. A method for processing a silver halide color photographic material as claimed in claim 18, wherein the duration of said drying step is from 1 to 5 minutes.

20. A method for processing a silver halide color photographic material as claimed in claim 15, wherein the washing water or the stabilizing solution in said washing step or said stabilizing step contains calcium and magnesium in a concentration of at most about 5 mg/l.

21. A method for processing a silver halide color photographic material as claimed in claim 15, wherein said washing step or said stabilizing step is conducted using at least 2 tanks.

22. A method for processing a silver halide color photographic material as claimed in claim 15, wherein the duration of said washing or stabilizing step is at most about 2 minutes.

23. A method for processing a silver halide color photographic material as claimed in claim 13, wherein said method comprises a blix step.

24. A method for processing a silver halide color photographic material as claimed in claim 14, wherein said method comprises a blix step.

25. A method for processing a silver halide color photographic material as claimed in claim 15, wherein said bath having fixing ability is a blix step.

26. A method for processing a silver halide color photographic material as claimed in claim 23, wherein the preceding bath of said blix step is a bleaching step.

27. A method for processing a silver halide color photographic material as claimed in claim 24, wherein the preceding bath of said blix step is a bleaching step.

28. A method for processing a silver halide color photographic material as claimed in claim 25, wherein the preceding bath of said blix step is a bleaching step.

29. A method for processing a silver halide color photographic material as claimed in claim 15, wherein the amount of said replenisher is from about 5 to 20 times the amount carried over from said preceding bath.

* * * * *